US010655808B2

(12) United States Patent
Takada et al.

(10) Patent No.: US 10,655,808 B2
(45) Date of Patent: May 19, 2020

(54) VEHICLE LAMP

(71) Applicant: KOITO MANUFACTURING CO., LTD., Tokyo (JP)

(72) Inventors: Kenichi Takada, Shizuoka (JP); Tatsuma Kitazawa, Shizuoka (JP); Hiroki Kawai, Shizuoka (JP); Teruaki Yamamoto, Shizuoka (JP); Akira Hanada, Shizuoka (JP); Kenta Oishi, Shizuoka (JP); Akinori Matsumoto, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/313,711

(22) PCT Filed: Jun. 28, 2017

(86) PCT No.: PCT/JP2017/023825
§ 371 (c)(1),
(2) Date: Dec. 27, 2018

(87) PCT Pub. No.: WO2018/003888
PCT Pub. Date: Jan. 4, 2018

(65) Prior Publication Data

US 2019/0145595 A1 May 16, 2019

(30) Foreign Application Priority Data

Jun. 29, 2016 (JP) ..... 2016-129204
Jun. 29, 2016 (JP) ..... 2016-129205
(Continued)

(51) Int. Cl.
*F21S 41/147* (2018.01)
*F21S 41/25* (2018.01)
(Continued)

(52) U.S. Cl.
CPC ..... *F21S 41/147* (2018.01); *F21S 41/151* (2018.01); *F21S 41/25* (2018.01); *F21V 5/04* (2013.01); *F21Y 2115/10* (2016.08)

(58) Field of Classification Search
CPC ..... F21S 41/147; F21S 41/25; F21S 41/151; F21V 5/04; F21Y 2115/10
See application file for complete search history.

(56) References Cited

U.S. PATENT DOCUMENTS

2005/0094411 A1* 5/2005 Ishida ..... B60Q 1/0041 362/538
2006/0120094 A1* 6/2006 Tsukamoto ..... F21S 41/143 362/518
(Continued)

FOREIGN PATENT DOCUMENTS

CN 102563484 A 7/2012
DE 10-2015-224745 A1 6/2017
(Continued)

OTHER PUBLICATIONS

Search Report dated Oct. 3, 2017, issued by the International Searching Authority in International Application No. PCT/JP2017/023825 (PCT/ISA/210).
(Continued)

*Primary Examiner* — Donald L Raleigh
(74) *Attorney, Agent, or Firm* — Sughrue Mion, PLLC

(57) ABSTRACT

A vehicle lamp includes a projection lens, a first light source disposed behind the projection lens and configured to emit light forming a low-beam light distribution pattern which is a predetermined light distribution pattern, a reflector configured to reflect light emitted from the first light source toward a first rear focal point of the projection lens, and a second array light source disposed behind the projection lens and having a plurality of semiconductor light emitting elements arranged in at least one row. The second array light
(Continued)

source is configured to emit light forming an additional light distribution pattern, and the center position or maximum light intensity position of the additional light distribution pattern overlaps with the low-beam light distribution pattern on a virtual vertical screen in front of the lamp.

18 Claims, 35 Drawing Sheets

(30) Foreign Application Priority Data

Jun. 29, 2016 (JP) ..... 2016-129206
Oct. 17, 2016 (JP) ..... 2016-203784

(51) Int. Cl.
*F21S 41/151* (2018.01)
*F21V 5/04* (2006.01)
*F21Y 115/10* (2016.01)

(56) References Cited

U.S. PATENT DOCUMENTS

2007/0070638 A1 3/2007 Fukawa et al.
2007/0201241 A1* 8/2007 Komatsu ..... F21S 41/143 362/545
2009/0097268 A1* 4/2009 Mochizuki ..... F21S 41/147 362/538
2011/0205748 A1 8/2011 Yatsuda
2012/0051071 A1* 3/2012 Okubo ..... F21S 41/147 362/465
2012/0106187 A1 5/2012 Uchida
2012/0262935 A1* 10/2012 Yamamoto ..... B60Q 1/14 362/516
2014/0321147 A1* 10/2014 Todaka ..... F21S 41/19 362/516
2015/0009700 A1* 1/2015 Yamamoto ..... F21S 41/147 362/538
2015/0219301 A1* 8/2015 Honda ..... F21S 41/336 362/517
2017/0227184 A1* 8/2017 Ishida ..... F21S 41/00
2017/0343173 A1 11/2017 Takada et al.

FOREIGN PATENT DOCUMENTS

JP 2007-80605 A 3/2007
JP 2007-227228 A 9/2007
JP 2009-134963 A 6/2009
JP 2011-175818 A 9/2011
JP 2012-226860 A 11/2012
JP 5152563 B2 2/2013
JP 2013-242996 A 12/2013
JP 2015-018828 A 1/2015
JP 2015-170388 A 9/2015
JP 2016-39020 A 3/2016
WO 2013099144 A1 7/2013
WO 2015176340 A1 11/2015

OTHER PUBLICATIONS

Written Opinion dated Oct. 3, 2017, issued by the International Searching Authority in International Application No. PCT/JP2017/023825 (PCT/ISA/237).
Communication dated Jan. 17, 2020, from the State Intellectual Property Office of People's Republic of China in counterpart Application No. 201780040106.6.
Communication dated Jan. 31, 2020, from the European Patent Office in counterpart European Application No. 17820242.0.

* cited by examiner

VEHICLE LAMP

TECHNICAL FIELD

The disclosure relates to a vehicle lamp.

BACKGROUND ART

Recently; a vehicle lamp including an array light source in which a plurality of semiconductor light emitting elements such as LEDs (Light Emitting Diodes) is arranged in a row has been developed.

A vehicle lamp which is a projector type optical system using a single projection lens and includes an array light source is disclosed in Patent Document 1.

Further, recently, a vehicle lamp using a projection lens having a large number of focal points has been developed.

A vehicle lamp which includes a projection lens having a large number of focal points, a light source for low-beam light distribution, and a light source for high-beam light distribution has been suggested in Patent Document 2. According to this vehicle lamp, it is possible to design various light distribution patterns by each light source.

CITATION LIST

Patent Document

Patent Document 1: JP-A-2016-039020
Patent Document 2: JP-A-2011-175818

DISCLOSURE OF INVENTION

Problems to be Solved by Invention

However, in the lamp of Patent Document 1, the array light source is used as a light source for forming an additional high-beam light distribution pattern and is not used for a low-beam light distribution pattern formed by a projector type optical system.

Further, in the lamp of Patent Document 1, the light source disposed just below the reflector is used as a light source for forming a low-beam light distribution pattern and is not used for other applications.

Furthermore, in the lamp of Patent Document 2, the projection lens is divided into upper and lower parts, and thus, there is room for improvement in the appearance design when seeing the lamp from the front.

A first object of the disclosure is to provide a vehicle lamp capable of reinforcing a predetermined light distribution pattern formed by a projector type optical system.

A second object of the disclosure is to provide a vehicle lamp capable of improving the degree of freedom in designing a light distribution pattern by increasing the applications of a light source of a projector type optical system.

A third object of the disclosure is to provide a vehicle lamp capable of suppressing the deterioration in the design of the lamp and improving the degree of freedom in designing a light distribution pattern.

Means for Solving the Problems

In order to achieve the first object, a vehicle lamp according to the disclosure includes a projection lens;

a light source disposed behind the projection lens and configured to emit light forming a predetermined light distribution pattern;

a reflector configured to reflect the light emitted from the light source toward a rear focal point of the projection lens; and an array light source disposed behind the projection lens and having a plurality of semiconductor light emitting elements arranged in at least one row, in which the array light source is configured to emit light forming an additional light distribution pattern, and in which the center position or maximum light intensity position of the additional light distribution pattern overlaps with the predetermined light distribution pattern on a virtual vertical screen in front of the lamp.

According to this configuration, the array light source forms the additional light distribution pattern, and the center position or the maximum light intensity position of the additional light distribution pattern overlaps, on the virtual vertical screen in front of the lamp, with a predetermined light distribution pattern formed by a projector type optical system. Therefore, the light emitted from the array light source can be used as light extending far in front of the lamp and as light spreading in the left and right direction, for example. Thus, the light can be used to reinforce the predetermined light distribution pattern.

Further, in order to achieve the first object, in the vehicle lamp of the disclosure, the array light source may be disposed at the position corresponding to the rear focal point.

According to this configuration, the light emitted from the array light source can be irradiated to the front of the lamp as the clear additional light distribution pattern. For example, the light can be used as light for enhancing the function of road surface irradiation.

Further, in order to achieve the first object, in the vehicle lamp of the disclosure, the array light source may have a first array light source and a second array light source, the projection lens may have a first lens portion forming a first rear focal point and a second lens portion forming a second rear focal point, and the second array light source may be disposed below the first array light source and configured to emit light forming the additional light distribution pattern, and the light may be incident on an incident surface of the second lens portion.

According to this configuration, the light emitted from the second array light source disposed below the first array light source can be used as light extending far in front of the lamp and as light spreading in the left and right direction. Further, the light can be used to reinforce the predetermined light distribution pattern formed by a projector type optical system.

Further, in order to achieve the first object, in the vehicle lamp of the disclosure, the first array light source may be disposed at the position corresponding to the first rear focal point, and the second array light source may be disposed at the position corresponding to the second rear focal point.

According to this configuration, the light emitted from the second array light source can be irradiated to the front of the lamp as the clear additional light distribution pattern. For example, the light can be used as light for enhancing the function of road surface irradiation.

Further, in order to achieve the first object, in the vehicle lamp of the disclosure, the array light source may have a first array light source and a second array light source, the projection lens may have a first lens portion forming the first rear focal point and a second lens portion forming a second rear focal point, and the first array light source may be disposed above the second array light source and configured to emit light forming the additional light distribution pattern, and the light may be incident on an incident surface of the second lens portion.

According to this configuration, the light emitted from the first array light source disposed above the second array light source can be used as light extending far in front of the lamp and as light spreading in the left and right direction. Further, the light can be used to reinforce the predetermined light distribution pattern formed by a projector type optical system.

Further, in order to achieve the first object, in the vehicle lamp of the disclosure, the vehicle lamp may include an optical member configured to cause the light emitted from the first array light source to be incident on the incident surface of the second lens portion, and the first array light source may be disposed above the second rear focal point and the light may be incident on the incident surface of the second lens portion via the optical member.

According to this configuration, the light emitted from the first array light source can be irradiated to the front of the lamp as the clear additional light distribution pattern. For example, the light can be used as light for enhancing the function of road surface irradiation.

In order to achieve the second object, a vehicle lamp according to the disclosure includes a projection lens;

a light source disposed behind the projection lens and configured to emit light forming a predetermined light distribution pattern;

a reflector configured to reflect the light emitted from the light source toward the projection lens;

an array light source disposed behind the projection lens and having a plurality of semiconductor light emitting elements arranged in at least one row, an optical member disposed behind the projection lens; and a drive mechanism configured to move the optical member to a first position and a second position, in which the optical member functions as a shade portion for forming a cut-off line in the predetermined light distribution pattern when the optical member is moved to the first position by the drive mechanism, and in which a light distribution pattern larger than the light distribution pattern formed when the optical member is moved to the first position is formed when the optical member is moved to the second position by the drive mechanism.

According to this configuration, by moving the optical member from the first position to the second position by the chive mechanism, the light emitted from the light source can be used not only as light forming the light distribution pattern including the cut-off line, but also as light forming the light distribution pattern different from the light distribution pattern. Since the light distribution pattern different from the predetermined light distribution pattern including the cut-off line can be formed by using the light source of the projector type optical system in this manner, the applications such as overlapping the light distribution pattern of the array light source are increased, and hence, the degree of freedom in designing the light distribution pattern is improved.

Further, in order to achieve the second object, in the vehicle lamp of the disclosure, the predetermined light distribution pattern may be a first light distribution pattern for low beam, and a second light distribution pattern formed by the light source when the optical member is moved to the second position by the drive mechanism may be enlarged above the first light distribution pattern on a virtual vertical screen in front of the lamp.

According to this configuration, the light emitted from the light source is extended far in front of the lamp and can contribute to improvement in far visibility.

Further, in order to achieve the second object, in the vehicle lamp of the disclosure, the array light source may be configured to emit light forming an additional light distribution pattern for high beam, and the array light source may be configured so that the second light distribution pattern and the additional light distribution pattern overlap with each other on the virtual vertical screen in front of the lamp when the optical member is moved to the second position by the drive mechanism.

According to this configuration, the portion where the second light distribution pattern and the additional light distribution pattern overlap with each other can be made brighter.

Further, in order to achieve the second object, in the vehicle lamp of the disclosure, the optical member may also function as a reflector configured to reflect at least a part of light emitted from the array light source toward the projection lens when moved to the first position by the drive mechanism.

According to this configuration, the optical member can be used as a reflector for the array light source, which can contribute to improvement in utilization efficiency of light of the array light source.

Further, in order to achieve the second object, in the vehicle lamp of the disclosure, the vehicle lamp may include a base member on which the light source and the array light source are disposed, and the optical member may be a part separate from the base member and may be moved to the first position and the second position along a front and rear direction of the lamp by the drive mechanism.

According to this configuration, it is possible to constitute a mechanism for moving the optical member with a simple structure.

Further, in order to achieve the second object, in the vehicle lamp of the disclosure, the array light source may have a first array light source and a second array light source, the projection lens may have a first lens portion forming a first rear focal point and a second lens portion forming a second rear focal point, the first array light source may be disposed at the position corresponding to the first rear focal point, and the second array light source may be disposed below the first array light source and at the position corresponding to the second rear focal point.

According to this configuration, a large number of semiconductor light emitting elements can be mounted on the lamp without increasing the width of the lamp in the left and right direction. Further, compared to a lamp having a single array light source, many semiconductor light emitting elements can be mounted on the lamp. Therefore, it is possible to improve the degree of freedom in designing a light distribution pattern which is added to the predetermined light distribution pattern formed by the light emitted from the light source of the projector type optical system.

In order to achieve the third object, a vehicle lamp according to the disclosure includes a projection lens having a convex exit surface based on at least one circular arc and having a first rear focal point and a second rear focal point;

a first light source disposed behind the projection lens; and a second light disposed behind the projection lens;

in which the projection lens has a first lens portion forming the first rear focal point and a second lens portion forming the second rear focal point, in which a boundary surface is provided between a first incident surface of the first lens portion and a second incident surface of the second lens portion, in which the first incident surface and the boundary surface are formed to be smoothly continuous, and in which the second incident surface and the boundary surface are formed to be smoothly continuous.

According to this configuration, the first light source and the second light source are disposed behind the projection lens having the first rear focal point and the second rear focal point. Therefore, various optical systems can be designed, and the degree of freedom in designing the light distribution pattern can be improved. Further, in the exit surface of the projection lens, the exit surface formed in a convex shape based on at least one circular arc. Therefore, the outline of the projection lens is remarkably visually recognized when seeing the lamp from the front, so that it is possible to restrain the deterioration in the design of the appearance of the lamp. Further, on the incident surface of the projection lens, the boundary surface is provided between the first incident surface and the second incident surface. Therefore, it is difficult for the boundary between the first incident surface and the second incident surface of the projection lens to be visually recognized as a dividing line (bending line) from the front of the lamp when seeing the lamp from the front, so that it is possible to restrain the deterioration in the design of the appearance of the lamp.

Further, in order to achieve the third object, in the vehicle lamp of the disclosure, the boundary surface may be formed as a curved surface recessed toward the exit surface.

According to this configuration, the boundary surface becomes less conspicuous from the front of the lamp and it is possible to restrain the deterioration in the design of the appearance of the lamp.

Further, in order to achieve the third object, in the vehicle lamp of the disclosure, the boundary surface may include a flat surface.

According to this configuration, when seeing the lamp from the front, the boundary surface becomes less conspicuous from the front of the lamp and it is possible to restrain the deterioration in the design of the appearance of the lamp.

Further, in order to achieve the third object, in the vehicle lamp of the disclosure, the boundary surface may be formed as a convex curved surface protruding toward the side opposite to the exit surface.

According to this configuration, the boundary surface becomes less conspicuous from the front of the lamp and it is possible to restrain the deterioration in the design of the appearance of the lamp. Further, since the focal region formed by the curved surface is dispersed, the light passing through the curved surface and irradiated to the front of the lamp is diffused, and a boundary line between an irradiation region and a non-irradiation region formed in front of the lamp can be made blurry.

Further, in order to achieve the third object, in the vehicle lamp of the disclosure, the exit surface may be formed on the basis of a single curved surface, and the exit surface of the projection lens may be configured by an outline based on two circular arcs when seeing the projection lens from a first direction which is one of an upper and lower direction and a left and right direction, and the exit surface of the projection lens may be configured by an outline based on one circular arc when seeing the projection lens from a second direction perpendicularly intersecting with the first direction.

According to this configuration, it is easy to optically design the first rear focal point and the second rear focal point as a band-shaped focus group while maintaining the shape of the exit surface in one curved surface shape. Further, since the light from the first light source and the second light source is spread in the upper and lower direction and the left and right direction, so that a wide range in front of the vehicle can be irradiated and the light distribution can be extended to the front and spread to the left and right.

Effects of Invention

According to this disclosure, it is possible to provide the vehicle lamp capable of reinforcing a predetermined light distribution pattern formed by a projector type optical system.

Further, according to this disclosure, it is possible to provide the vehicle lamp capable of improving the degree of freedom in designing a light distribution pattern by increasing the applications of a light source of a projector type optical system.

Further, according to this disclosure, it is possible to provide the vehicle lamp capable of suppressing the deterioration in the design of the lamp and improving the degree of freedom in designing a light distribution pattern.

BRIEF DESCRIPTION OF DRAWINGS

FIG. 2A is a left side view, FIG. 2B is a front view, and FIG. 2C is a right side view;

FIG. 6A is a front view, and FIG. 6B is a sectional view taken along the line A-A in FIG. 6A;

FIG. 18A is a left side view, FIG. 18B is a front view, and FIG. 18C is a right side view;

FIG. 22A is a front view, and FIG. 22B is a sectional view taken along the line A-A in FIG. 22A;

FIG. 24A is a sectional view in a state where the movable optical member is disposed at a first position, and FIG. 24B is a sectional view in a state where the movable optical member is disposed at a second position;

FIG. 27A is a schematic view of the light distribution pattern in a normal irradiation mode, and FIG. 27B is a schematic view of the light distribution pattern in an extended irradiation mode;

FIG. 33A is a left side view, FIG. 33B is a front view, and FIG. 33C is a right side view;

FIG. 38A is a front view, and FIG. 38B is a sectional view taken along the line A-A in FIG. 38A;

FIG. 45A is a perspective view of the projection lens as viewed from the exit surface side, and FIG. 45B is a perspective view of the projection lens as viewed from the incident surface side;

FIG. 46A is a top view of the projection lens, FIG. 46B is a front view of the projection lens, FIG. 46C is a bottom view of the projection lens, and FIG. 46D is a side view of the projection lens;

EMBODIMENT FOR CARRYING OUT INVENTION

Hereinafter, an example of the present embodiment will be described in detail with reference to the drawings.

First Embodiment

Figure 1:
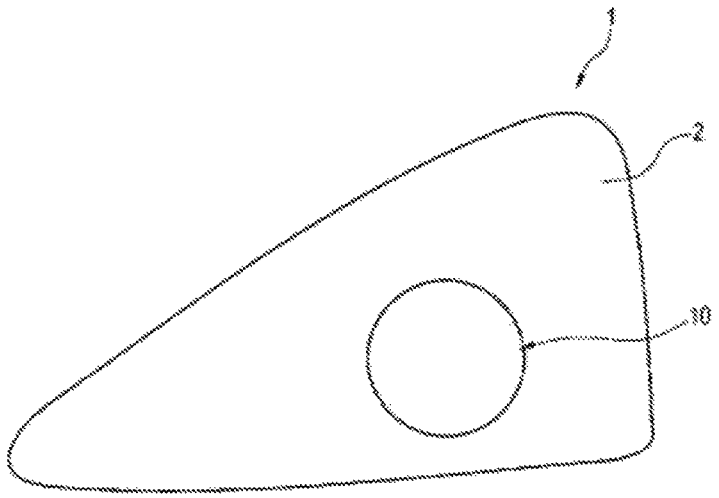
FIG. 1 is a schematic view of a headlamp including a vehicle lamp according to a first embodiment of the disclosure, as viewed from the front.

As shown in FIG. 1, a vehicle lamp 10 according to a first embodiment of the disclosure constitutes a headlamp 1 of a vehicle. The headlamp 1 is provided on the left and right of the front portion of the vehicle. Meanwhile, in FIG. 1, only the headlamp 1 on the left side of the vehicle is shown. In the present example, each headlamp 1 is configured as a monocular headlamp having one vehicle lamp 10. The vehicle lamp 10 is provided in a lamp body (not shown). A translucent cover 2 is mounted in front of the lamp body. The translucent cover 2 is mounted to the lamp body to form a lamp chamber, and the vehicle lamp 10 is disposed in the lamp chamber.

Figure 2A:
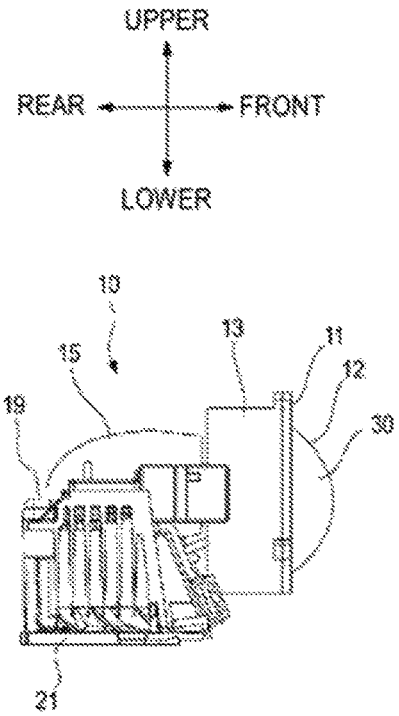
FIGS. 2A to 2C are views showing the vehicle lamp according to the first embodiment of the disclosure.
Figure 2B:
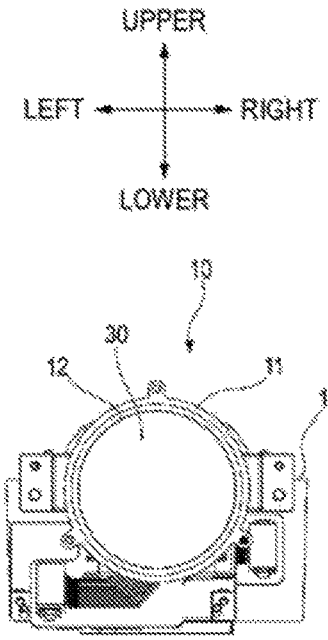
Figure 2C:
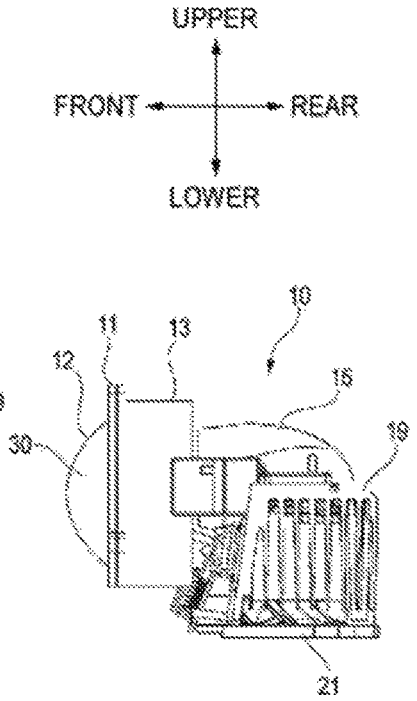
Figure 3:
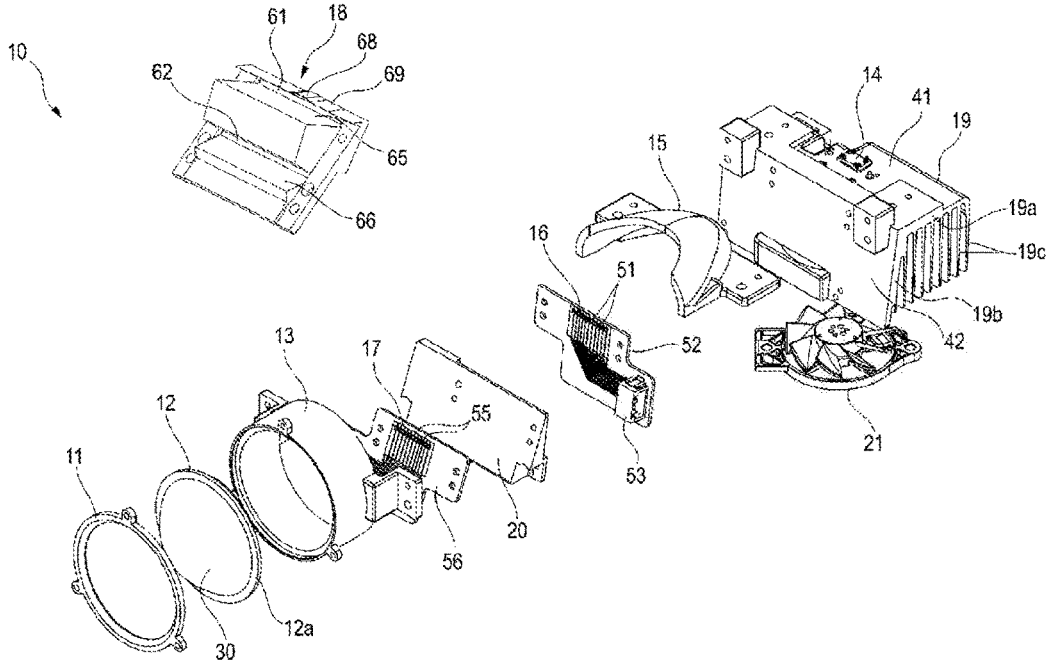
FIG. 3 is an exploded perspective view of the vehicle lamp according to the first embodiment of the disclosure.
Figure 4:
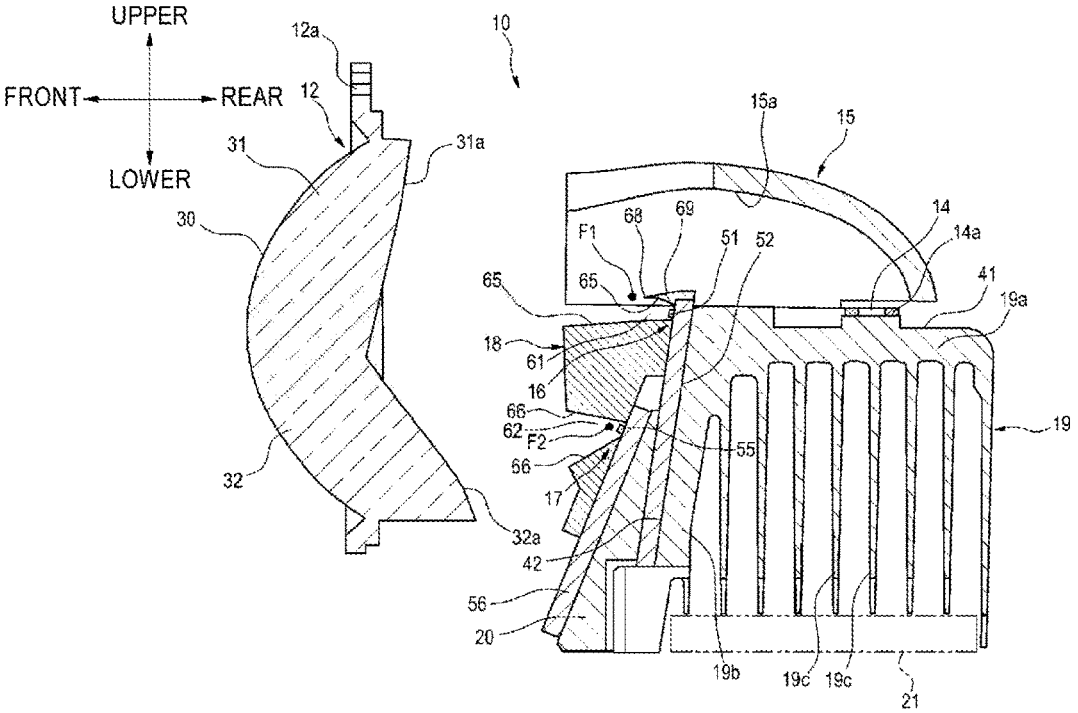
FIG. 4 is a sectional view of the vehicle lamp according to the first embodiment of the disclosure.

As shown in FIGS. 2 to 4, the vehicle lamp 10 includes a fixing ring 11, a projection lens 12, a lens holder 13, a low-beam light source (an example of the light source) 14, a reflector 15, a first array light source 16, a second array light source 17, an optical member 18, a base member 19, a fixing member 20, and a fan 21.

The vehicle lamp 10 is, for example, a headlamp capable of selectively performing low-beam irradiation and high-beam irradiation and is configured as a projector type lamp unit.

The projection lens 12 has a convex exit surface 30 based on one circular arc at its front surface. The projection lens 12 has a circular shape when viewed from the front of the lamp. The projection lens 12 has a first lens portion 31 forming a first rear focal point F1 and a second lens portion 32 forming a second rear focal point F2. The projection lens 12 has a first incident surface 31*a* on the side of the first lens portion 31 opposite to the exit surface 30 and has a second incident surface 32*a* on the side of the second lens portion 32 opposite to the exit surface 30.

The projection lens 12 forms the first rear focal point F1 on an optical axis of the first incident surface 31*a* of the first lens portion 31 and forms the second rear focal point F2 on an optical axis of the second incident surface 32*a* of the second lens portion 32. The projection lens 12 projects a light source image formed on each of focal planes including the first rear focal point F1 and the second rear focal point F2 as an inverted image onto a virtual vertical screen in front of the lamp. The first rear focal point F1 and the second rear focal point F2 are arranged up and down such that the first rear focal point F1 is located above the second rear focal point F2. In this manner, the projection lens 12 is a multi-focal lens having two rear focal points F1, F2.

The projection lens 12 is disposed on the front portion of the lens holder 13 formed in a cylindrical shape. The fixing ring 11 is fixed to the lens holder 13 from the front side. An outer peripheral flange portion 12*a* of the projection lens 12 is sandwiched between the lens holder 13 and the fixing ring 11, so that the projection lens 12 is supported on the front portion of the lens holder 13. The lens holder 13 for supporting the projection lens 12 is fixed to the base member 19. In this way, the projection lens 12 is supported on the base member 19 via the lens holder 13.

The base member 19 is formed of a metal material having excellent thermal conductivity such as aluminum, for example. The base member 19 has an upper wall portion 19*a* formed in a horizontal plane shape and an inclined wall portion 19*b* extending obliquely downward and forward from a front end of the upper wall portion 19*a*. In the upper wall portion 19*a*, a plurality of heat-dissipation fins 19*c* extending downward from a lower surface thereof are arranged side by side in a front and rear direction. The fan 21 is disposed below the base member 19. Wind generated from the fan 21 is sent from the lower side to the heat-dissipation fins 19*c* extending downward.

In the base member 19, an upper surface of the upper wall portion 19*a* is a first surface 41, and a front surface of the inclined wall portion 19*b* is a second surface 42. The low-beam light source 14 is disposed on the first surface 41 of the base member 19, and the first array light source 16 and the second array light source 17 are disposed on the second surface 42 of the base member 19.

The low-beam light source 14 is configured by, for example, a white light emitting diode, and its upper surface side is a light emitting surface. The low-beam light source 14 is disposed behind the projection lens 12. In this example, the low-beam light source 14 emits light forming a low-beam light distribution pattern. The low-beam light source 14 is fixed to the first surface 41 of the upper wall portion 19*a* of the base member 19 via an attachment 14*a*.

The reflector 15 is fixed to the first surface 41 of the upper wall portion 19*a* of the base member 19 so as to cover the low-beam light source 14 from the upper side. An inner surface side of the reflector 15 is formed as a reflecting surface 15*a*. The reflecting surface 15*a* reflects light emitted from the low-beam light source 14 toward the projection lens 12. The reflecting surface 15*a* is formed of a curved surface having a substantially elliptical surface shape with the light emitting center of the low-beam light source 14 as a focal point. The eccentricity of the reflecting surface 15*a* is set so as to gradually increase from the vertical section to the horizontal section.

Figure 5:
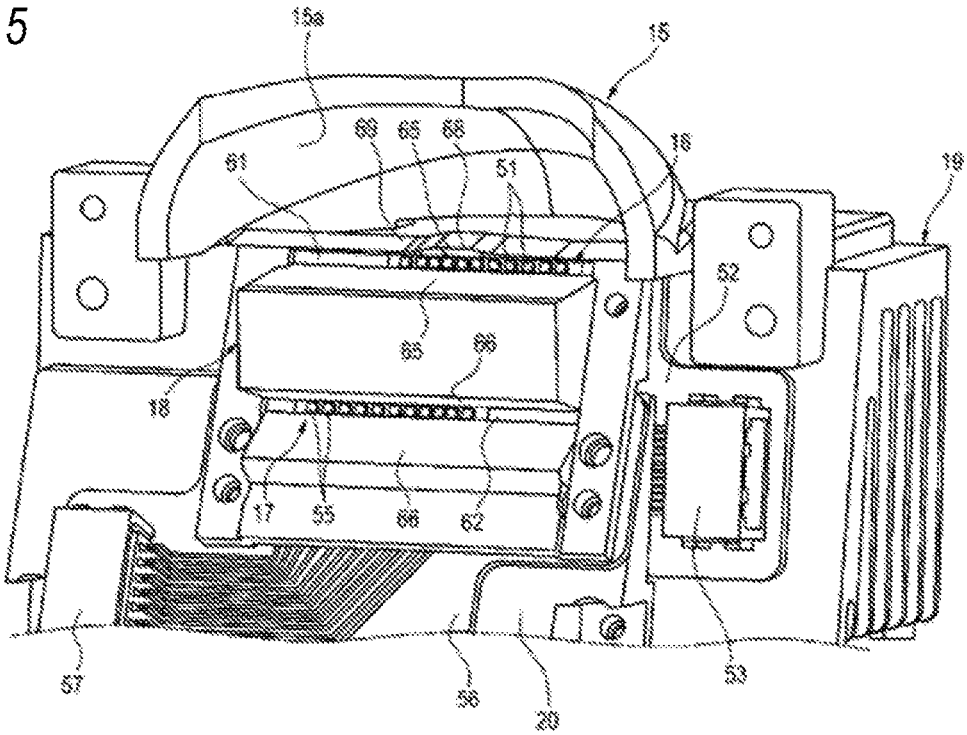
FIG. 5 is a perspective view of a base member on which a light source of the vehicle lamp according to the first embodiment is mounted.
Figure 6A:
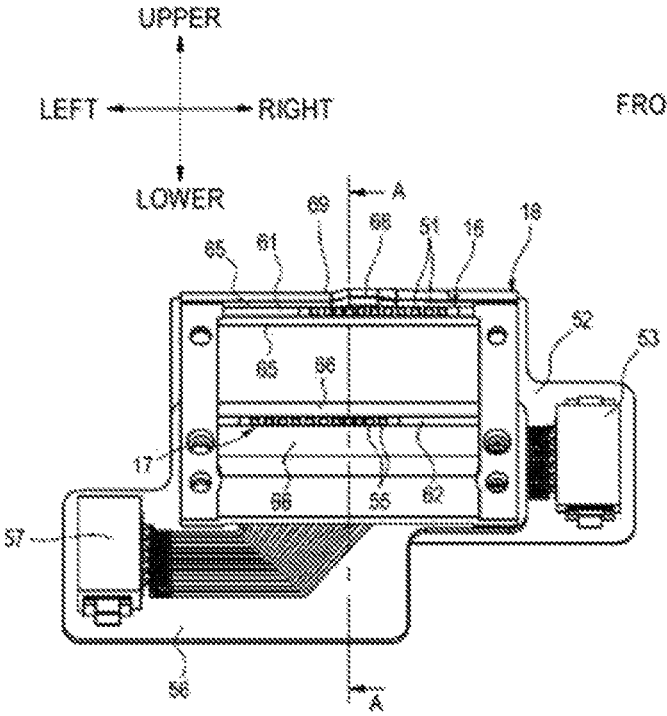
FIG. 6A and FIG. 6B are views for explaining a structure composed of a first array light source, a second array light source and an optical member of the vehicle lamp according to the first embodiment.
Figure 6B:
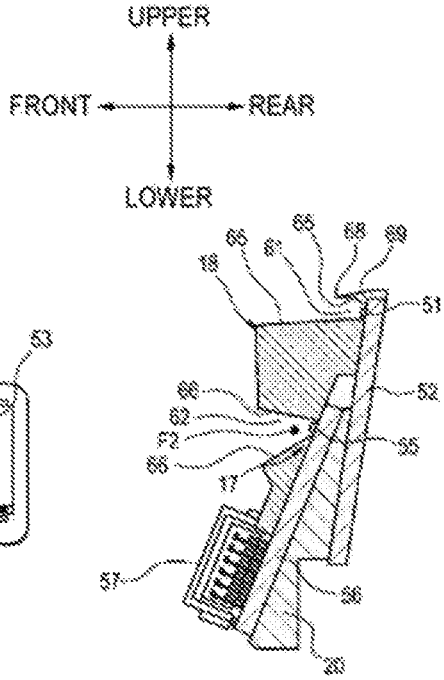

As shown in FIGS. 5 and 6, the first array light source 16 includes a plurality of (eleven in this example) semiconductor light emitting elements 51, and a substrate 52. The first array light source 16 is disposed behind the projection lens 12. The semiconductor light emitting elements 51 are arranged in a row in the left and right direction. Meanwhile, the semiconductor light emitting elements 51 may be arranged in two or more rows. Each of the semiconductor light emitting elements 51 is configured by, for example, a white light emitting diode and has, for example, an exit portion formed of a square light emitting surface. Further, in the first array light source 16, the arrangement pitch of the plurality of semiconductor light emitting elements 51 in the left and right direction of the lamp becomes denser as approaching the first rear focal point F1 of the projection lens 12.

The semiconductor light emitting elements 51 are mounted on the substrate 52. A connector 53 is provided on the substrate 52. The connector 53 is disposed on the right side of the substrate 52 in a front view. A mating connector (not shown) provided in a feeder line is connected to the connector 53 and power is supplied from the feeder line to the semiconductor light emitting elements 51. Further, the plurality of semiconductor light emitting elements 51 included in the first array light source 16 can be individually turned on.

The substrate 52 on which the semiconductor light emitting elements 51 are mounted is supported on the second surface 42 that is a front surface of the inclined wall portion 19*b* of the base member 19. The first array light source 16 is disposed at the position corresponding to the first rear focal point F1 of the projection lens 12. Meanwhile, the position corresponding to the first rear focal point F1 is not limited to the position that completely coincides with the first rear focal point F1, but is the position including the first rear focal point F1 projected as an inverted image on the virtual vertical screen in front of the lamp by the projection lens 12 and its surroundings.

By mounting the substrate 52 on the inclined second surface 42, the first array light source 16 is disposed so that the exit portion configured by the light emitting surfaces of the semiconductor light emitting elements 51 faces obliquely forward and upward. Further, the first array light source 16 is disposed so that the exit portion of the semiconductor light emitting elements 51 is located below the first rear focal point F1. That is, the second surface 42 of the base member 19 is configured as an inclined surface inclined with respect to an optical axis of the first incident surface 31*a* of the projection lens 12 so that the exit portion of the first array light source 16 is disposed below the first rear focal point F1. Furthermore, the first array light source 16 is disposed between the first rear focal point F1 of the projection lens 12 and the low-beam light source 14 in the front and rear direction of the lamp (see FIG. 4, etc.).

The second array light source 17 includes a plurality of (eleven in this example) semiconductor light emitting elements 55, and a substrate 56. The second array light source 17 is disposed behind the projection lens 12. The semiconductor light emitting elements 55 are arranged in a row in the left and right direction. Meanwhile, the semiconductor light emitting elements 55 may be arranged in two or more rows. Each of the semiconductor light emitting elements 55 is configured by, for example, a white light emitting diode and has, for example, an exit portion formed of a square light emitting surface.

The semiconductor light emitting elements 55 are mounted on the substrate 56. A connector 57 is provided on the substrate 56. The connector 57 is disposed on the left side of the substrate 56 in a front view. A mating connector (not shown) provided in a feeder line is connected to the connector 57 and power is supplied from the feeder line to the semiconductor light emitting elements 55. Further, the plurality of semiconductor light emitting elements 55 included in the second array light source 17 can be individually turned on.

The substrate 56 on which the semiconductor light emitting elements 55 are mounted is supported on the second surface 42 that is a front surface of the inclined wall portion 19*b* of the base member 19 via the fixing member 20. The fixing member 20 is formed into a tapered shape whose thickness dimension gradually decreases upward. The second array light source 17 supported on the second surface 42 of the base member 19 via the fixing member 20 is disposed at the position corresponding to the second rear focal point F2 of the projection lens 12. Meanwhile, the position corresponding to the second rear focal point F2 is not limited to the position that completely coincides with the second rear focal point F2, but is the position including the second rear focal point F2 projected as an inverted image on the virtual vertical screen in front of the lamp by the projection lens 12 and its surroundings.

The first array light source 16 and the second array light source 17 are arranged up and down. Specifically, the first array light source 16 is disposed above the second array light source 17. Further, since the second array light source 17 is fixed to the second surface 42 of the base member 19 via the fixing member 20 whose thickness dimension decreases upward, the inclination of the second array light source 17 is larger than that of the first array light source 16. In this manner, the exit portion configured by the light emitting surfaces of the semiconductor light emitting elements 55 of the second array light source 17 is oriented upward from the exit portion configured by the light emitting surfaces of the semiconductor light emitting elements 51 of the first array light source 16. That is, the exit portion of the semiconductor light emitting elements 51 of the first array light source 16 is oriented in a direction different from the exit portion of the semiconductor light emitting elements 55 of the second array light source 17 in the upper and lower direction of the lamp.

The center position of the first array light source 16 is disposed closer to the right side than the center position of the lamp in a front view, and the center position of the second array light source 17 is disposed closer to the left side than the center position of the lamp in a front view. In this manner, the center position of the first array light source 16 is disposed at a position different from the center position of the second array light source 17 in the left and right direction of the lamp.

The optical member 18 is made of a member separate from the base member 19 on which the first array light source 16 and the second array light source 17 are mounted. The optical member 18 is mounted on the front side of the first array light source 16 and the second array light source 17 supported on the base member 19. The optical member 18 is made of, for example, aluminum die casting or polycarbonate resin or the like having excellent heat resistance.

The optical member 18 has a first opening portion 61 and a second opening portion 62. The first opening portion 61 and the second opening portion 62 are formed along a width direction of the optical member 18. In a state where the optical member 18 is supported on the base member 19, the first opening portion 61 is disposed at the position corresponding to the first array light source 16, and the second opening portion 62 is disposed at the position corresponding to the second array light source 17. In this manner, the first array light source 16 is exposed toward the front of the lamp at the first opening portion 61 of the optical member 18, and the second array light source 17 is exposed toward the front of the lamp at the second opening portion 62 of the optical member 18.

In the optical member 18, upper and lower wall surfaces forming upper and lower edge portions of the first opening portion 61 are formed as first reflecting surfaces 65. The first reflecting surfaces 65 reflect light emitted from the first array light source 16 toward the first incident surface 31*a* of the projection lens 12. Further, in the optical member 18, upper and lower wall surfaces forming upper and lower edge portions of the second opening portion 6 are formed as second reflecting surfaces 66. The second reflecting surfaces 66 reflect light emitted from the second array light source 17 toward the second incident surface 32*a* of the projection lens 12. The first reflecting surfaces 65 and the second reflecting surfaces 66 are mirror-finished by aluminum vapor deposition or the like.

The optical member 18 has a shade portion 68 at its upper portion. The shade portion 68 functions as a shade forming a cut-off line of a low-beam light distribution pattern by shielding a part of light emitted from the low-beam light source 14 and reflected by the reflecting surface 15*a* of the reflector 15. An upper surface of the shade portion 68 constitutes a reflecting surface 69 for reflecting a part of light emitted from the low-beam light source 14 and reflected by the reflecting surface 15*a* of the reflector 15 upward. The reflecting surface 69 is formed to be inclined slightly forward and downward with respect to the horizontal plane and causes the reflected light to be incident on the first incident surface 31*a* of the projection lens 12. The reflecting surface 69 is mirror-finished by aluminum vapor deposition or the like.

Figure 7:
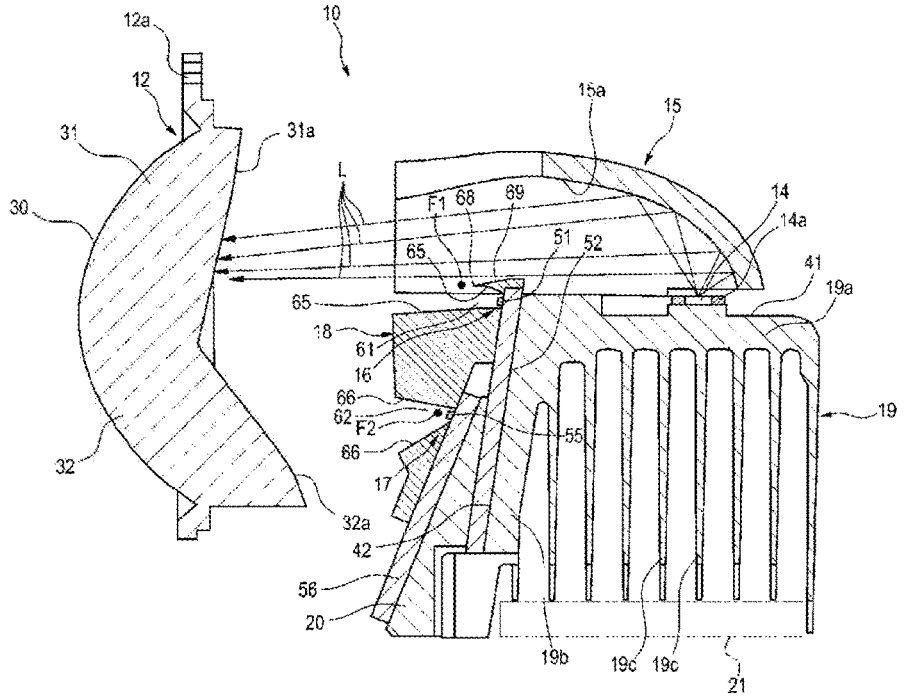
FIG. 7 is a sectional view showing a light path of a low-beam light source in the vehicle lamp according to the first embodiment.

As shown in FIG. 7, light L emitted from the low-beam light source 14 is reflected by the reflecting surface 15*a* of the reflector 15 and incident on the first incident surface 31*a* of the projection lens 12. Further, a part of the light L reflected by the reflecting surface 15*a* of the reflector 15 is reflected by the reflecting surface 69 of the optical member 18 and incident on the first incident surface 31*a* of the projection lens 12. Meanwhile, a part of the light L reflected by the reflecting surface 15*a* of the reflector 15 passes through the vicinity of the first rear focal point F1.

Figure 8:
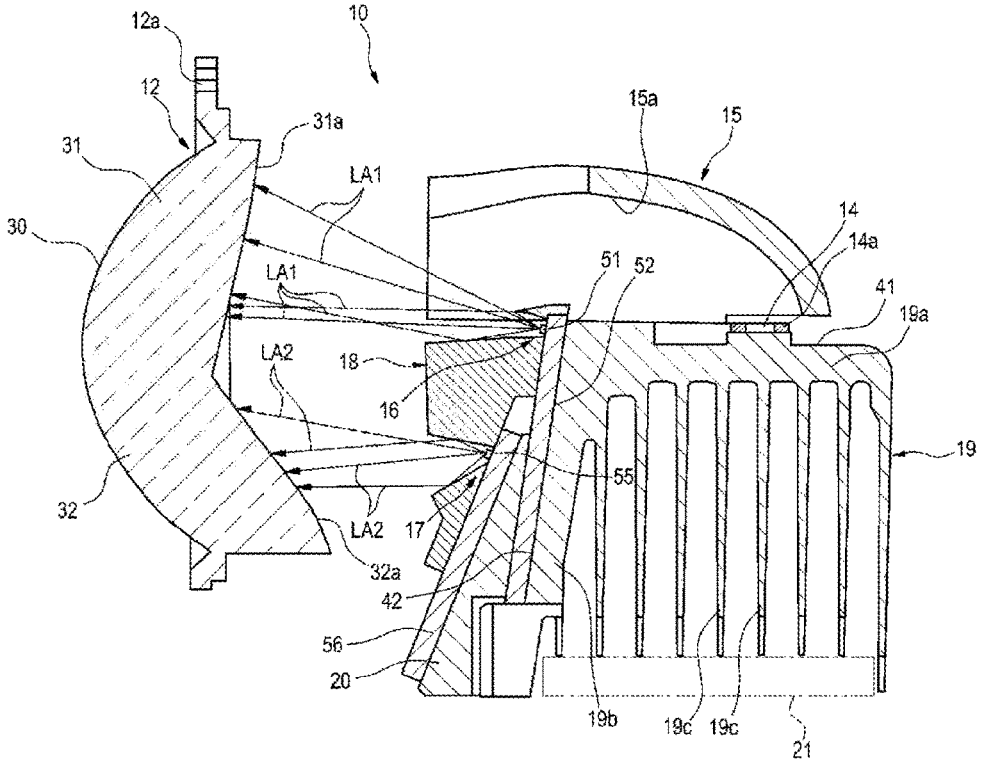
FIG. 8 is a sectional view showing light paths of the first array light source and the second array light source in the vehicle lamp according to the first embodiment.

As shown in FIG. 8, light LA1 emitted from the first array light source 16 is directly incident on the first incident surface 31*a* of the projection lens 12, or is reflected by the first reflecting surface 65 of the optical member 18 and incident on the first incident surface 31*a* of the projection lens 12. Light LA2 emitted from the second array light source 17 is directly incident on the second incident surface 32*a* of the projection lens 12, or is reflected by the second reflecting surface 66 of the optical member 18 and incident on the second incident surface 32*a* of the projection lens 12.

Figure 9:
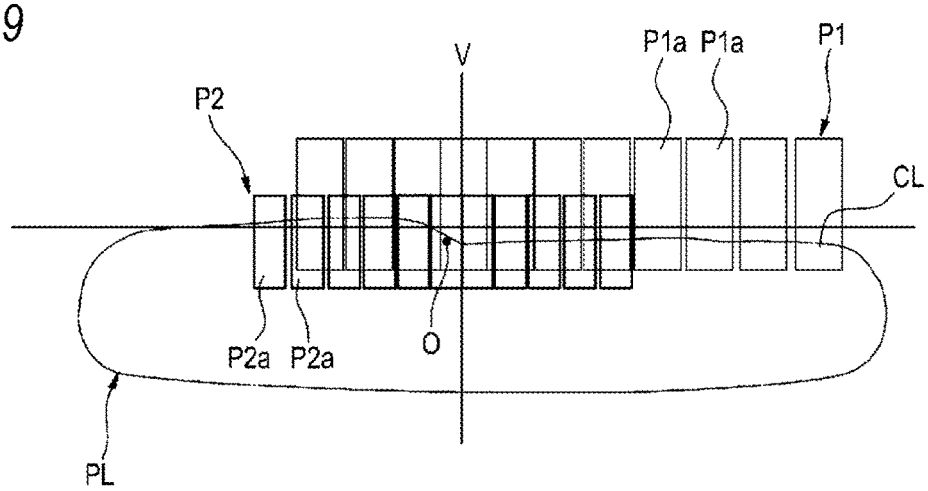
FIG. 9 is a schematic perspective view showing a light distribution pattern formed on a virtual vertical screen arranged in front of the lamp by the light irradiated from the vehicle lamp according to the first embodiment.

FIG. 9 shows a light distribution pattern projected on a virtual screen provided in a vertical direction at a position of 25 m in front of the lamp. As shown in FIG. 9, the light L emitted from the low-beam light source 14 and incident on the first incident surface 31*a* of the projection lens 12 is emitted from the exit surface 30 to form a low-beam light distribution pattern PL. A cut-off line CL is formed in the low-beam light distribution pattern PL by the shade portion 68.

The light LA1 emitted from the first array light source 16 and incident on the first incident surface 31*a* of the projection lens 12 is emitted from the exit surface 30 to form an additional light distribution pattern P1. The additional light distribution pattern P1 is a light distribution pattern in which light distribution patterns P1*a* of the semiconductor light emitting elements 51 of the first array light source 16 are laterally arranged in a row. Here, since the arrangement pitch of the semiconductor light emitting elements 51 of the first array light source 16 in the left and right direction of the lamp becomes denser as approaching the first rear focal point F1 of the projection lens 12, the illuminance at the central portion of the additional light distribution pattern P1 is increased and light is irradiated far.

The light LA2 emitted from the second array light source 17 and incident on the second incident surface 32*a* of the projection lens 12 is emitted from the exit surface 30 to form an additional light distribution pattern P2. The additional light distribution pattern P2 is a light distribution pattern in which light distribution patterns P2*a* of the semiconductor light emitting elements 55 of the second array light source 17 are laterally arranged in a row. The additional light distribution pattern P2 is formed so that its center position O overlaps with the low-beam light distribution pattern PL. Further, the additional light distribution pattern P2 may be formed so that its maximum light intensity position overlaps with the low-beam light distribution pattern PL.

The additional light distribution pattern P1 formed by the light LA1 emitted from the first array light source 16 is a high-beam light distribution pattern. On the virtual vertical screen in front of the lamp, the additional light distribution pattern P2 formed by the light LA2 emitted from the second array light source 17 overlaps with both the low-beam light distribution pattern PL formed by the light L emitted from the low-beam light source 14 and the additional high-beam light distribution pattern P1 formed by the light LA1 emitted from the first array light source 16.

Here, the low-beam light distribution pattern PL in which a cut-off line is formed by the shade portion 68 of the optical member 18 and the additional high-beam light distribution pattern P1 are difficult to overlap with each other and may not overlap with each other. Thus, the amount of light may be reduced.

On the contrary, in the vehicle lamp 10 according to the first embodiment of the disclosure, in a state where the low-beam light distribution pattern PL is formed and the additional light distribution pattern P1 as a high-beam light distribution pattern is formed, the additional light distribution pattern P2 is formed in a space between the low-beam light distribution pattern PL and the additional light distribution pattern P1 where the amount of light is reduced. In this way, the additional light distribution pattern P2 compensates for the space between the low-beam light distribution pattern PL and the additional light distribution pattern P1 where the amount of light is reduced.

Moreover, the additional light distribution pattern P2 is formed such that its center position O or maximum light intensity position overlaps with the low-beam light distribution pattern PL. Therefore, at least a part of the additional light distribution pattern P2 overlaps with the low-beam light distribution pattern PL. In this way, the low-beam light distribution pattern PL is reinforced by the additional light distribution pattern P2.

Further, among the light distribution patterns projected on the virtual vertical screen in front of the lamp, the additional light distribution pattern P1 formed by the light LA1 emitted from the semiconductor light emitting elements 51 of the first array light source 16 and the additional light distribution pattern P2 formed by the light LA2 emitted from the semiconductor light emitting elements 55 of the second array light source 17 are offset in the left and right direction. Specifically, the additional light distribution pattern P1 formed by the first array light source 16 is shifted to the right, and the additional light distribution pattern P2 formed by the second array light source 17 is shifted to the left. Meanwhile, here, the offset means a configuration in which the light distribution pattern P1*a* and the light distribution pattern P2*a* are arranged so as to partially overlap with each other in the left and right direction or a configuration in which the light distribution pattern P1*a* and the light distribution pattern P2*a* are alternately arranged in the left and right direction without overlapping.

Figure 10:
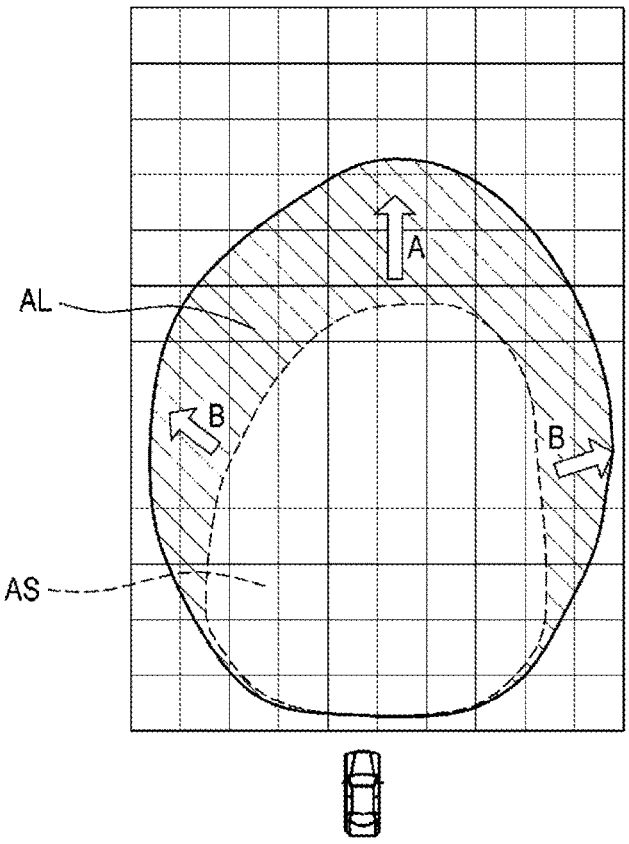
FIG. 10 is a schematic top view showing an irradiation range in front of a vehicle of the light irradiated from the vehicle lamp according to the first embodiment.

In this way, as shown in FIG. 10, while a road surface irradiation area AS is formed by a general vehicle lamp, in the first embodiment of the disclosure, the amount of light is supplemented by the additional light distribution pattern P2, and the additional light distribution pattern P1 and the additional light distribution pattern P2 are offset in the left and right direction, so that a road surface irradiation area AL enlarged to the front (direction of arrow B shown in FIG. 10) and in the left and right direction (direction of arrow A shown in FIG. 10) is formed.

Further, since the semiconductor light emitting elements 51 of the first array light source 16 and the semiconductor light emitting elements 55 of the second array light source 17 can be individually turned on, it is possible to form light distribution patterns suitable for various situations. For example, in the case where the additional light distribution pattern P1 is formed by turning off some of the semiconductor light emitting elements 51 of the first array light source 16 for irradiating the position of an oncoming vehicle so that light does not hit an oncoming vehicle detected by an in-vehicle camera, it is possible to widely irradiate the running road in front of the vehicle within a range not giving a glare to a driver of the oncoming vehicle. Similarly, in the case where the additional light distribution pattern P2 is formed by turning off some of the semiconductor light emitting elements 55 of the second array light source 17 for irradiating the position of an oncoming vehicle, it is possible to widely irradiate the running road in front of the vehicle within a range not giving a glare to a driver of the oncoming vehicle.

As described above, according to the vehicle lamp 10 of the first embodiment of the disclosure, the second array light source 17 forms the additional light distribution pattern P2, and the center position O or the maximum light intensity position of the additional light distribution pattern P2 overlaps, on a virtual vertical screen in front of the lamp, with the low-beam light distribution pattern PL which is a predetermined light distribution pattern formed by a projector type optical system. Therefore, the light LA2 emitted from the second array light source 17 can be used as light extending far in front of the lamp and as light spreading in the left and right direction. Thus, the light LA2 can be used to reinforce the low-beam light distribution pattern PL.

Further, since the second array light source 17 is disposed at the position corresponding to the second rear focal point F2, the light LA2 emitted from the second array light source 17 can be irradiated to the front of the lamp as the clear additional light distribution pattern P2. For example, the light LA2 can be used as light for enhancing the function of road surface irradiation.

Further, the vehicle lamp 10 includes the first array light source 16 that emits the light LA1 forming the additional light distribution pattern P1 that is a high-beam light distribution pattern, and the second array light source 17 is disposed below the first array light source 16. In this way, the light LA2 emitted from the second array light source 17 disposed below the first array light source 16 can be used as light extending far in front of the lamp and as light spreading in the left and right direction while suppressing the width dimension of the lamp. Further, the light LA2 can be used to reinforce the low-beam light distribution pattern PL formed by a projector type optical system.

Moreover, since the first array light source 16 is disposed at the position corresponding to the first rear focal point F1 of the first lens portion 31, and the second array light source 17 is disposed at the position corresponding to the second rear focal point F2 of the second lens portion 32, the light LA2 emitted from the second array light source 17 can be irradiated to the front of the lamp as the clear additional light distribution pattern P2. For example, the light LA2 can be used as light for enhancing the function of road surface irradiation.

Meanwhile, the formation position of the additional light distribution pattern P2 on the virtual vertical screen in front of the lamp may be located at any position, as long as the center position O or the maximum light intensity position thereof overlaps with the low-beam light distribution pattern PL.

Figure 11:
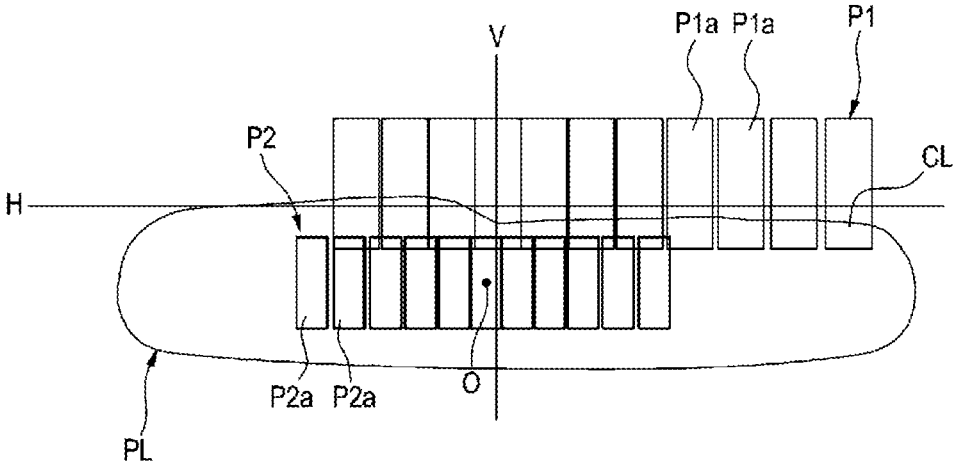
FIG. 11 is a schematic view showing another example of a light distribution pattern formed on the virtual vertical screen.

For example, as shown in FIG. 11, the additional light distribution pattern P2 formed so that the center position O or the maximum light intensity position overlaps with the low-beam light distribution pattern PL on the virtual vertical screen in front of the lamp may be formed so that the whole thereof is arranged within the low-beam light distribution pattern PL. In this way, it is possible to reliably reinforce the low-beam light distribution pattern PL.

Further, in the first embodiment of the disclosure, the vehicle lamp 10 includes the first array light source 16 for forming the additional light distribution pattern P1 that is a high-beam light distribution pattern. However, only the second array light source 17 that forms the additional light distribution pattern P2 for reinforcing the low-beam light distribution pattern PL may be provided in the vehicle lamp 10, and the first array light source 16 for forming the additional light distribution pattern P1 that is a high-beam light distribution pattern may be provided in another lamp.

Further, in the present example, the low-beam light source 14 is described as an example of a light source of a projector type optical system. However, the disclosure is not limited to this example. This light source may be a light source of a projector type optical system (a projection type optical system using a reflector and a projection lens) and the light distribution pattern may be set in accordance with its application. For example, the light source may be a light source for forming a light distribution pattern suitable for road surface irradiation or a light source for forming a light distribution pattern to be irradiated toward a specific object.

Subsequently, modifications of the vehicle lamp 10 according to the first embodiment will be described.

Modification 1 of First Embodiment

Figure 12:
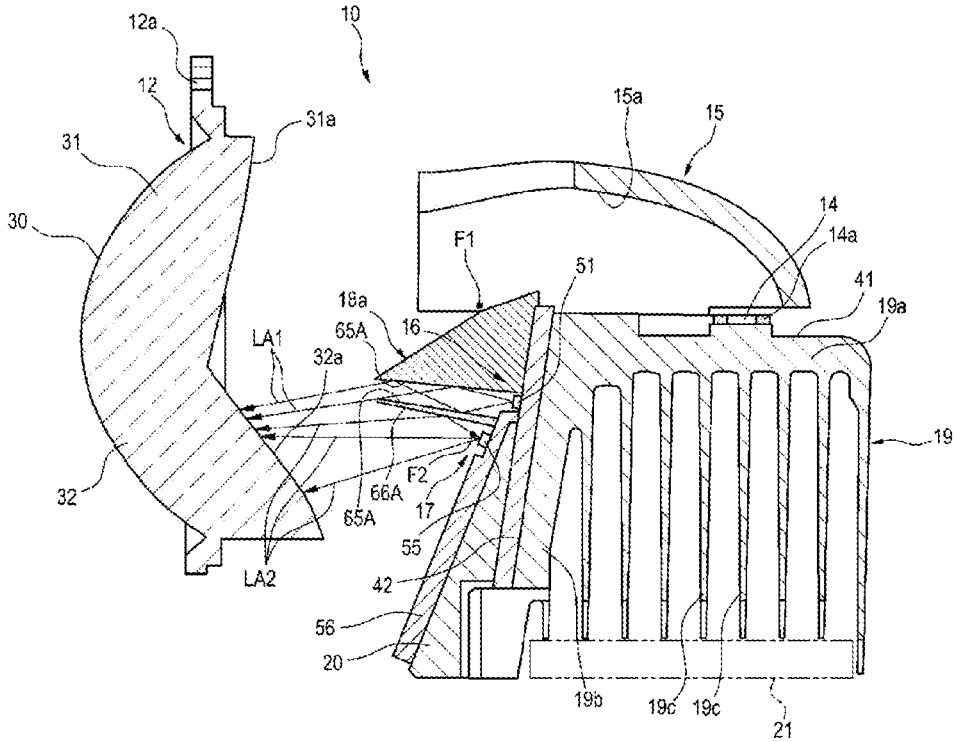
FIG. 12 is a schematic sectional view of a vehicle lamp for explaining a modification 1 of the first embodiment.

As shown in FIG. 12, a lamp of a modification 1 of the first embodiment includes the multifocal projection lens 12 having the first lens portion 31 forming the first rear focal point F1 and the second lens portion 32 forming the second rear focal point F2. Further, the lamp of the A modification 1 includes the first array light source 16 and the second array light source 17. The first array light source 16 is disposed above the second array light source 17. The second array light source 17 is disposed at the position corresponding to the second rear focal point F2, and the first array light source 16 is disposed above the second rear focal point F2.

The lamp of the modification 1 includes an optical member 18*a* which is separate from the base member 19. The optical member 18*a* has a first reflecting surface 65A for reflecting the light LA1 emitted from the first array light source 16 toward the second incident surface 32*a* that is an incident surface of the second lens portion 32 of the projection lens 12. Further, the optical member 18*a* has a second reflecting surface 66A for reflecting the light LA2 emitted from the second array light source 17 toward the second incident surface 32*a* that is an incident surface of the second lens portion 32 of the projection lens 12. Further, the light LA1 emitted from the first array light source 16 is incident on the second incident surface 32*a* of the second lens portion 32 via the optical member 18*a*, and the light LA2 emitted from the second array light source 17 is incident on the second incident surface 32*a* of the second lens portion 32 via the optical member 18*a*. Meanwhile, a part of the light LA1, LA2 of the first array light source 16 and the second array light source 17 is directly incident on the second incident surface 32*a* of the second lens portion 32.

Figure 13:
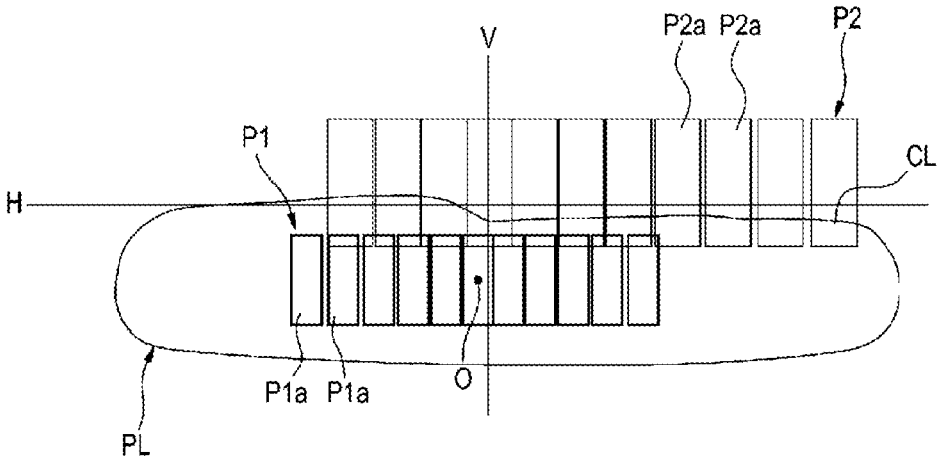
FIG. 13 is a schematic view of a light distribution pattern formed on the virtual vertical screen by the light irradiated from the vehicle lamp according to the modification 1 of the first embodiment.

As shown in FIG. 13, in the lamp of the modification 1, the light LA1 emitted from the first array light source 16 and incident on the second incident surface 32*a* of the projection lens 12 is emitted from the exit surface 30 to form the additional light distribution pattern P1. The additional light distribution pattern P1 is a light distribution pattern in which the light distribution patterns P1*a* of the semiconductor light emitting elements 51 of the first array light source 16 are laterally arranged in a row. The additional light distribution pattern P1 is formed so that the center position O or the maximum light intensity position thereof overlaps with the low-beam light distribution pattern PL. Further, the light LA2 emitted from the second array light source 17 and incident on the second incident surface 32*a* of the projection lens 12 is emitted from the exit surface 30 to form the additional light distribution pattern P2. The additional light distribution pattern P2 is a light distribution pattern which is a high-beam light distribution pattern and in which the light distribution patterns P2*a* of the semiconductor light emitting elements 55 of the second array light source 17 are laterally arranged in a row.

In this example, the additional light distribution pattern P1 formed so that the center position O or the maximum light intensity position overlaps with the low-beam light distribution pattern PL on the virtual vertical screen in front of the lamp is entirely arranged in an overlapping manner within the low-beam light distribution pattern PL.

According to this configuration, the light LA1 emitted from the first array light source 16 disposed above the second array light source 17 can be used as light extending far in front of the lamp and as light spreading in the left and right direction. Thus, the light LA1 can be used to reinforce the low-beam light distribution pattern PL that is a predetermined light distribution pattern formed by the projector type optical system.

Further, the light LA1 emitted from the first array light source 16 is caused to be incident on the second incident surface 32*a* that is an incident surface of the second lens portion 32 by the optical member 18*a*. In this way, the light LA1 emitted from the first array light source 16 can be irradiated to the front of the lamp as the additional light distribution pattern P1. For example, the light LA1 can be used as light for enhancing the function of road surface irradiation.

Meanwhile, also in the lamp of the modification 1 of the first embodiment, the additional light distribution pattern P1 formed by the light LA1 emitted from the first array light source 16 may be formed to overlap with both the low-beam light distribution pattern PL formed by the light emitted from the low-beam light source 14 and the additional high-beam light distribution pattern P2 formed by the light LA2 emitted from the second array light source 17 on the virtual vertical screen in front of the lamp. In this way, the additional light distribution pattern P1 can compensate for the space between the low-beam light distribution pattern PL and the additional light distribution pattern P2 where the amount of light is reduced.

Modification 2 of First Embodiment

Figure 14:
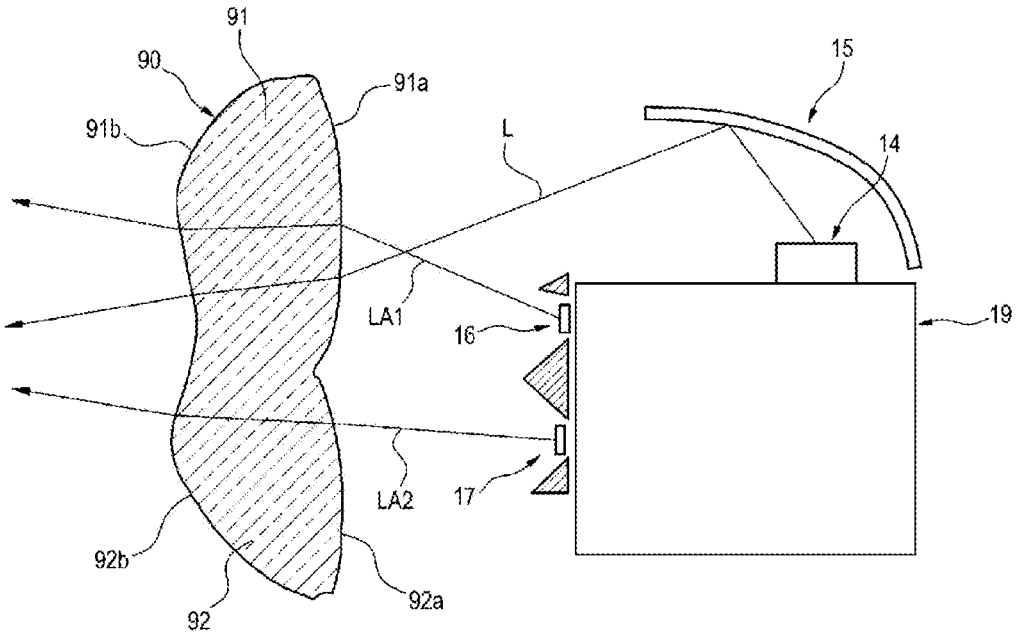
FIG. 14 is a schematic sectional view of a vehicle lamp for explaining a modification 2 of the first embodiment.

As shown in FIG. 14, a lamp of a modification 2 of the first embodiment includes a projection lens 90 in which a convex shape of an exit surface is split up and down. Specifically, the projection lens 90 has a first lens portion 91 on the upper side and a second lens portion 92 on the lower side. The first lens portion 91 and the second lens portion 92 are integrated. The first lens portion 91 has a first incident surface 91*a* and a first exit surface 91*b*, and the second lens portion 92 has a second incident surface 92*a* and a second exit surface 92*b*.

In the lamp of the modification 2, the light L emitted from the low-beam light source 14 and the light LA1 emitted from the first array light source 16 are incident on the first incident surface 91*a* of the first lens portion 91 and emitted from the first exit surface 91*b*. Further, the light LA2 emitted from the second array light source 17 is incident on the second incident surface 92*a* of the second lens portion 92 and emitted from the second exit surface 92*b*.

According to this structure, for example, the light LA2 emitted from the second array light source 17 can be used as light extending far in front of the lamp and as light spreading in the left and right direction. Thus, the light LA2 can be used to reinforce the low-beam light distribution pattern PL. Meanwhile, by providing an optical member, the light LA1 emitted from the first array light source 16 may be used to reinforce the low-beam light distribution pattern PL.

Further, according to the above structure, the light distribution pattern can be extended to the front of the lamp and spread to the left and right while suppressing cost.

Modification 3 of First Embodiment

Figure 15:
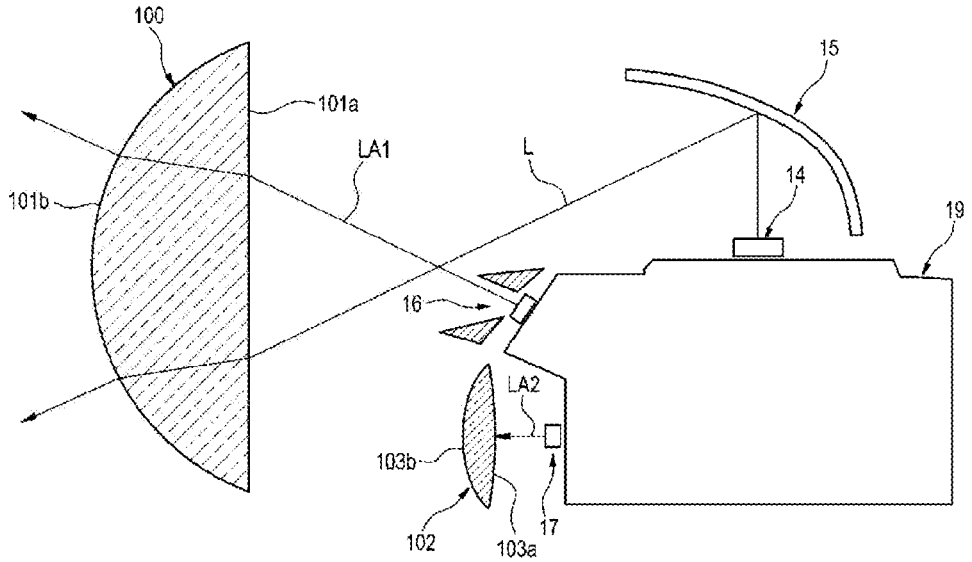
FIG. 15 is a schematic sectional view of a vehicle lamp for explaining a modification 3 of the first embodiment.

As shown in FIG. 15, a lamp of a modification 3 of the first embodiment includes a projection lens 100 and a sub lens 102. Each of the projection lens 100 and the sub lens 102 is a single focus lens. The projection lens 100 has an incident surface 101*a* and an exit surface 101*b*. Further, the sub lens 102 has an incident surface 103*a* and an exit surface 103*b*. The sub lens 102 is disposed between the second array light source 17 and the projection lens 100.

In the lamp of the modification 3, the light L emitted from the low-beam light source 14 and the light LA1 emitted from the first array light source 16 are incident on the incident surface 101*a* of the projection lens 100 and emitted from the exit surface 101*b*. Further, the light LA2 emitted from the second array light source 17 is incident on the incident surface 103*a* of the sub lens 102 and emitted from the exit surface 103*b*. And then, the light LA2 is incident on the incident surface 101*a* of the projection lens 100 and emitted from the exit surface 101*b*.

According to this structure, for example, the light LA2 emitted from the second array light source 17 can be used as light extending far in front of the lamp and as light spreading in the left and right direction. Thus, the light LA2 can be used to reinforce the low-beam light distribution pattern PL. Meanwhile, by providing an optical member, the light LA1 emitted from the first array light source 16 may be used to reinforce the low-beam light distribution pattern PL.

Further, according to this structure, the projection lens 100 seen from the front of the lamp has a single focal point. Therefore, the light LA2 emitted from the second array light source 17 can be guided in a predetermined direction by the sub lens 102, and the light distribution pattern can be extended to the front of the lamp and spread to the left and right while improving the appearance from the front of the lamp.

Modification 4 of First Embodiment

Figure 16:
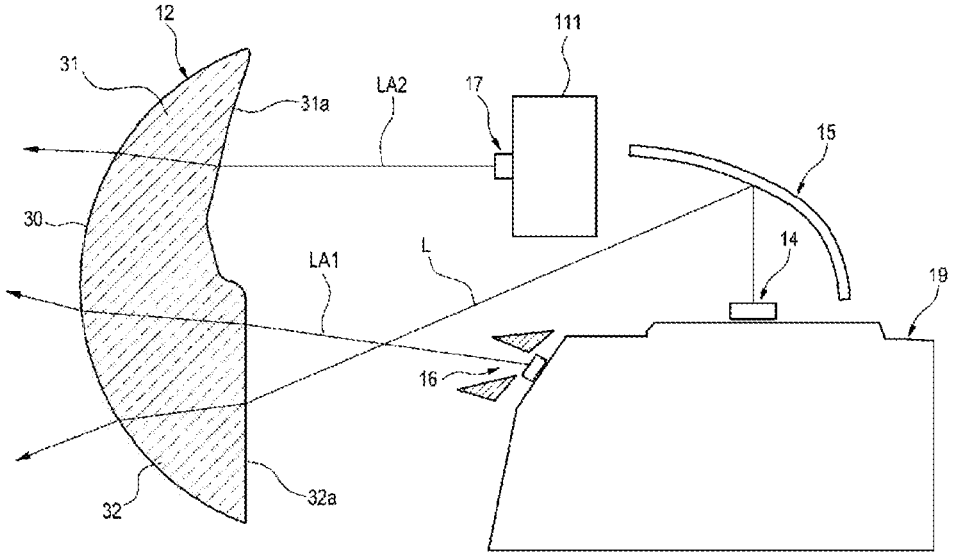
FIG. 16 is a schematic sectional view of a vehicle lamp for explaining a modification 4 of the first embodiment.

As shown in FIG. 16, in a lamp of a modification 4 of the first embodiment, the second array light source 17 is supported not on the base member 19 but on a bracket 111 disposed at a position different from the base member 19, and the second array light source 17 is disposed above the first array light source 16.

In the lamp of the modification 4, the light L emitted from the low-beam light source 14 and the light LA1 emitted from the first array light source 16 are incident on the second incident surface 32*a* of the projection lens 12 and emitted from the exit surface 30. Further, the light LA2 emitted from the second array light source 17 is incident on the first incident surface 31*a* of the projection lens 12 and emitted from the exit surface 30.

According to this structure, for example, the light LA2 emitted from the second array light source 17 can be used as light extending far in front of the lamp and as light spreading in the left and right direction. Thus, the light LA2 can be used to reinforce the low-beam light distribution pattern PL. Meanwhile, in the lamp of the modification 4 of the first embodiment, by providing an optical member, the light LA1 emitted from the first array light source 16 may be used to reinforce the low-beam light distribution pattern PL.

According to this structure, the light distribution can be extended and spread while maintaining good appearance from the front of the lamp.

Second Embodiment

Hereinafter, an example of a second embodiment of the disclosure will be described in detail with reference to the drawings.

Figure 17:
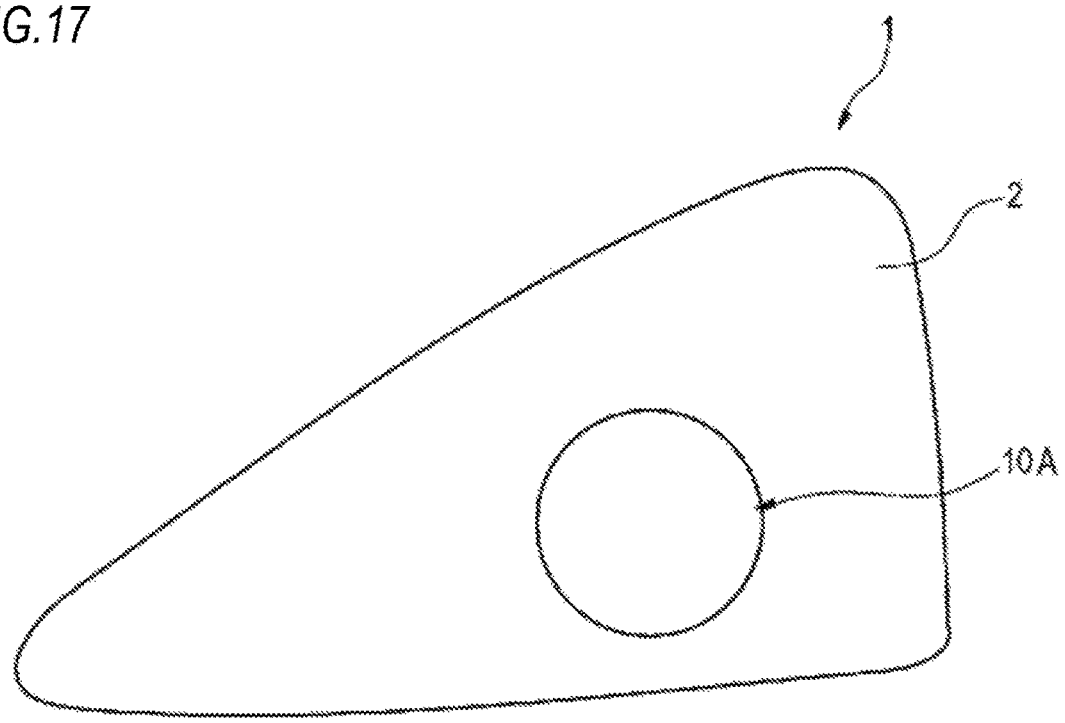
FIG. 17 is a schematic view of a headlamp including a vehicle lamp according to a second embodiment of the disclosure, as viewed from the front.

As shown in FIG. 17, a vehicle lamp 10A according to the second embodiment of the disclosure constitutes the headlamp 1 of a vehicle. The headlamp 1 is provided on the left and right of the front portion of the vehicle. Meanwhile, in FIG. 17, only the headlamp 1 on the left side of the vehicle is shown. In the present example, each headlamp 1 is configured as a monocular headlamp having one vehicle lamp 10A. The vehicle lamp 10A is provided in a lamp body (not shown). The translucent cover 2 is mounted in front of the lamp body. The translucent cover 2 is mounted to the lamp body to form a lamp chamber, and the vehicle lamp 10A is disposed in the lamp chamber.

Figure 18A:
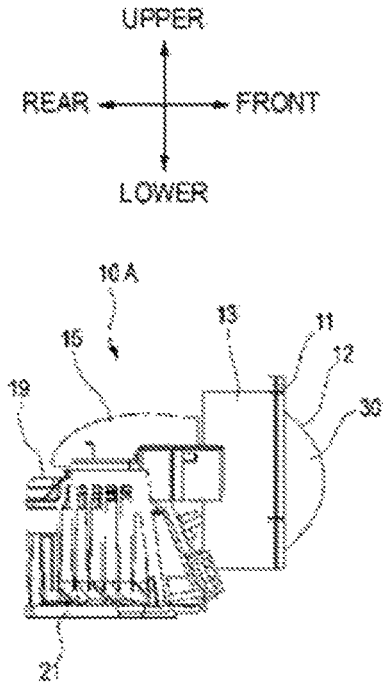
FIGS. 18A to 18C are views showing the vehicle lamp according to the second embodiment of the disclosure.
Figure 18B:
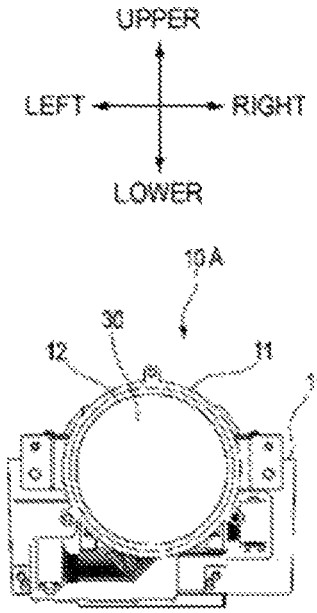
Figure 18C:
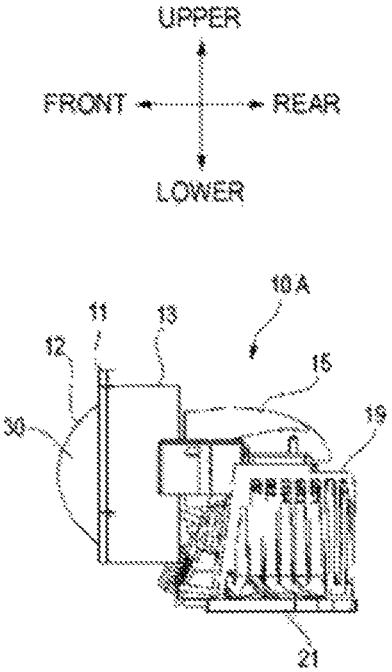
Figure 19:
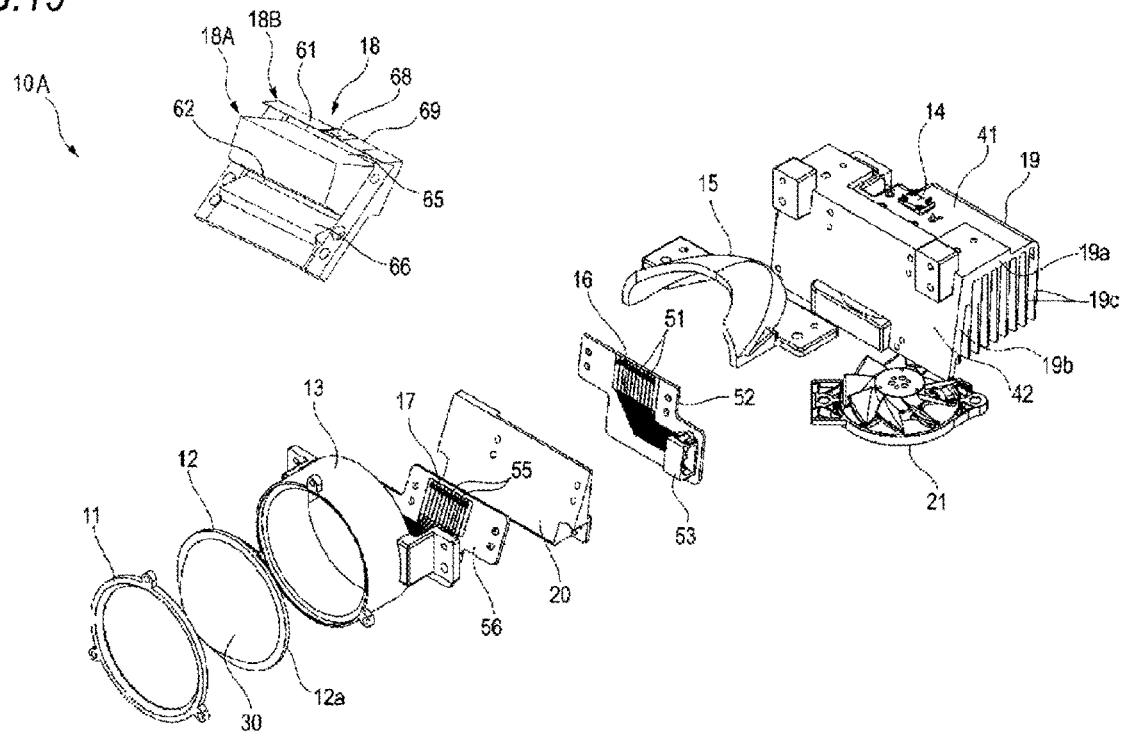
FIG. 19 is an exploded perspective view of the vehicle lamp according to the second embodiment of the disclosure.
Figure 20:
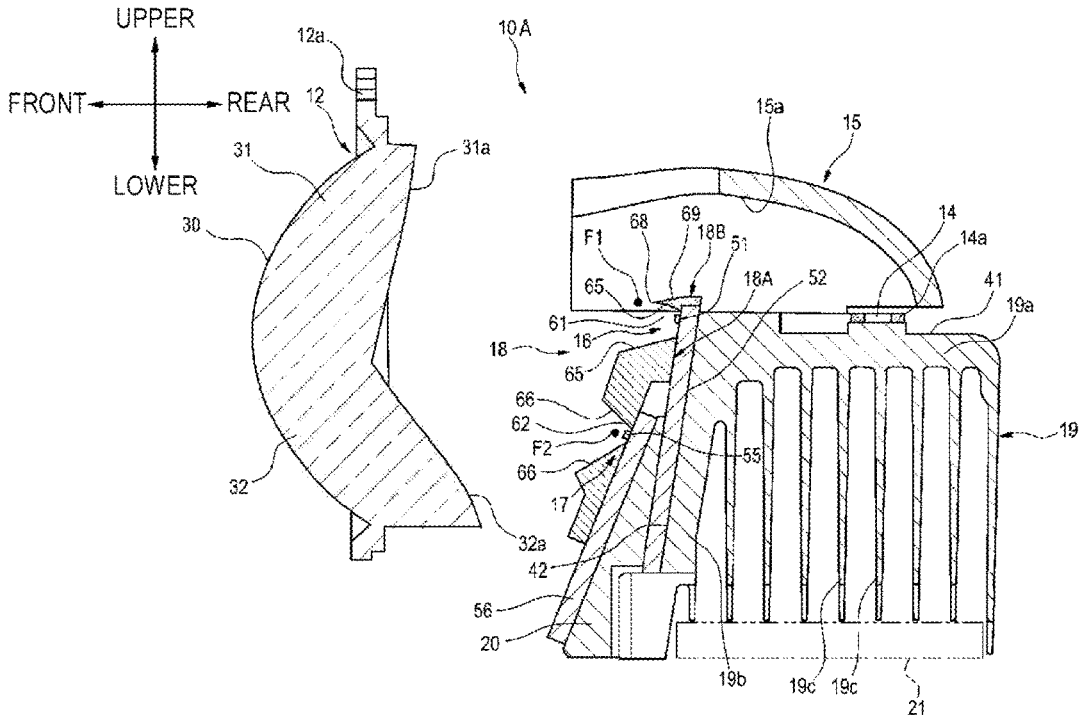
FIG. 20 is a sectional view of the vehicle lamp according to the second embodiment of the disclosure.
Figure 21:
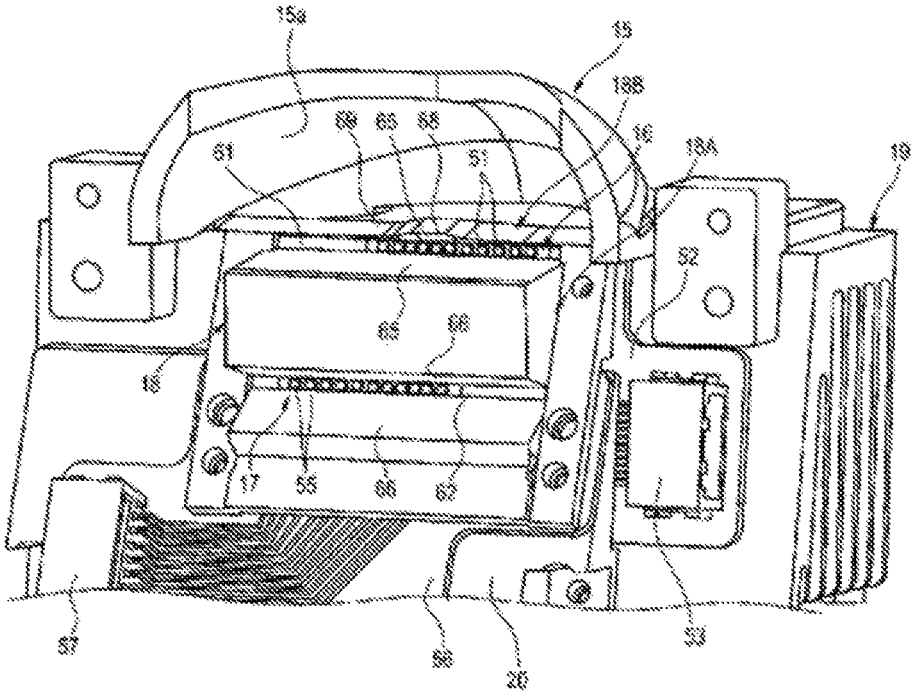
FIG. 21 is a perspective view of a base member on which a light source of the vehicle lamp according to the second embodiment is mounted.
Figure 22A:
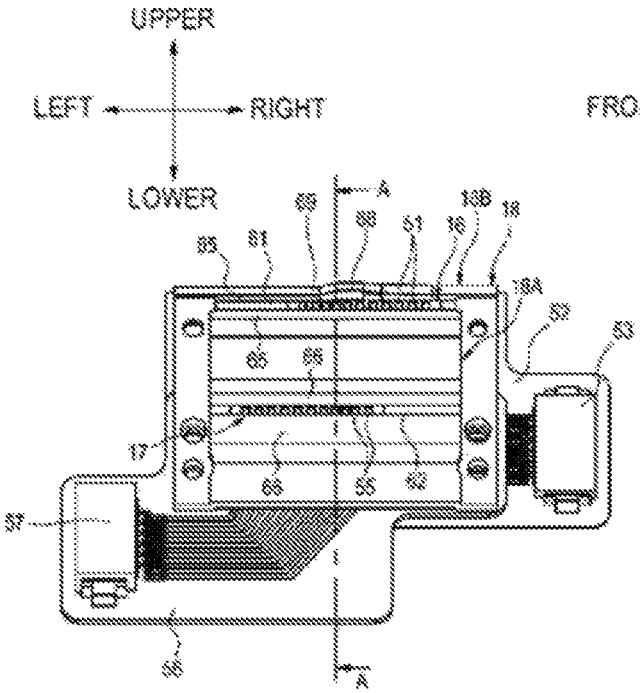
FIG. 22A and FIG. 22B are views for explaining a structure composed of a first array light source, a second array light source and an optical member of the vehicle lamp according to the second embodiment.
Figure 22B:
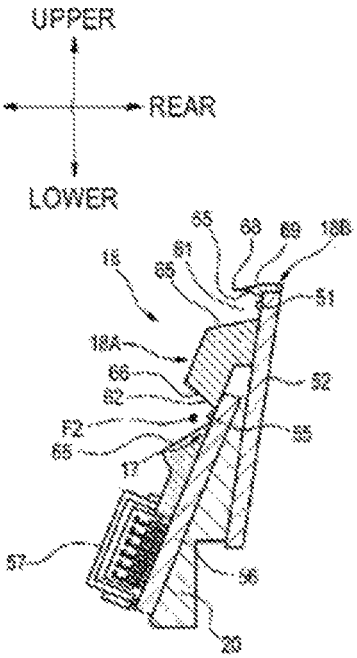

As shown in FIGS. 18 to 20, the vehicle lamp 10A includes the fixing ring 11, the projection lens 12, the lens holder 13, the low-beam light source (an example of the light source) 14, the reflector 15, the first array light source 16, the second array light source 17, the optical member 18, the base member 19, the fixing member 20, and the fan 21. Meanwhile, the configurations of the fixing ring 11, the projection lens 12, the lens holder 13, the low-beam light source 14, the reflector 15, the first array light source 16, the second array light source 17, the base member 19, the fixing member 20, and the fan 21 of the vehicle lamp 10A according to the second embodiment are the same as those of the first embodiment. Accordingly, these parts are denoted by the same reference numerals and description thereof will be omitted.

Similar to the first embodiment, the optical member 18 of the second embodiment is made of a member separate from the base member 19 on which the first array light source 16 and the second array light source 17 are mounted. The optical member 18 is mounted on the front side of the first array light source 16 and the second array light source 17 supported on the base member 19. The optical member 18 is made of, for example, aluminum die casting or polycarbonate resin or the like having excellent heat resistance.

Similar to the first embodiment, the optical member 18 has the first opening portion 61 and the second opening portion 62. The first opening portion 61 and the second opening portion 62 are formed along a width direction of the optical member 18. In a state where the optical member 18 is supported on the base member 19, the first opening portion 61 is disposed at the position corresponding to the first array light source 16, and the second opening portion 62 is disposed at the position corresponding to the second array light source 17. In this manner, the first array light source 16 is exposed toward the front of the lamp at the first opening portion 61 of the optical member 18, and the second array light source 17 is exposed toward the front of the lamp at the second opening portion 62 of the optical member 18.

Similar to the first embodiment, in the optical member 18, upper and lower wall surfaces forming upper and lower edge portions of the first opening portion 61 are funned as the first reflecting surfaces (an example of the reflector) 65. The first reflecting surfaces 65 reflect light emitted from the first array light source 16 toward the first incident surface 31*a* of the projection lens 12. Further, in the optical member 18, upper and lower wall surfaces forming upper and lower edge portions of the second opening portion 6 are formed as the second reflecting surfaces 66. The second reflecting surfaces 66 reflect light emitted from the second array light source 17 toward the second incident surface 32*a* of the projection lens 12. The first reflecting surfaces 65 and the second reflecting surfaces 66 are mirror-finished by aluminum vapor deposition or the like.

As shown in FIGS. 19 to 26, the optical member 18 of the second embodiment includes a fixed optical member 18A and a movable optical member 18B. The fixed optical member 18A is fixed and supported on the base member 19, and the movable optical member 18B can be displaced back and forth with respect to the base member 19.

The movable optical member 18B functions as the shade portion 68 forming a cut-off line of a low-beam light distribution pattern by shielding a part of light emitted from the low-beam light source 14 and reflected by the reflecting surface 15*a* of the reflector 15. An upper surface of the movable optical member 18B constitutes the reflecting surface 69 for reflecting a part of light emitted from the low-beam light source 14 and reflected by the reflecting surface 15*a* of the reflector 15 upward. The reflecting surface 69 is formed to be inclined slightly forward and downward with respect to the horizontal plane and causes the reflected light to be incident on the first incident surface 31*a* of the projection lens 12. The reflecting surface 69 is minor-finished by aluminum vapor deposition or the like.

Figure 23:
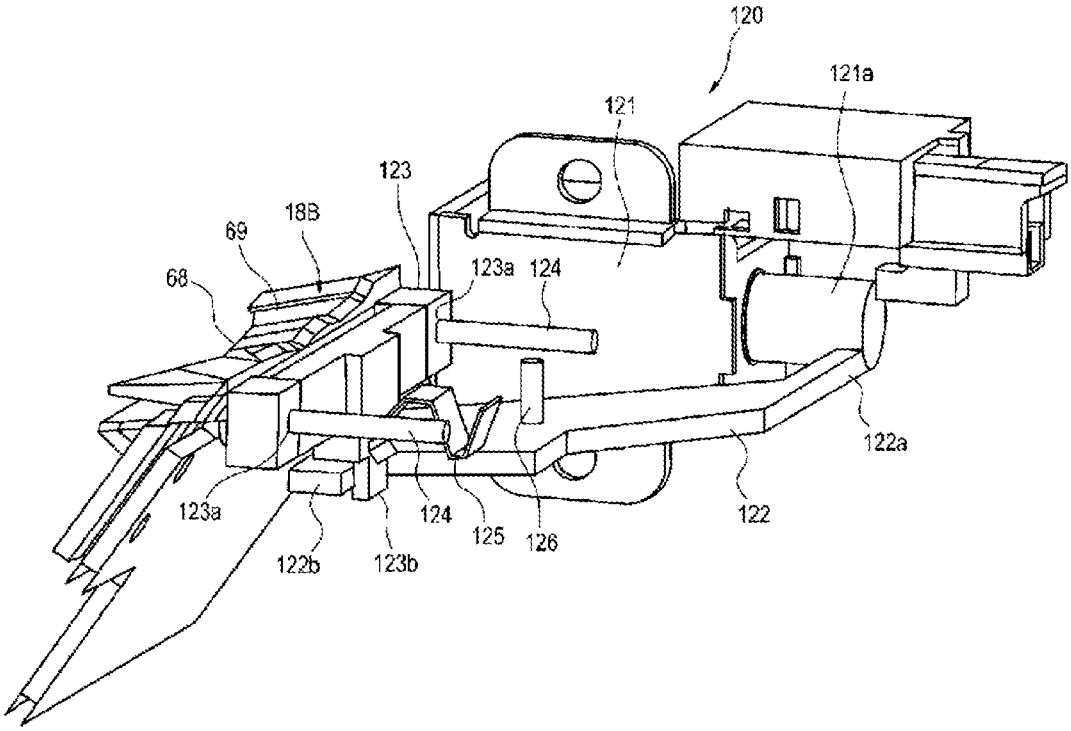
FIG. 23 is a perspective view of a drive mechanism for explaining a structure of the drive mechanism for driving a movable optical member.

As shown in FIG. 23, the movable optical member 18B is supported on a drive mechanism 120. The drive mechanism 120 is attached to the base member 19. The drive mechanism 120 includes a solenoid 121, a pivoting lever 122, a guide member 123, a guide rod 124, and a leaf spring 125.

The solenoid 121 is fixed to the base member 19. The solenoid 121 has an actuating rod 121*a*. The actuating rod 121*a* is retracted by power feeding. The pivoting lever 122 is supported by a spindle 126 erected on the base member 19 and is pivotable about a vertical axis. One end of the pivoting lever 122 is a connecting end 122*a* connected to the actuating rod 121*a* of the solenoid 121. A locking portion 122*b* is provided in the other end of the pivoting lever 122. The guide member 123 is provided integrally with the movable optical member 18B. The guide member 123 has guide holes 123*a* near both ends thereof. The guide rod 124 is inserted through the guide holes 123*a*. The guide rod 124 is provided on the base member 19 and extends in the front and rear direction of the lamp. In this way, the guide member 123 is supported by the guide rod 124 so as to be horizontally movable in the front and rear direction of the lamp. The guide member 123 has a locking piece 123*b* protruding downward at its central portion. The locking portion 122*b* of the pivoting lever 122 is locked to the locking piece 123*b*. The leaf spring 125 is disposed behind the lamp in the guide member 123. The leaf spring 125 urges the guide member 123 toward the front of the lamp by its elastic force.

The position of the movable optical member 18B including the drive mechanism 120 is displaced to a first position on the front side of the lamp and a second position on the rear side of the lamp by the drive mechanism 120.

Figure 24A:
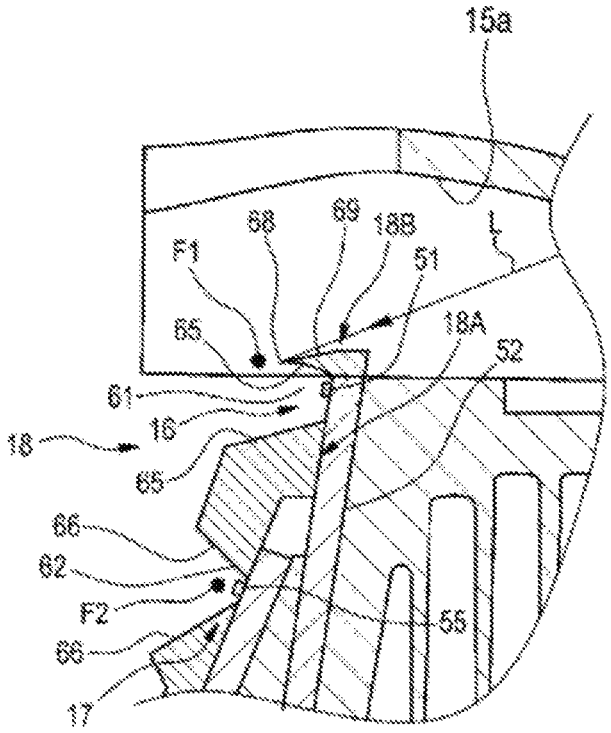
FIG. 24A and FIG. 24B are views for explaining the movement of the movable optical member.

As shown in FIG. 24A, the movable optical member 18B is urged to the front of the lamp by the leaf spring 125 of the drive mechanism 120 and is disposed at the first position. In this first position, the movable optical member 18B functions as the shade portion 68 forming a cut-off line of a low-beam light distribution pattern by shielding a part of the light L emitted from the low-beam light source 14 and reflected by the reflecting surface 15*a* of the reflector 15.

When power is supplied to the solenoid 121 of the drive mechanism 120 from this state, the actuating rod 121*a* of the solenoid 121 is retracted. Thus, the pivoting lever 122 is pivoted, and the guide member 123 locked to the locking portion 122*b* of the pivoting lever 122 is pulled to the rear of the lamp against the elastic force of the leaf spring 125. In this way, as shown in FIG. 24A, the movable optical member 18B disposed at the first position is moved to the rear of the lamp by the drive mechanism 120 and is disposed at the second position. When the movable optical member 18B is moved to the second position by the drive mechanism 120 in this manner, the shielding of the light emitted from the low-beam light source 14 and shielded by the movable optical member 18B is released. In this manner, a light distribution pattern larger than a light distribution pattern formed when the movable optical member 18B is moved to the first position is formed.

Meanwhile, when the power supply to the solenoid 121 of the drive mechanism 120 is released and the retraction of the actuating rod 121*a* of the solenoid 121 is released, the guide member 123 is pushed out to the front of the lamp by the elastic force of the leaf spring 125 and the movable optical member 18B is disposed at the first position. Meanwhile, the pivoting lever 122 is pivoted as the locking portion 122*b* is moved to the front of the lamp. In this way, the actuating rod 121*a* of the solenoid 121 is pulled out.

Figure 25:
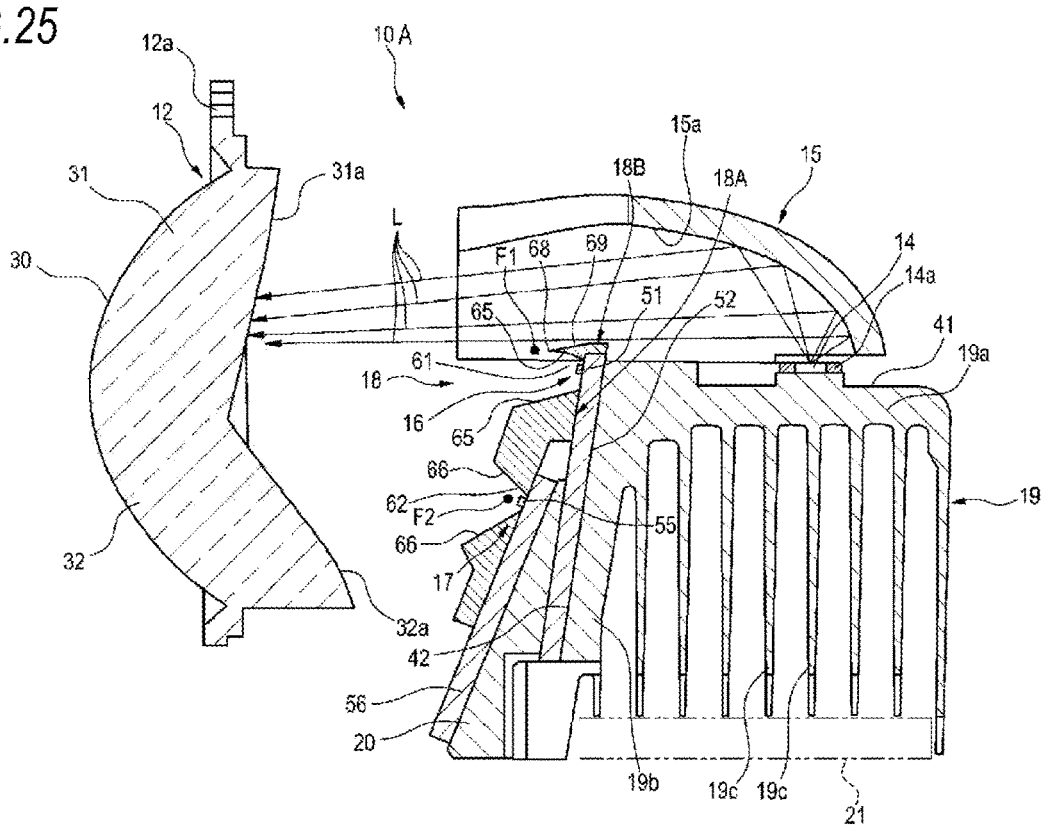
FIG. 25 is a sectional view showing a light path of a low-beam light source in the vehicle lamp according to the second embodiment.

As shown in FIG. 25, in the vehicle lamp 10A having the above structure, the light L emitted from the low-beam light source 14 is reflected by the reflecting surface 15*a* of the reflector 15 and incident on the first incident surface 31*a* of the projection lens 12. Further, a part of the light L reflected by the reflecting surface 15*a* of the reflector 15 is reflected by the reflecting surface 69 of the movable optical member 18B disposed at the first position and incident on the first incident surface 31*a* of the projection lens 12. Meanwhile, a part of the light L reflected by the reflecting surface 15*a* of the reflector 15 passes near the first rear focal point F1.

Figure 26:
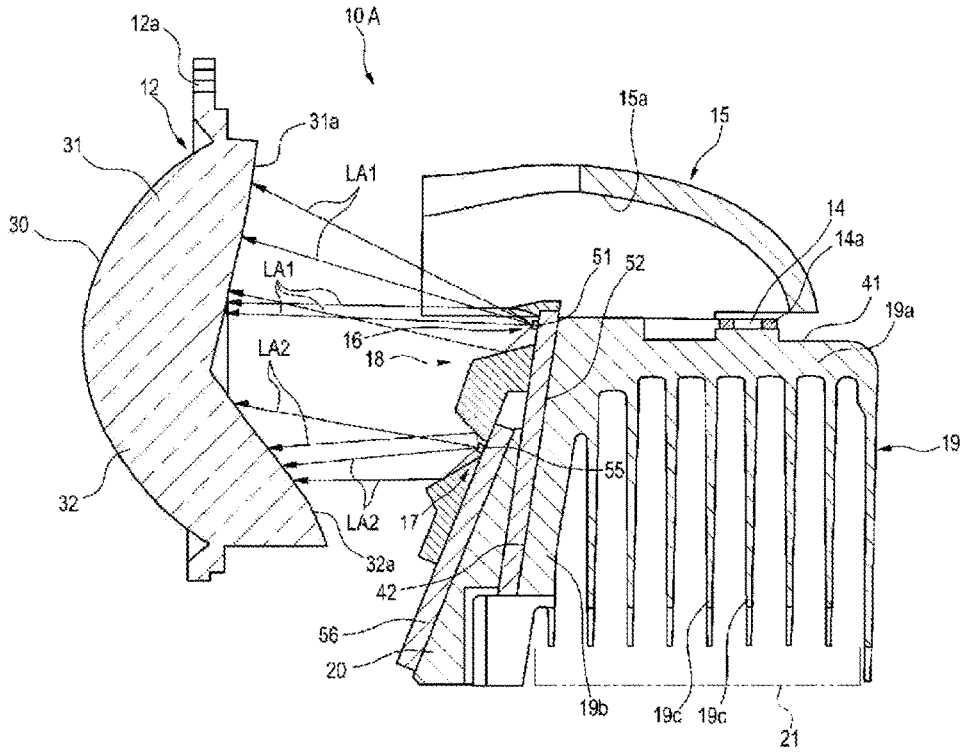
FIG. 26 is a sectional view showing light paths of the first array light source and the second array light source in the vehicle lamp according to the second embodiment.

As shown in FIG. 26, the light LA1 emitted from the first array light source 16 is directly incident on the first incident surface 31*a* of the projection lens 12, or is reflected by the first reflecting surface 65 of the optical member 18 and incident on the first incident surface 31*a* of the projection lens 12. The light LA2 emitted from the second array light source 17 is directly incident on the second incident surface 32*a* of the projection lens 12, or is reflected by the second reflecting surface 66 of the optical member 18 and incident on the second incident surface 32*a* of the projection lens 12.

The irradiation mode of the vehicle lamp 10A having the above structure can be switched between a normal irradiation mode and an extended irradiation mode. Subsequently, the light distribution pattern in each irradiation mode will be described.

(Normal Irradiation Mode)

Figure 27A:
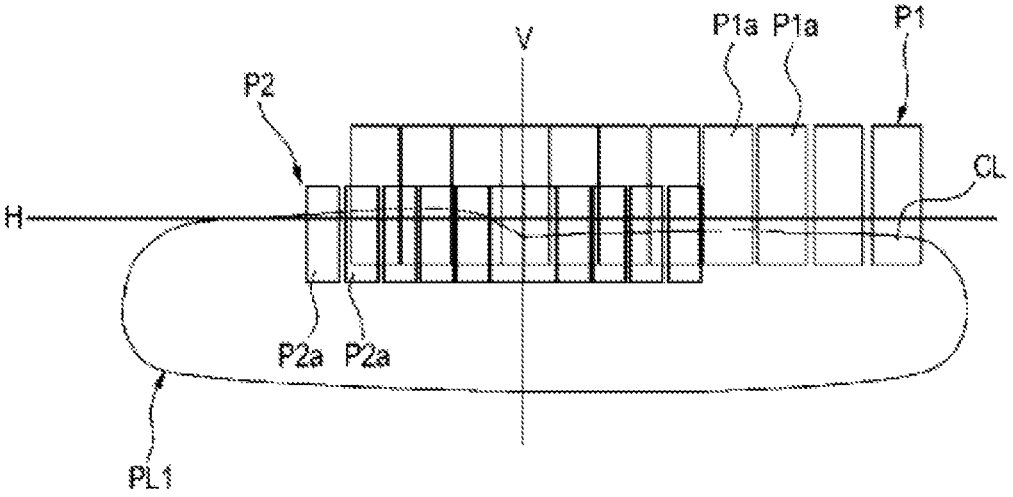
FIG. 27A and FIG. 27B are schematic perspective views showing a light distribution pattern formed on a virtual vertical screen arranged in front of the lamp by the light irradiated from the vehicle lamp according to the second embodiment.

FIG. 27A shows a light distribution pattern projected on a virtual screen provided in a vertical direction at a position of 25 m in front of the lamp in the normal irradiation mode.

In the vehicle lamp 10A set to the normal irradiation mode, the movable optical member 18B is disposed at the first position by the drive mechanism 120 (see FIG. 24A). Then, the light L emitted from the low-beam light source 14 is partially shielded by the movable optical member 18B disposed at the first position, and is incident on the first incident surface 31*a* of the projection lens 12 and emitted from the exit surface 30. In this way, a first light distribution pattern PL1 which is a low-beam light distribution pattern having a cut-off line CL is formed on the virtual screen in front of the lamp.

The light LA1 emitted from the first array light source 16 and incident on the first incident surface 31*a* of the projection lens 12 is emitted from the exit surface 30 to form the additional light distribution pattern P1. The additional light distribution pattern P1 is a light distribution pattern in which the light distribution patterns P1*a* of the semiconductor light emitting elements 51 of the first array light source 16 are laterally arranged in a row. Here, since the arrangement pitch of the semiconductor light emitting elements 51 of the first array light source 16 in the left and right direction of the lamp becomes denser as approaching the first rear focal point F1 of the projection lens 12, the illuminance at the central portion of the additional light distribution pattern P1 is increased and light is irradiated far.

The light LA2 emitted from the second array light source 17 and incident on the second incident surface 32*a* of the projection lens 12 is emitted from the exit surface 30 to form the additional light distribution pattern P2. The additional light distribution pattern P2 is a light distribution pattern in which the light distribution patterns P2*a* of the semiconductor light emitting elements 55 of the second array light source 17 are laterally arranged in a row.

The additional light distribution pattern P1 formed by the light LA1 emitted from the first array light source 16 is a high-beam light distribution pattern. On the virtual vertical screen in front of the lamp, the additional light distribution pattern P2 formed by the light LA2 emitted from the second array light source 17 overlaps with both the first light distribution pattern PL1 that is a low-beam light distribution pattern formed by the light L emitted from the low-beam light source 14 and the additional high-beam light distribution pattern P1 formed by the light LA1 emitted from the first array light source 16.

Here, the first light distribution pattern PL1 that is a low-beam light distribution pattern in which a cut-off line is formed by the movable optical member 18B constituting the optical member 18 and the additional high-beam light distribution pattern P1 are difficult to overlap with each other and may not overlap with each other. Thus, the amount of light may be reduced.

On the contrary, in the vehicle lamp 10A according to the second embodiment, in a state where the first light distribution pattern PL1 is formed and the additional light distribution pattern P1 as a high-beam light distribution pattern is formed, the additional light distribution pattern P2 is formed in a space between the first light distribution pattern PL1 and the additional light distribution pattern P1 where the amount of light is reduced. In this way, the additional light distribution pattern P2 compensates for the space between the first light distribution pattern PL1 and the additional light distribution pattern P1 where the amount of light is reduced.

(Extended Irradiation Mode)

Figure 27B:
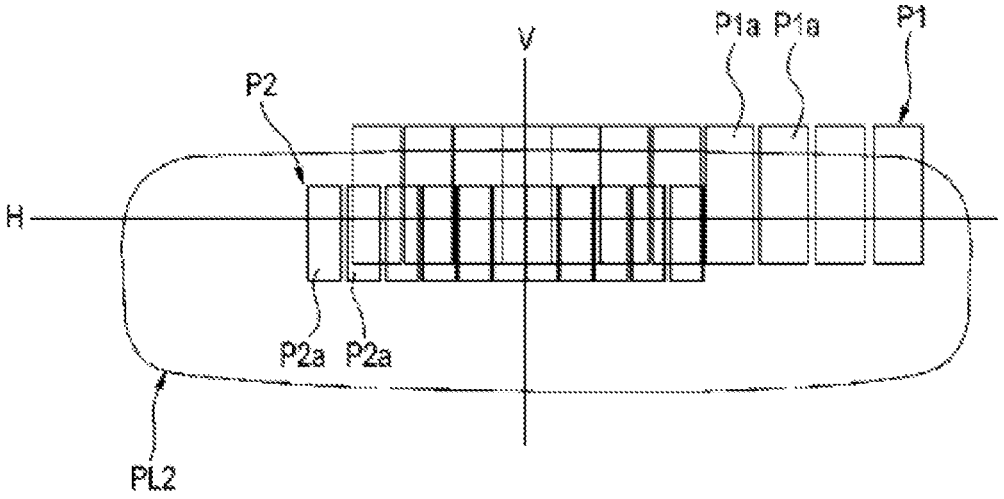

FIG. 27B shows a light distribution pattern projected on a virtual screen provided in a vertical direction at a position of 25 m in front of the lamp in the extended irradiation mode.

Figure 24B:
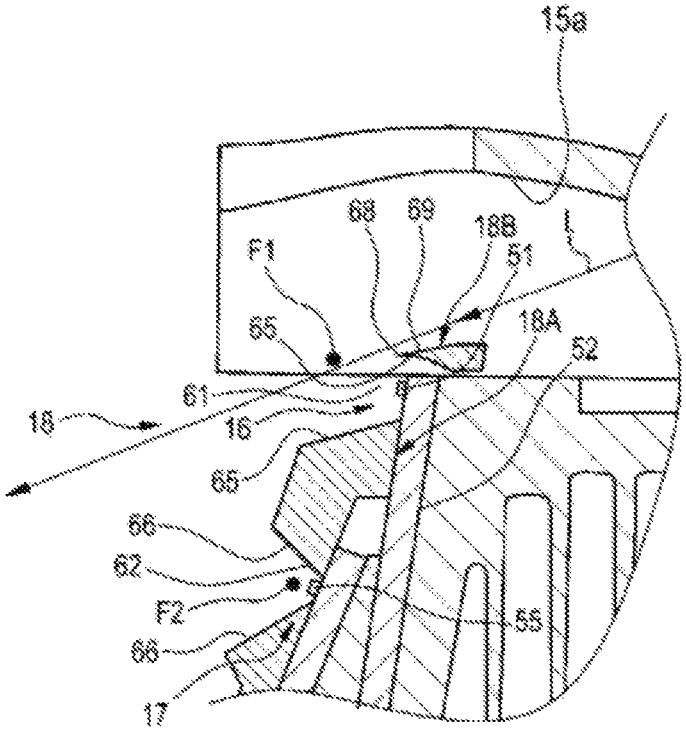

In the vehicle lamp 10A set to the extended irradiation mode, the movable optical member 18B is disposed at the second position by the drive mechanism 120 (see FIG. 24B). Then, as the movable optical member 18B forming the cut-off line CL in the first position moves backward, the shielding of the light L emitted from the low-beam light source 14 by the movable optical member 18B disposed at the first position is released. In this way, on the virtual screen in front of the lamp, a second light distribution pattern PL2 which is a light distribution pattern larger than the first light distribution pattern PL1 is formed by being enlarged above the first light distribution pattern PL1.

Further, on the virtual screen in front of the lamp, the additional light distribution pattern P1 is formed by the light LA1 emitted from the first array light source 16, incident on the first incident surface 31*a* of the projection lens 12 and emitted from the exit surface 30, and the additional light distribution pattern P2 is formed by the light LA2 emitted from the second array light source 17, incident on the second incident surface 32*a* of the projection lens 12 and emitted from the exit surface 30.

Further, in the extended irradiation mode, the second light distribution pattern PL2 formed by the light L emitted from the low-beam light source 14 and the additional light distribution pattern P1 formed by the light LA1 emitted from the first array light source 16 overlap with each other on the virtual screen in front of the lamp. Meanwhile, the additional light distribution pattern P2 formed by the light LA2 emitted from the second array light source 17 overlaps with the second light distribution pattern PL2 and the additional light distribution pattern P1 at the central portion thereof.

Meanwhile, in each of the irradiation modes described above, among the light distribution patterns projected on the virtual vertical screen in front of the lamp, the additional light distribution pattern P1 formed by the light LA1 emitted from the semiconductor light emitting elements 51 of the first array light source 16 and the additional light distribution pattern P2 formed by the light LA2 emitted from the semiconductor light emitting elements 55 of the second array light source 17 are offset in the left and right direction. Specifically, the additional light distribution pattern P1 formed by the first array light source 16 is shifted to the right, and the additional light distribution pattern P2 formed by the second array light source 17 is shifted to the left. Meanwhile, here, the offset means a configuration in which the light distribution pattern P1*a* and the light distribution pattern P2*a* are arranged so as to partially overlap with each other in the left and right direction or a configuration in which the light distribution pattern P1*a* and the light distribution pattern P2*a* are alternately arranged in the left and right direction without overlapping.

Figure 28:
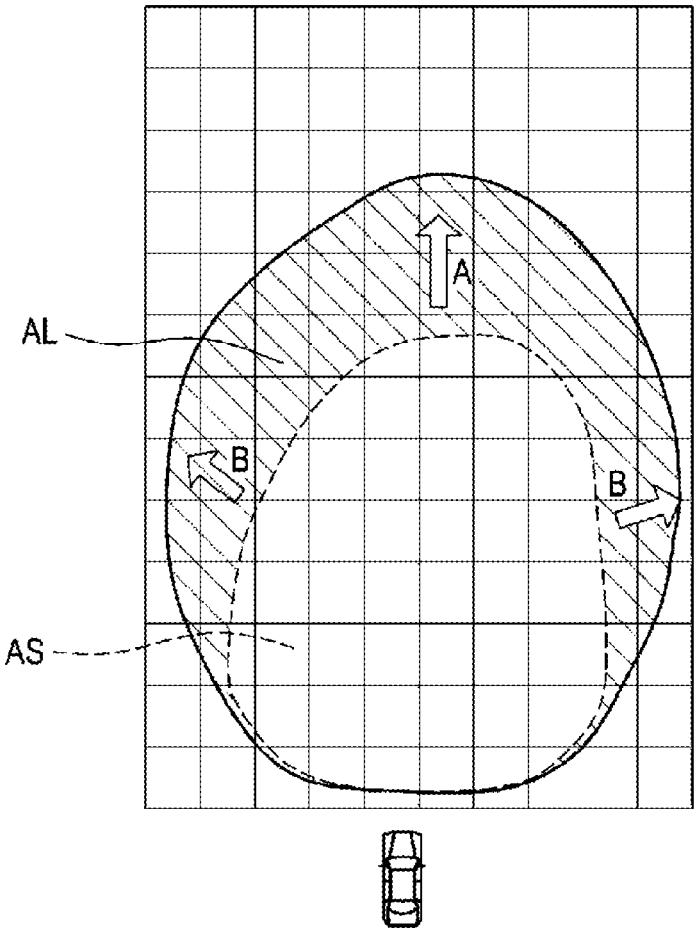
FIG. 28 is a schematic top view showing an irradiation range in front of a vehicle of the light irradiated from the vehicle lamp according to the second embodiment.

In this way, as shown in FIG. 28, while a road surface irradiation area AS is formed by a general vehicle lamp, in the second embodiment, the amount of light is supplemented by the additional light distribution pattern P2, and the additional light distribution pattern P1 and the additional light distribution pattern P2 are offset in the left and right direction, so that the road surface irradiation area AL enlarged to the front (direction of arrow A shown in FIG. 28) and in the left and right direction (direction of arrow B shown in FIG. 28) is formed.

Further, since the semiconductor light emitting elements 51 of the first array light source 16 and the semiconductor light emitting elements 55 of the second array light source 17 can be individually turned on, it is possible to form light distribution patterns suitable for various situations. For example, in the case where the additional light distribution pattern P1 is formed by turning off some of the semiconductor light emitting elements 51 of the first array light source 16 for irradiating the position of an oncoming vehicle so that light does not hit an oncoming vehicle detected by an in-vehicle camera, it is possible to widely irradiate the running road in front of the vehicle within a range not giving a glare to a driver of the oncoming vehicle. Similarly, in the case where the additional light distribution pattern P2 is formed by turning off some of the semiconductor light emitting elements 55 of the second array light source 17 for irradiating the position of an oncoming vehicle, it is possible to widely irradiate the running road in front of the vehicle within a range not giving a glare to a driver of the oncoming vehicle.

As described above, according to the vehicle lamp 10A of the second embodiment, by moving the movable optical member 18B from the first position to the second position by the drive mechanism 120, the light emitted from the low-beam light source 14 can be used not only as light forming the first light distribution pattern PL1 that is a low-beam light distribution pattern including the cut-off line CL, but also as light forming the second light distribution pattern PL2 different from the first light distribution pattern PL1. Since the second light distribution pattern PL2 different from the predetermined first light distribution pattern PL1 including the cut-off line CL can be formed by using the low-beam light source 14 of the projector type optical system in this manner, the applications such as overlapping the additional light distribution pattern P1 of the first array light source 16 and the additional light distribution pattern P2 of the second array light source 17 are increased, and hence, the degree of freedom in designing the light distribution pattern is improved.

Further, since the second light distribution pattern PL2 is enlarged above the first light distribution pattern PL1 on the virtual vertical screen in front of the lamp, the light L emitted from the low-beam light source 14 is extended far in front of the lamp and can contribute to improvement in far visibility.

In particular, since the second light distribution pattern PL2 and the additional light distribution pattern P1 are overlapped with each other on the virtual vertical screen in front of the lamp, the portion where the second light distribution pattern PL2 and the additional light distribution pattern P1 overlap with each other can be made brighter.

Further, when the movable optical member 18B is moved to the first position by the drive mechanism 120, the first reflecting surface 65 of the movable optical member 18B on the side of the first array light source 16 functions as a reflector for reflecting at least a part of the light LA1 emitted from the first array light source 16 toward the projection lens 12. Thus, the movable optical member 18B can be used as a reflector for the first array light source 16, which can contribute to improvement in utilization efficiency of light of the first array light source 16.

Moreover, since the movable optical member 18B is a part separate from the base member 19 on which the low-beam light source 14, the first array light source 16 and the second array light source 17 are disposed, and the movable optical member 18B is moved to the first position and the second position along the front and rear direction of the lamp by the drive mechanism 120, it is possible to constitute a mechanism for moving the movable optical member 18B with a simple structure.

Further, the projection lens 12 has the first lens portion 31 forming the first rear focal point F1 and the second lens portion 32 forming the second rear focal point F2. The first array light source 16 is disposed at the position corresponding to the first rear focal point F1, and the second array light source 17 is disposed below the first array light source 16 and at the position corresponding to the second rear focal point F2. Therefore, a large number of semiconductor light emitting elements 51, 55 can be mounted on the lamp without increasing the width of the lamp in the left and right direction. Further, compared to a lamp having a single array light source, many semiconductor light emitting elements 51, 55 can be mounted on the lamp. Therefore, it is possible to improve the degree of freedom in designing a light distribution pattern which is added to the first light distribution pattern PL1 and the second light distribution pattern PL2 formed by the light L emitted from the low-beam light source 14 of the projector type optical system.

Meanwhile, in the second embodiment, the vehicle lamp 10A includes, as the array light source, the first array light source 16 for forming the additional light distribution pattern P1 and the second array light source 17 for forming the additional light distribution pattern P2. However, only the first array light source 16 for forming the additional light distribution pattern P1 may be provided.

Further, in the present example, the low-beam light source 14 is described as an example of the light source of the projector type optical system. However, the disclosure is not limited to this example. This light source may be a light source of a projector type optical system having a reflector, and the light distribution pattern may be formed according to applications. For example, the light source may be a light source for forming a light distribution pattern suitable for road surface irradiation or may be a light source for forming a light distribution pattern to be irradiated toward a specific object.

Subsequently, modifications of the vehicle lamp 10A according to the second embodiment will be described.

Modification 1 of First Embodiment

Figure 29:
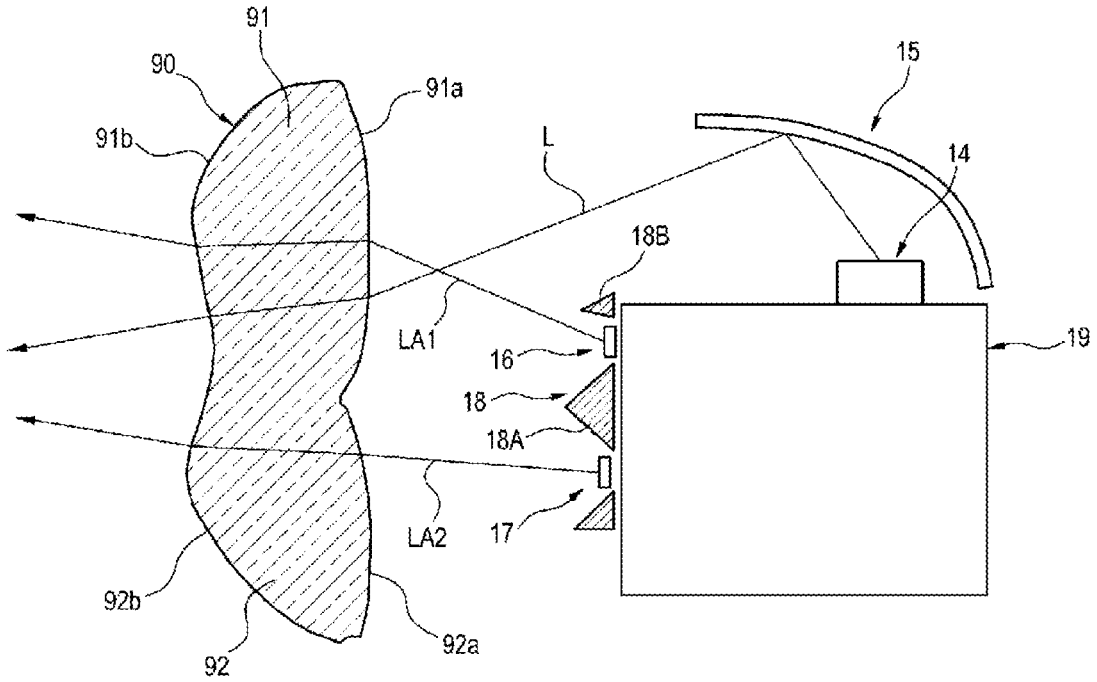
FIG. 29 is a schematic sectional view of a vehicle lamp for explaining a modification 1 of the second embodiment.

As shown in FIG. 29, a lamp of a modification 1 includes the projection lens 90 in which a convex shape of an exit surface is split up and down. Specifically, the projection lens 90 has the first lens portion 91 on the upper side and the second lens portion 92 on the lower side. The first lens portion 91 and the second lens portion 92 are integrated. The first lens portion 91 has the first incident surface 91*a* and the first exit surface 91*b*, and the second lens portion 92 has the second incident surface 92*a* and the second exit surface 92*b*.

In the vehicle lamp of the modification 1, the light L emitted from the low-beam light source 14 and the light LA1 emitted from the first array light source 16 are incident on the first incident surface 91*a* of the first lens portion 91 and emitted from the first exit surface 91*b*. Further, the light LA2 emitted from the second array light source 17 is incident on the second incident surface 92*a* of the second lens portion 92 and emitted from the second exit surface 92*b*.

According to this structure, the light distribution pattern can be extended to the front and spread to the left and right while suppressing cost. Further, by moving the movable optical member 18B from the first position to the second position, the light emitted from the low-beam light source 14 can be used not only as light forming the first light distribution pattern PL1 that is a low-beam light distribution pattern including the cut-off line CL, but also as light forming the second light distribution pattern PL2 different from the first light distribution pattern PL1.

Modification 2 of Second Embodiment

Figure 30:
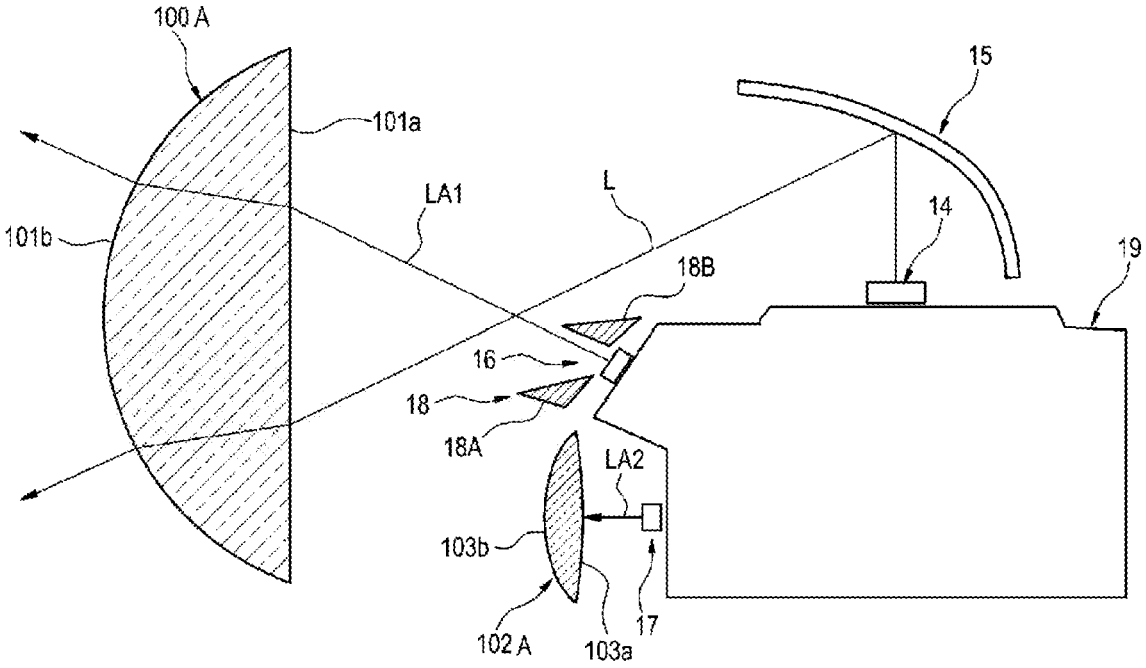
FIG. 30 is a schematic sectional view of a vehicle lamp for explaining a modification 2 of the second embodiment.

As shown in FIG. 30, a lamp of a modification 2 of the second embodiment includes a projection lens 100A and a sub lens 102A. Each of the projection lens 100A and the sub lens 102A is a single focus lens. The projection lens 100A has the incident surface 101*a* and the exit surface 101*b*. Further, the sub lens 102A has the incident surface 103*a* and the exit surface 103*b*. The sub lens 102A is disposed between the second array light source 17 and the projection lens 100A.

In the lamp of the modification 2, the light L emitted from the low-beam light source 14 and the light LA1 emitted from the first array light source 16 are incident on the incident surface 101*a* of the projection lens 100A and emitted from the exit surface 101*b*. Further, the light LA2 emitted from the second array light source 17 is incident on the incident surface 103*a* of the sub lens 102A and emitted from the exit surface 103*b*. And then, the light LA2 is incident on the incident surface 101*a* of the projection lens 100A and emitted from the exit surface 101*b*.

According to this structure, the projection lens 100A seen from the front of the lamp has a single focal point. Therefore, the light LA2 emitted from the second array light source 17 can be guided in a predetermined direction by the sub lens 102A, and the light distribution pattern can be extended to the front and spread to the left and right while improving the appearance from the front of the lamp.

Further, by moving the movable optical member 18B from the first position to the second position, the light emitted from the low-beam light source 14 can be used not only as light forming the first light distribution pattern PL1 that is a low-beam light distribution pattern including the cut-off CL, but also as light forming the second light distribution pattern PL2 different from the first light distribution pattern PL1.

Modification 3 of Second Embodiment

Figure 31:
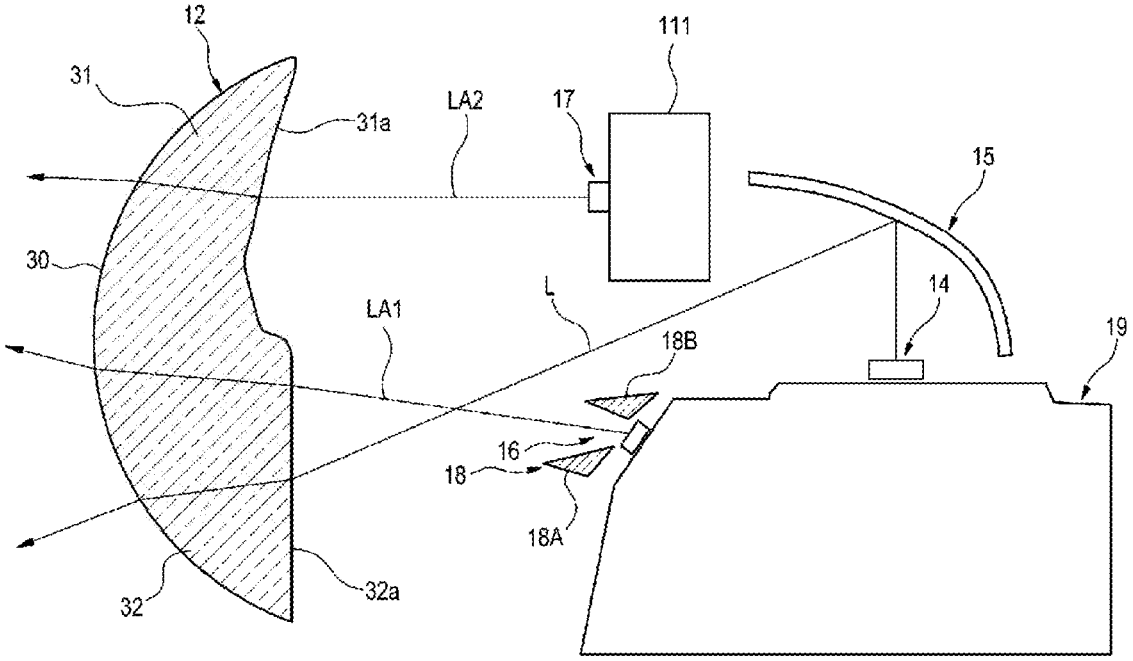
FIG. 31 is a schematic sectional view of a vehicle lamp for explaining a modification 3 of the second embodiment.

As shown in FIG. 31, in a lamp of a modification 3 of the second embodiment, the second array light source 17 is supported not on the base member 19 but on the bracket 111 disposed at a position different from the base member 19, and the second array light source 17 is disposed above the first array light source 16.

In the modification 3, the light L emitted from the low-beam light source 14 and the light LA1 emitted from the first array light source 16 are incident on the second incident surface 32*a* of the projection lens 12 and emitted from the exit surface 30. Further, the light LA2 emitted from the second array light source 17 is incident on the first incident surface 31*a* of the projection lens 12 and emitted from the exit surface 30.

According to this structure, the light distribution can be extended and spread while maintaining good appearance from the front of the lamp. Further, in the modification 3 of the second embodiment, by moving the movable optical member 18B from the first position to the second position, the light emitted from the low-beam light source 14 can be used not only as light forming the first light distribution pattern PL1 that is a low-beam light distribution pattern including the cut-off line CL, but also as light forming the second light distribution pattern PL2 different from the first light distribution pattern PL1.

Third Embodiment

Hereinafter, an example of a third embodiment of the disclosure will be described in detail with reference to the drawings.

Figure 32:
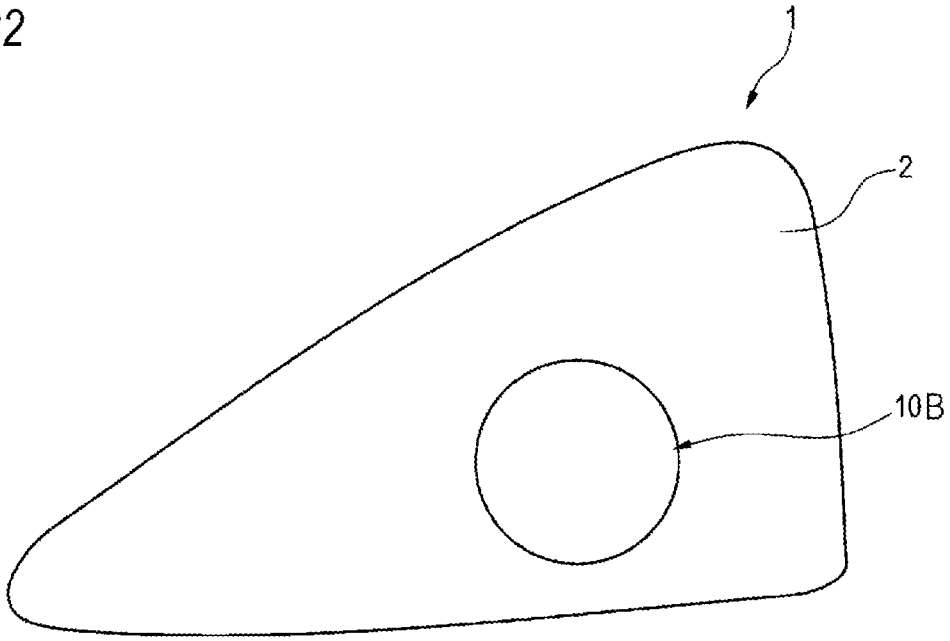
FIG. 32 is a schematic view of a headlamp including a vehicle lamp according to a third embodiment of the disclosure, as viewed from the front.

As shown in FIG. 32, a vehicle lamp 10B according to the third embodiment of the disclosure constitutes the headlamp 1 of a vehicle. The headlamp 1 is provided on the left and right of the front portion of the vehicle. Meanwhile, in FIG. 32, only the headlamp 1 on the left side of the vehicle is shown. In the present example, each headlamp 1 is configured as a monocular headlamp having one vehicle lamp 10B. The vehicle lamp 10B is provided in a lamp body (not shown). The translucent cover 2 is mounted in front of the lamp body. The translucent cover 2 is mounted to the lamp body to form a lamp chamber, and the vehicle lamp 10B is disposed in the lamp chamber.

Figure 33A:
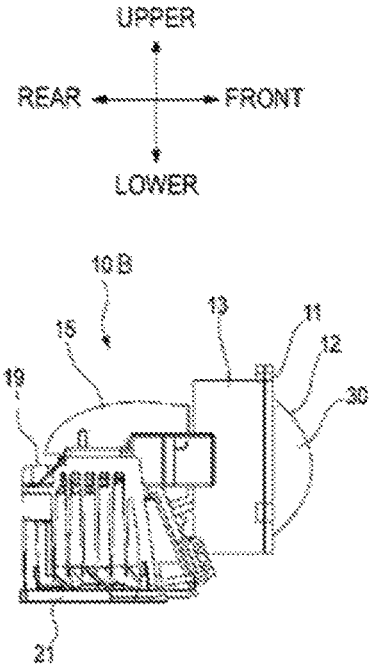
FIGS. 33A to 33C are views showing the vehicle lamp according to the third embodiment of the disclosure.
Figure 33B:
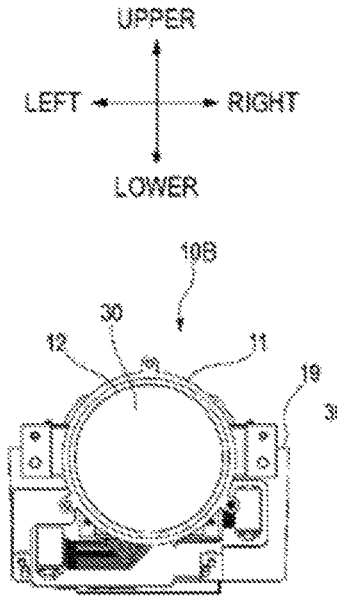
Figure 33C:
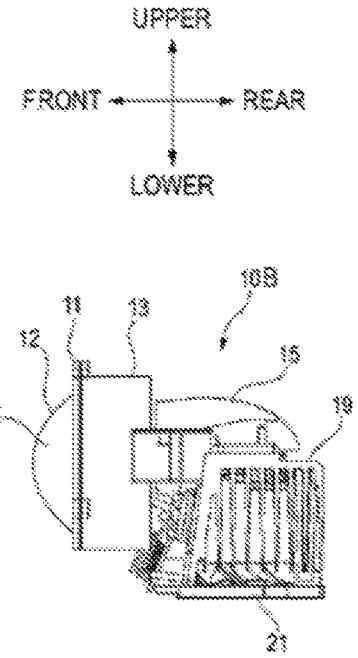
Figure 34:
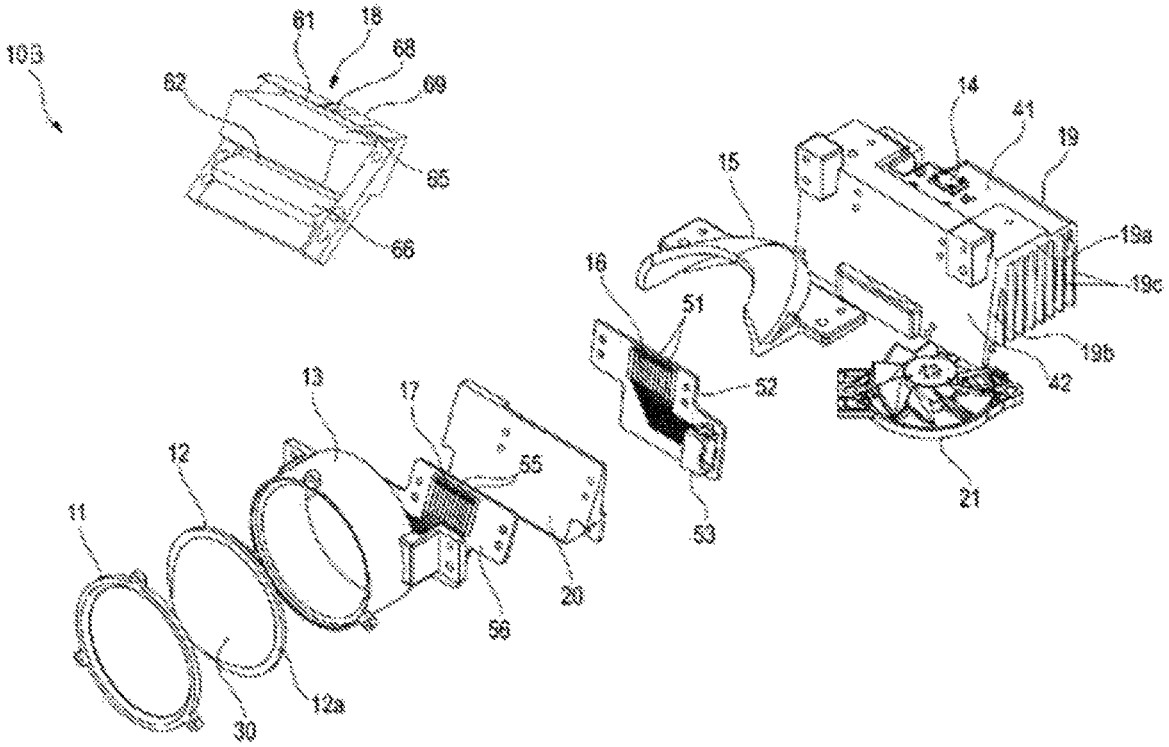
FIG. 34 is an exploded perspective view of the vehicle lamp according to the third embodiment of the disclosure.
Figure 35:
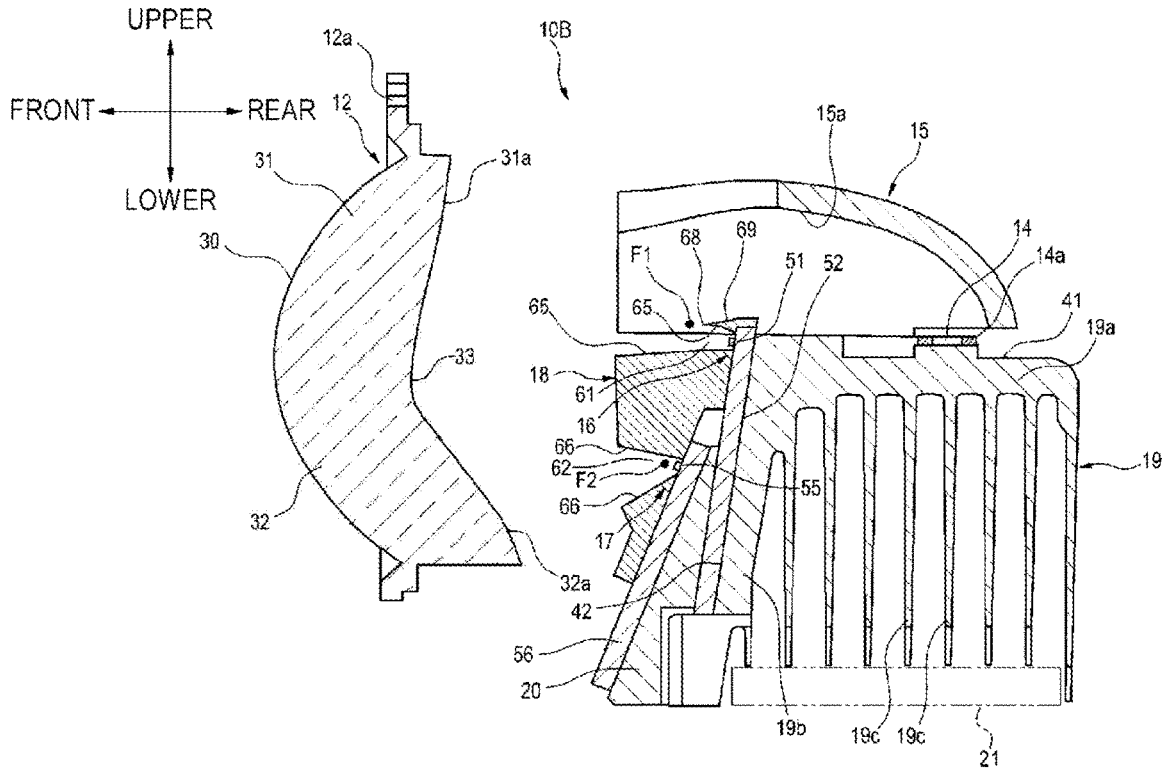
FIG. 35 is a sectional view of the vehicle lamp according to the third embodiment of the disclosure.

As shown in FIGS. 33 to 35, the vehicle lamp 10B includes the fixing ring 11, the projection lens 12, the lens holder 13, the low-beam light source 14, the reflector 15, the first array light source 16, the second array light source 17, the optical member 18, the base member 19, the fixing member 20, and the fan 21. The first array light source 16 is an example of a first light source in the third embodiment, and the second array light source 17 is an example of a second light source in the third embodiment. Meanwhile, the configurations of the fixing ring 11, the lens holder 13, the low-beam light source 14, the reflector 15, the first array light source 16, the second array light source 17, the base member 19, the fixing member 20, and the fan 21 of the third embodiment are the same as those of the first embodiment. Accordingly, these parts are denoted by the same reference numerals and description thereof will be omitted.

Similar to the projection lens 12 of the first embodiment, the projection lens 12 of the third embodiment has the convex exit surface 30 based on one circular arc at its front surface. The projection lens 12 has a circular shape when viewed from the front of the lamp. The projection lens 12 has the first lens portion 31 forming the first rear focal point F1 and the second lens portion 32 forming the second rear focal point F2. The projection lens 12 has the first incident surface 31*a* on the side of the first lens portion 31 opposite to the exit surface 30 and has the second incident surface 32*a* on the side of the second lens portion 32 opposite to the exit surface 30.

Similar to the projection lens 12 of the first embodiment, the projection lens 12 of the third embodiment forms the first rear focal point F1 on an optical axis of the first incident surface 31*a* of the first lens portion 31 and forms the second rear focal point F2 on an optical axis of the second incident surface 32*a* of the second lens portion 32. The projection lens 12 projects a light source image formed on each of focal planes including the first rear focal point F1 and the second rear focal point F2 as an inverted image onto a virtual vertical screen in front of the lamp. The first rear focal point F1 and the second rear focal point F2 are arranged up and down such that the first rear focal point F1 is located above the second rear focal point F2. In this manner, the projection lens 12 is a multifocal lens having two rear focal points F1, F2.

Figure 36:
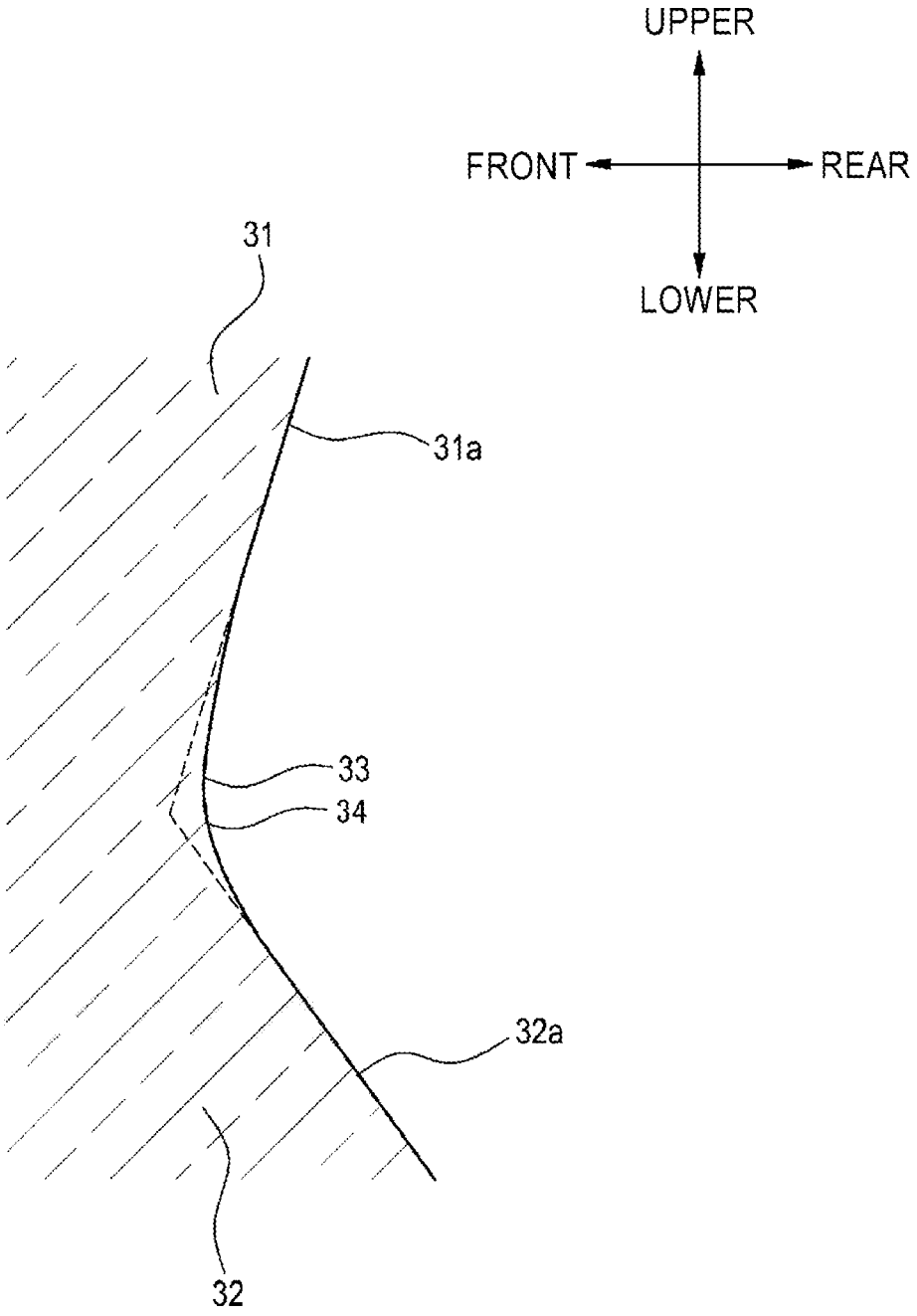
FIG. 36 is a sectional view of a boundary portion between a first lens portion and a second lens portion of a projection lens.

As shown in FIG. 36, the projection lens 12 of the third embodiment has a boundary surface 33 provided between the first incident surface 31*a* of the first lens portion 31 and the second incident surface 32*a* of the second lens portion 32. The boundary surface 33 is formed as a curved surface 34 recessed toward the exit surface 30 and is provided along the width direction of the projection lens 12. The first incident surface 31*a* and the boundary surface 33 are formed to be smoothly continuous. Similarly, the second incident surface 32*a* and the boundary surface 33 are formed to be smoothly continuous.

Since the boundary surface 33 is provided between the first incident surface 31*a* of the first lens portion 31 and the second incident surface 32*a* of the second lens portion 32 in this manner, the first incident surface 31*a* and the second incident surface 32*a* of the projection lens 12 are connected to be smoothly continuous. Therefore, an angular dent (see the dotted line in FIG. 36) formed when there is no boundary surface 33 is eliminated.

Similar to the projection lens 12 of the first embodiment, the projection lens 12 of the third embodiment is disposed on the front portion of the lens holder 13 formed in a cylindrical shape. The fixing ring 11 is fixed to the lens holder 13 from the front side. The outer peripheral flange portion 12*a* of the projection lens 12 is sandwiched between the lens holder 13 and the fixing ring 11, so that the projection lens 12 is supported on the front portion of the lens holder 13. The lens holder 13 for supporting the projection lens 12 is fixed to the base member 19. In this way, the projection lens 12 is supported on the base member 19 via the lens holder 13.

Figure 37:
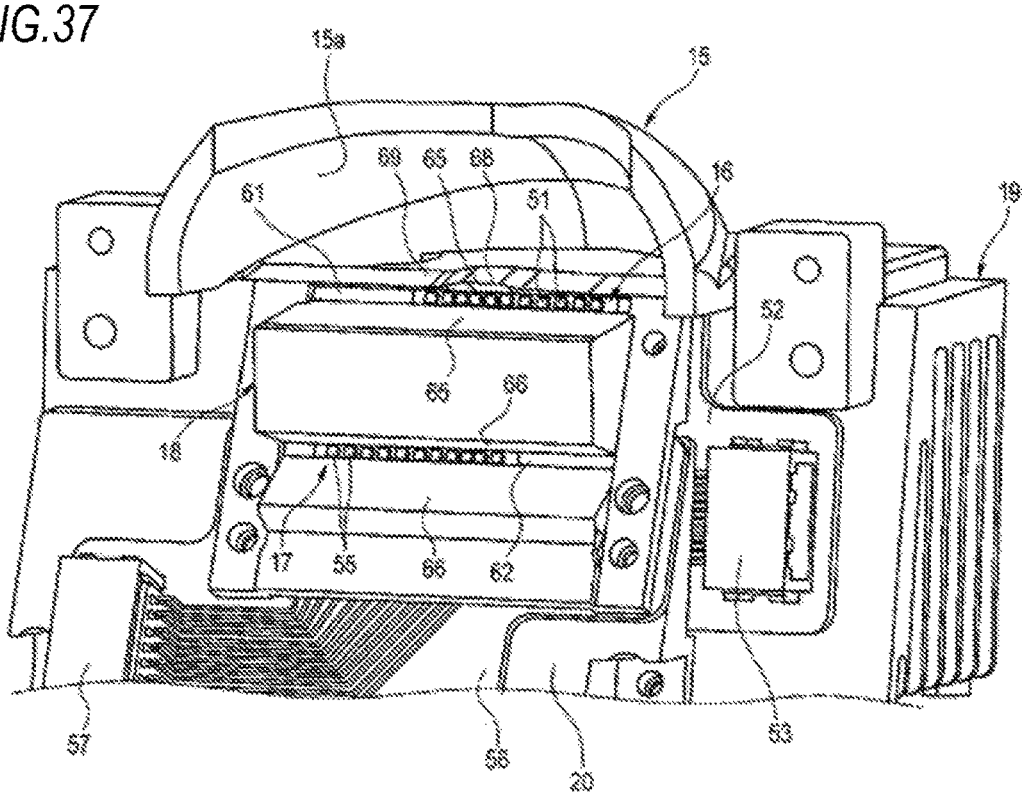
FIG. 37 is a perspective view of a base member on which a light source of the vehicle lamp according to the third embodiment is mounted.
Figure 38A:
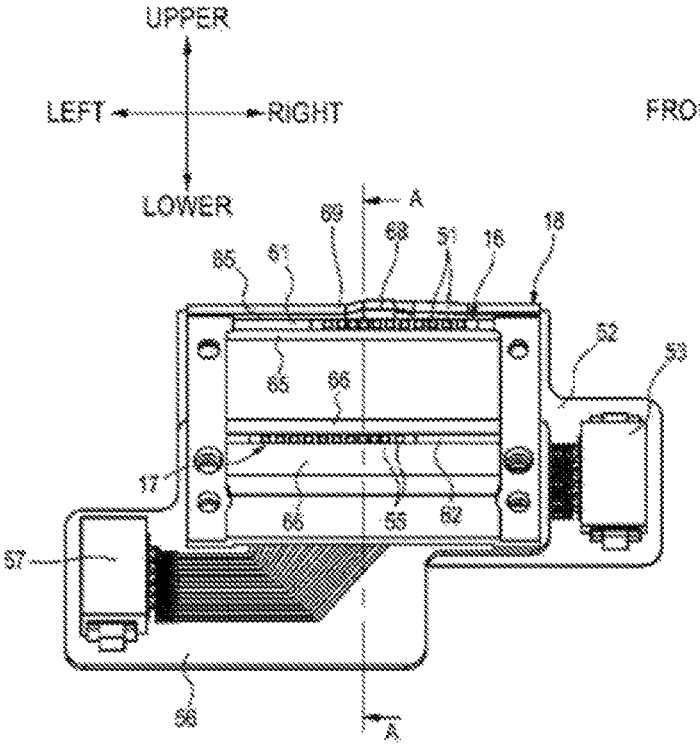
FIG. 38A and FIG. 38B are views for explaining a structure composed of a first array light source, a second array light source and an optical member of the vehicle lamp according to the third embodiment.
Figure 38B:
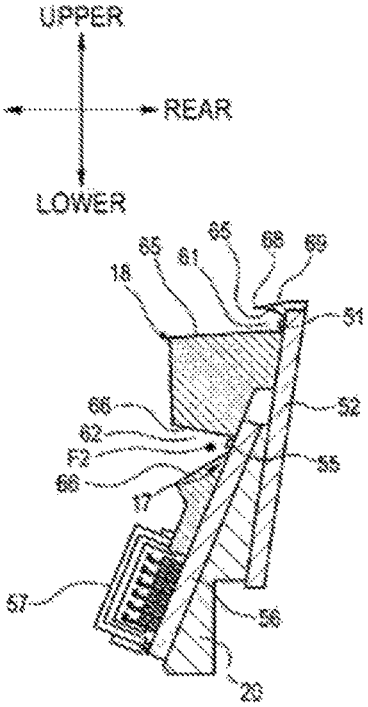

As shown in FIGS. 37 and 38, the first array light source 16 includes the plurality of (eleven in this example) semiconductor light emitting elements 51, and the substrate 52. Since respective parts shown in FIGS. 37 and 38 are the same as those of the first embodiment shown in FIGS. 5 and 6, these parts are denoted by the same reference numerals and description thereof will be omitted.

Figure 39:
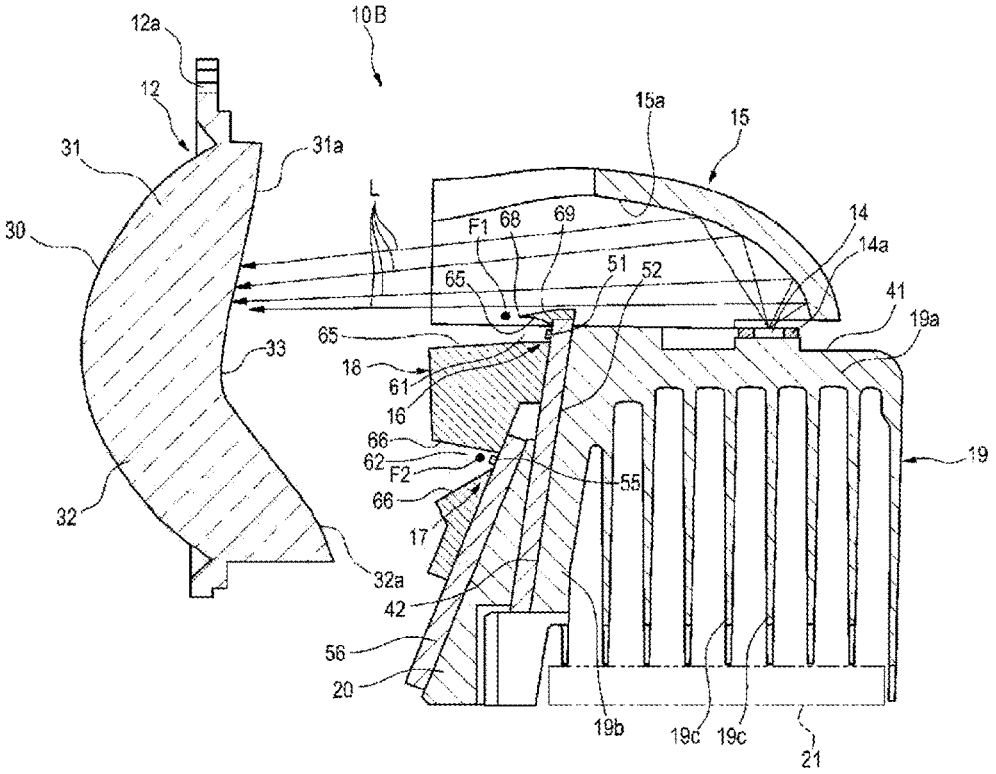
FIG. 39 is a sectional view showing a light path of a low-beam light source in the vehicle lamp according to the third embodiment.

As shown in FIG. 39, similar to the light L (FIG. 7) emitted from the low-beam light source 14 in the first embodiment, the light L emitted from the low-beam light source 14 in the third embodiment is reflected by the reflecting surface 15*a* of the reflector 15 and incident on the first incident surface 31*a* of the projection lens 12. Further, a part of the light L reflected by the reflecting surface 15*a* of the reflector 15 is reflected by the reflecting surface 69 of the optical member 18 and incident on the first incident surface 31*a* of the projection lens 12. Meanwhile, a part of the light L reflected by the reflecting surface 15*a* of the reflector 15 passes near the first rear focal point F1.

Figure 40:
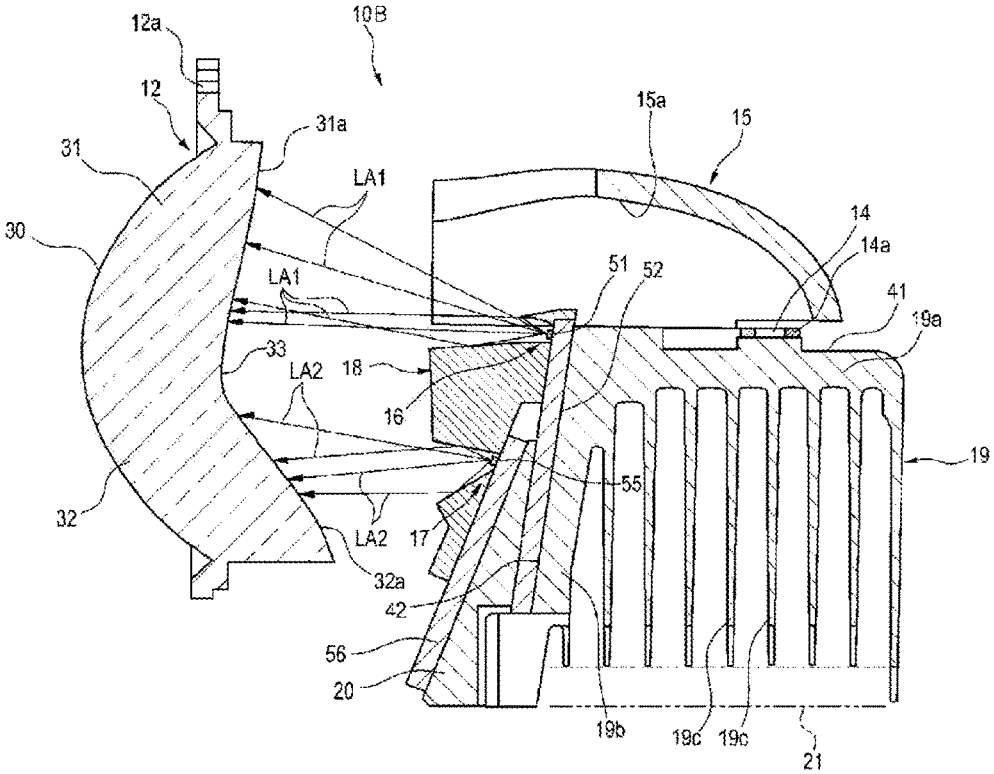
FIG. 40 is a sectional view showing light paths of the first array light source and the second array light source in the vehicle lamp according to the third embodiment.

Further, as shown in FIG. 40, similar to the light LA1 (FIG. 8) emitted from the first array light source 16 in the first embodiment, the light LA1 emitted from the first array light source 16 in the third embodiment is directly incident on the first incident surface 31*a* of the projection lens 12, or is reflected by the first reflecting surface 65 of the optical member 18 and incident on the first incident surface 31*a* of the projection lens 12. The light LA2 emitted from the second array light source 17 is directly incident on the second incident surface 32*a* of the projection lens 12, or is reflected by the second reflecting surface 66 of the optical member 18 and incident on the second incident surface 32*a* of the projection lens 12.

Figure 41:
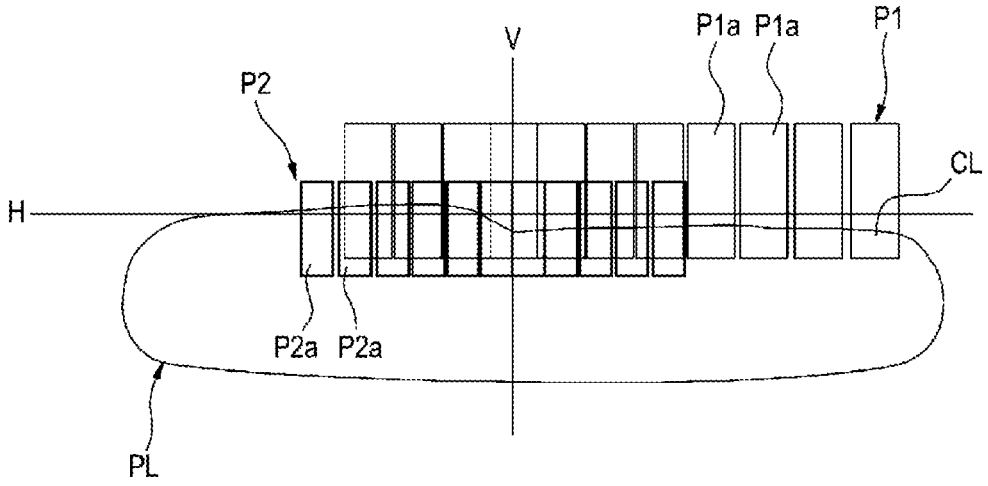
FIG. 41 is a schematic perspective view showing a light distribution pattern formed on a virtual vertical screen arranged in front of the lamp by the light irradiated from the vehicle lamp according to the third embodiment.

FIG. 41 shows a light distribution pattern projected on a virtual screen provided in a vertical direction at a position of 25 m in front of the lamp in the third embodiment. The light L emitted from the low-beam light source 14 and incident on the first incident surface 31*a* of the projection lens 12 is emitted from the exit surface 30 to form the low-beam light distribution pattern PL. The cut-off line CL is formed in the low-beam light distribution pattern PL by the shade portion 68.

The light LA1 emitted from the first array light source 16 and incident on the first incident surface 31*a* of the projection lens 12 is emitted from the exit surface 30 to form the additional light distribution pattern P1. The additional light distribution pattern P1 is a light distribution pattern in which the light distribution patterns P1*a* of the semiconductor light emitting elements 51 of the first array light source 16 are laterally arranged in a row Here, since the arrangement pitch of the semiconductor light emitting elements 51 of the first array light source 16 in the left and right direction of the lamp becomes denser as approaching the first rear focal point F1 of the projection lens 12, the illuminance at the central portion of the additional light distribution pattern P1 is increased and light is irradiated far.

The light LA2 emitted from the second array light source 17 and incident on the second incident surface 32*a* of the projection lens 12 is emitted from the exit surface 30 to form the additional light distribution pattern P2. The additional light distribution pattern P2 is a light distribution pattern in which the light distribution patterns P2*a* of the semiconductor light emitting elements 55 of the second array light source 17 are laterally arranged in a row.

The additional light distribution pattern P1 formed by the light LA1 emitted from the first array light source 16 is a high-beam light distribution pattern. On the virtual vertical screen in front of the lamp, the additional light distribution pattern P2 formed by the light LA2 emitted from the second array light source 17 overlaps with both the low-beam light distribution pattern PL formed by the light L emitted from the low-beam light source 14 and the additional high-beam light distribution pattern P1 formed by the light LA1 emitted from the first array light source 16.

Here, the low-beam light distribution pattern PL in which a cut-off line is formed by the shade portion 68 of the optical member 18 and the additional high-beam light distribution pattern P1 are difficult to overlap with each other and may not overlap with each other. Thus, the amount of light may be reduced.

On the contrary, in the vehicle lamp 10B according to the third embodiment, in a state where the low-beam light distribution pattern PL is formed and the additional light distribution pattern P1 as a high-beam light distribution pattern is formed, the additional light distribution pattern P2 is formed in a space between the low-beam light distribution pattern PL and the additional light distribution pattern P1 where the amount of light is reduced. In this way, the additional light distribution pattern P2 compensates for the space between the low-beam light distribution pattern PL and the additional light distribution pattern P1 where the amount of light is reduced.

Further, among the light distribution patterns projected on the virtual vertical screen in front of the lamp, the additional light distribution pattern P1 formed by the light LA1 emitted from the semiconductor light emitting elements 51 of the first array light source 16 and the additional light distribution pattern P2 formed by the light LA2 emitted from the semiconductor light emitting elements 55 of the second array light source 17 are offset in the left and right direction. Specifically, the additional light distribution pattern P1 formed by the first array light source 16 is shifted to the right, and the additional light distribution pattern P2 formed by the second array light source 17 is shifted to the left. Meanwhile, here, the offset means a configuration in which the light distribution pattern P1*a* and the light distribution pattern P2*a* are arranged so as to partially overlap with each other in the left and right direction or a configuration in which the light distribution pattern P1*a* and the light distribution pattern P2*a* are alternately arranged in the left and right direction without overlapping.

Figure 42:
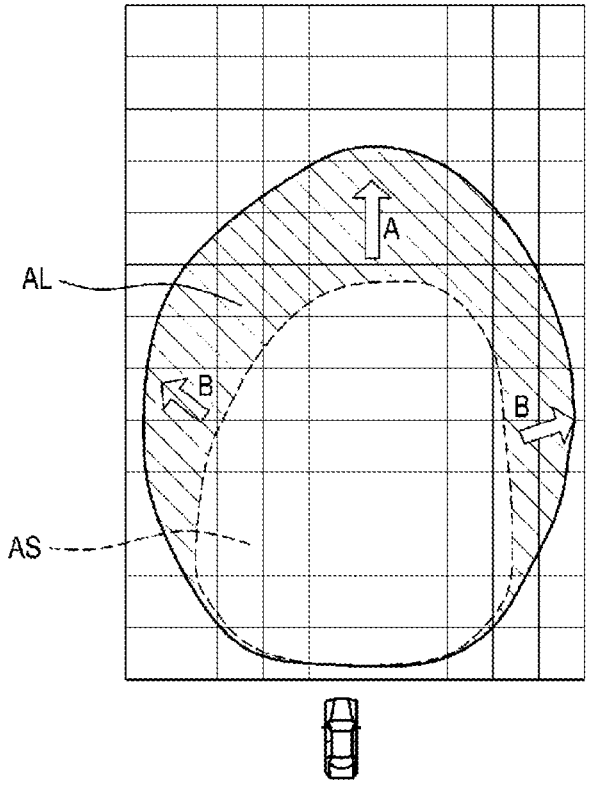
FIG. 42 is a schematic top view showing an irradiation range in front of a vehicle of the light irradiated from the vehicle lamp according to the third embodiment.

In this way, as shown in FIG. 42, while the road surface irradiation area AS is formed by a general vehicle lamp, in the present embodiment, the amount of light is supplemented by the additional light distribution pattern P2, and the additional light distribution pattern P1 and the additional light distribution pattern P2 are offset in the left and right direction, so that the road surface irradiation area AL enlarged to the front (direction of arrow A shown in FIG. 42) and in the left and right direction (direction of arrow A shown in FIG. 42) is formed.

Further, since the semiconductor light emitting elements 51 of the first array light source 16 and the semiconductor light emitting elements 55 of the second array light source 17 can be individually turned on, it is possible to form light distribution patterns suitable for various situations. For example, in the case where the additional light distribution pattern P1 is formed by turning off some of the semiconductor light emitting elements 51 of the first array light source 16 for irradiating the position of an oncoming vehicle so that light does not hit an oncoming vehicle detected by an in-vehicle camera, it is possible to widely irradiate the running road in front of the vehicle within a range not giving a glare to a driver of the oncoming vehicle. Similarly, in the case where the additional light distribution pattern P2 is formed by turning off some of the semiconductor light emitting elements 55 of the second array light source 17 for irradiating the position of an oncoming vehicle, it is possible to widely irradiate the running road in front of the vehicle within a range not giving a glare to a driver of the oncoming vehicle.

Further, in the present example, the low-beam light source 14 is described as an example of a light source of a projector type optical system. However, the disclosure is not limited to this example. This light source may be a light source of a projector type optical system (a projection type optical system using a reflector and a projection lens) and the light distribution pattern may be set in accordance with its application. For example, the light source may be a light source for forming a light distribution pattern suitable for road surface irradiation or a light source for forming a light distribution pattern to be irradiated toward a specific object.

As described above, according to the vehicle lamp 10B of the third embodiment, the first array light source 16 and the second array light source 17 are disposed behind the projection lens 12 having the first rear focal point F1 and the second rear focal point F2. Therefore, various optical systems can be designed, and the degree of freedom in designing the light distribution pattern can be improved. Further, in the exit surface 30 of the projection lens 12, the exit surface 30 is formed in a convex shape based on at least one circular arc. Therefore, the outline of the projection lens 12 is remarkably visually recognized when seeing the lamp from the front, so that it is possible to restrain the deterioration in the design of the appearance of the lamp. Further, on the incident surface of the projection lens 12, the boundary surface 33 is provided between the first incident surface 31*a* and the second incident surface 32*a*. Therefore, it is difficult for the boundary between the first incident surface 31*a* and the second incident surface 32*a* of the projection lens 12 to be visually recognized as a dividing line (bending line) from the front of the lamp when seeing the lamp from the front, so that it is possible to restrain the deterioration in the design of the appearance of the lamp.

In particular, since the boundary surface 33 is formed as the curved surface 34 recessed toward the exit surface 30, the boundary surface 33 becomes less conspicuous from the front of the lamp and it is possible to further restrain the deterioration in the design of the appearance of the lamp.

Meanwhile, the boundary surface 33 formed on the projection lens 12 is not limited to one having the curved surface 34 recessed toward the exit surface 30.

Here, the projection lens 12 having the boundary surface 33 with another shape will be described.

Figure 43:
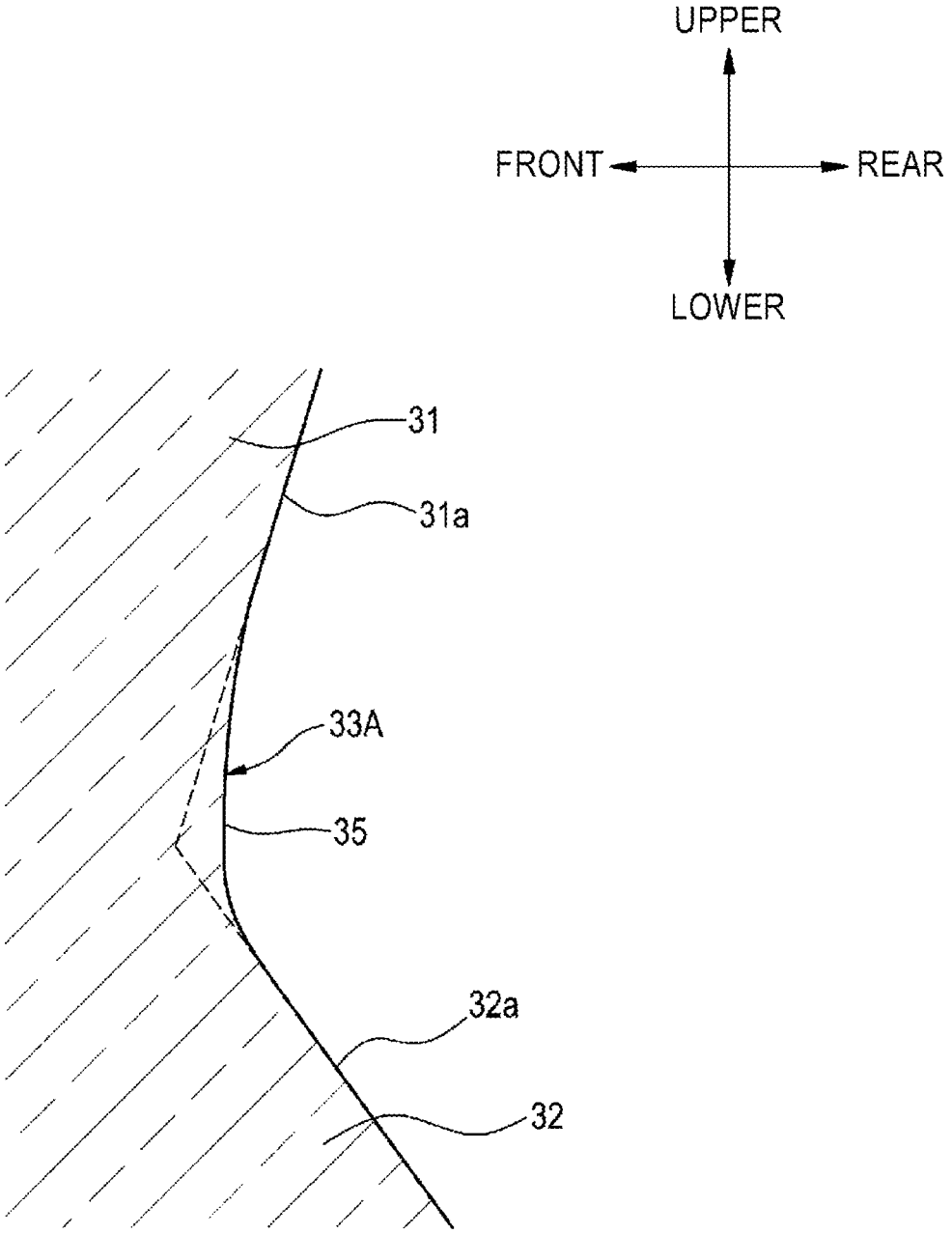
FIG. 43 is a sectional view of the boundary portion between the first lens portion and the second lens portion of the projection lens for explaining another example of a boundary surface.

For example, as shown in FIG. 43, the projection lens 12 may have a boundary surface 33A provided between the first incident surface 31*a* and the second incident surface 32*a* and having a flat surface 35. Even when the projection lens 12 has the boundary surface 33A having the flat surface 35 in this manner, the first incident surface 31*a* and the boundary surface 33A are formed to be smoothly continuous, and the second incident surface 32*a* and the boundary surface 33A are formed to be smoothly continuous. Therefore, when seeing the lamp from the front, the boundary surface 33A becomes less conspicuous from the front of the lamp and it is possible to restrain the deterioration in the design of the appearance of the lamp.

Figure 44:
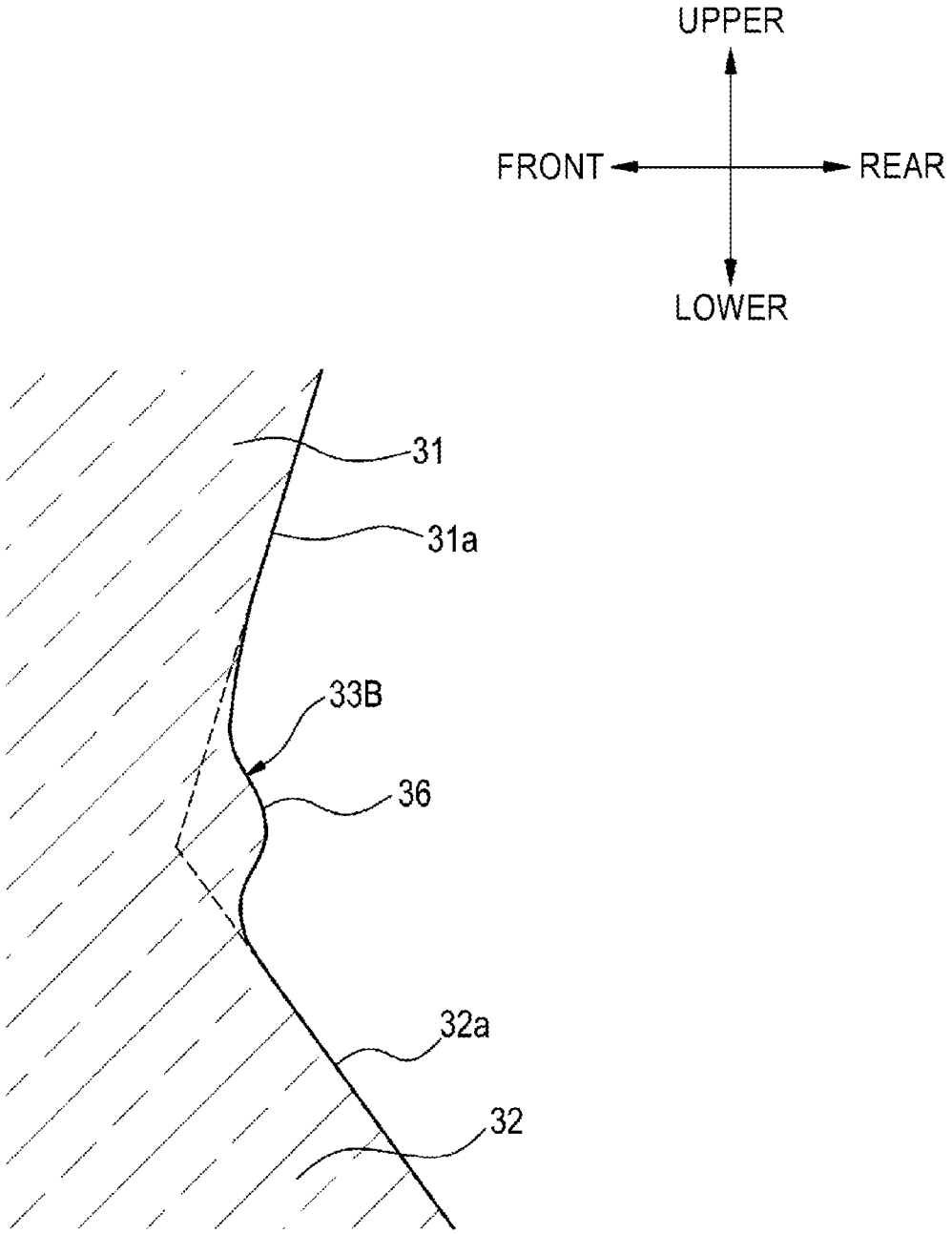
FIG. 44 is a sectional view of the boundary portion between the first lens portion and the second lens portion of the projection lens for explaining another example of a boundary surface.

Further, as shown in FIG. 44, the projection lens 12 may have a boundary surface 33B provided between the first incident surface 31*a* and the second incident surface 32*a* and formed as a convex curved surface 36 protruding toward the side opposite to the exit surface 30. Even when the projection lens 12 is formed to have the convex curved surface 36 protruding toward the side opposite to the exit surface 30 in this manner, the first incident surface 31*a* and the boundary surface 33B are formed to be smoothly continuous, and the second incident surface 32*a* and the boundary surface 33B are formed to be smoothly continuous. Therefore, the boundary surface 33B becomes less conspicuous from the front of the lamp and it is possible to restrain the deterioration in the design of the appearance of the lamp. Further, since the focal region formed by the curved surface 36 is dispersed vertically, the light passing through the curved surface 36 and irradiated to the front of the lamp is diffused, and a boundary line between an irradiation region and a non-irradiation region formed in front of the lamp can be made blurry.

Subsequently, modifications of the vehicle lamp 10B according to the present embodiment will be described.

Modification 1 of Third Embodiment

Figure 45A:
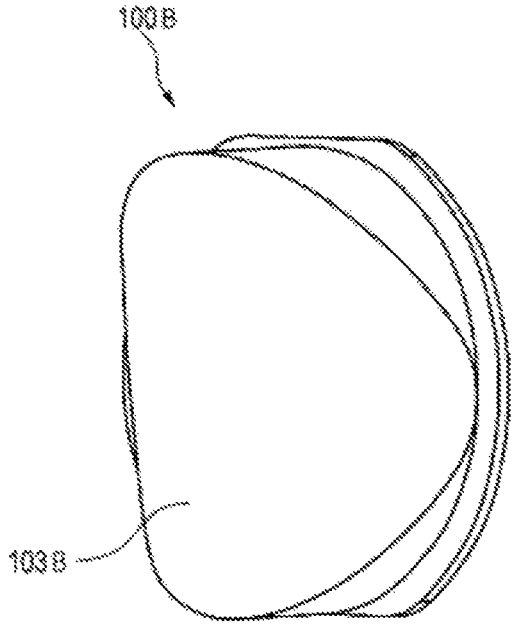
FIG. 45A and FIG. 45B are views for explaining a projection lens in a modification 1 of the third embodiment.
Figure 45B:
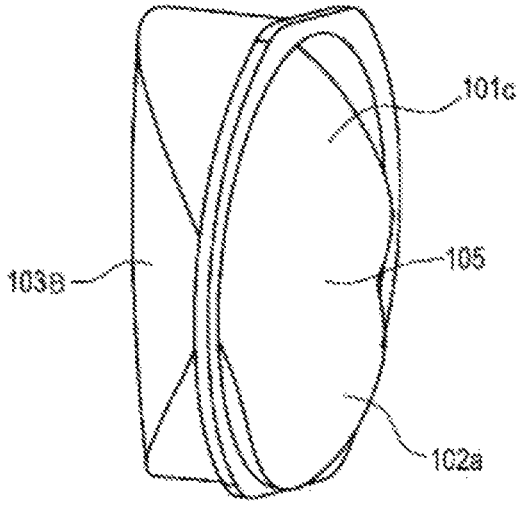

As shown in FIGS. 45A and 45B. FIGS. 46A to 46D, and FIG. 47, a lamp of a modification 1 of the third embodiment includes a projection lens 100B. The projection lens 100B has a first lens portion 101B and a second lens portion 102B. The first lens portion 101B forms the first rear focal point F1, and the second lens portion 102B forms the second rear focal point F2. In this manner, the projection lens 100B is a multifocal lens forming a plurality of focal points. The first lens portion 101B has a first incident surface 101*c*, and the second lens portion 102B has a second incident surface 102*a*. The light LA1 emitted from the first array light source 16 disposed at the position corresponding to the first rear focal point F1 is incident on the first incident surface 101*c*, and the light LA2 emitted from the second array light source 17 disposed at the position corresponding to the second rear focal point F2 is incident on the second incident surface 102*a*.

Also in this projection lens 100B, a boundary surface 105 is provided between the first incident surface 101*c* and the second incident surface 102*a*. The first incident surface 101*c* and the boundary surface 105 are formed to be smoothly continuous. Similarly, the second incident surface 102*a* and the boundary surface 105 are formed to be smoothly continuous.

The projection lens 100B has an exit surface 103B formed on the basis of one curved surface and has a circular shape as viewed from the front of the lamp.

The exit surface 103B of the projection lens 100B is configured by an outline based on two circular arcs as viewed from a first direction which is one of the upper and lower direction and the left and right direction, and is configured by an outline based on one circular arc as viewed from a second direction perpendicularly intersecting with the first direction.

Figure 46A:
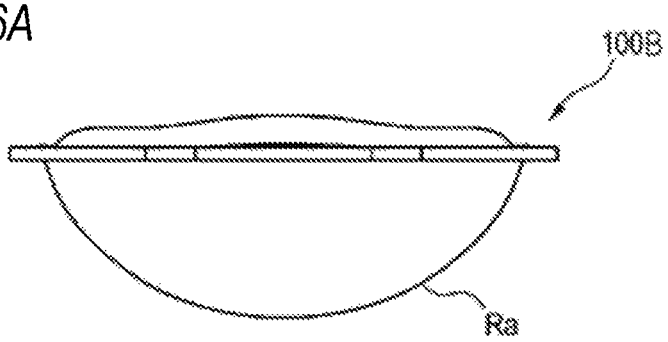
FIGS. 46A to 46D is a view for explaining the projection lens in the modification 1 of the third embodiment.
Figure 46B:
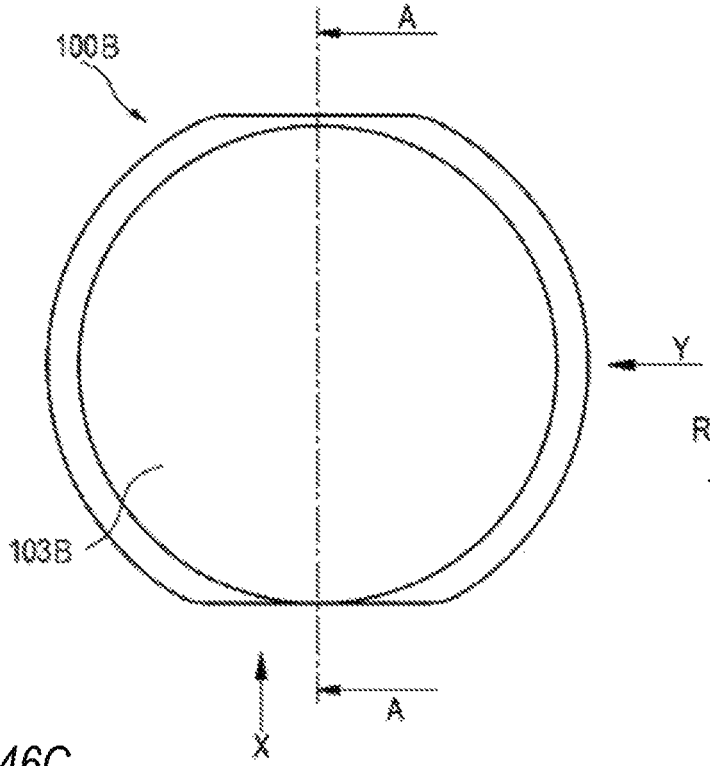
Figure 46D:
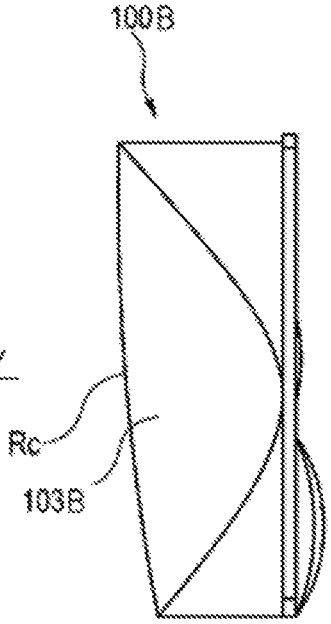
Figure 46C:
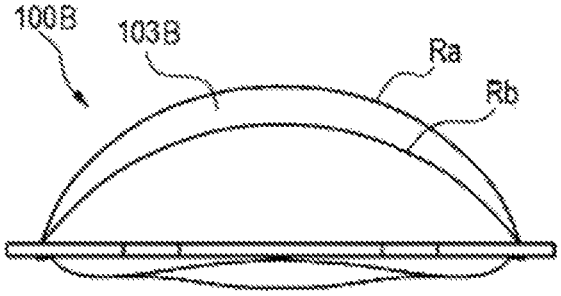

In this example, the upper and lower direction is the first direction, and the left and right direction perpendicularly intersecting with the first direction which is the upper and lower direction is the second direction. In this manner, as shown in FIG. 46C, the exit surface 103B of the projection lens 100B is configured by outlines Ra, Rb based on two circular arcs when seeing the projection lens 100B from the first direction, for example, from below (the direction of arrow X in FIG. 46B). The outline Ra has a radius of curvature smaller than the outline Rb. In other words, the outline Ra is formed in a curvature larger than the outline Rb. Furthermore, as shown in FIG. 46D, the exit surface 103B of the projection lens 100B is configured by an outline Rc based on one circular arc when seeing the projection lens 100B from the second direction, for example, from the right (the direction of arrow Y in FIG. 46B).

Figure 47:
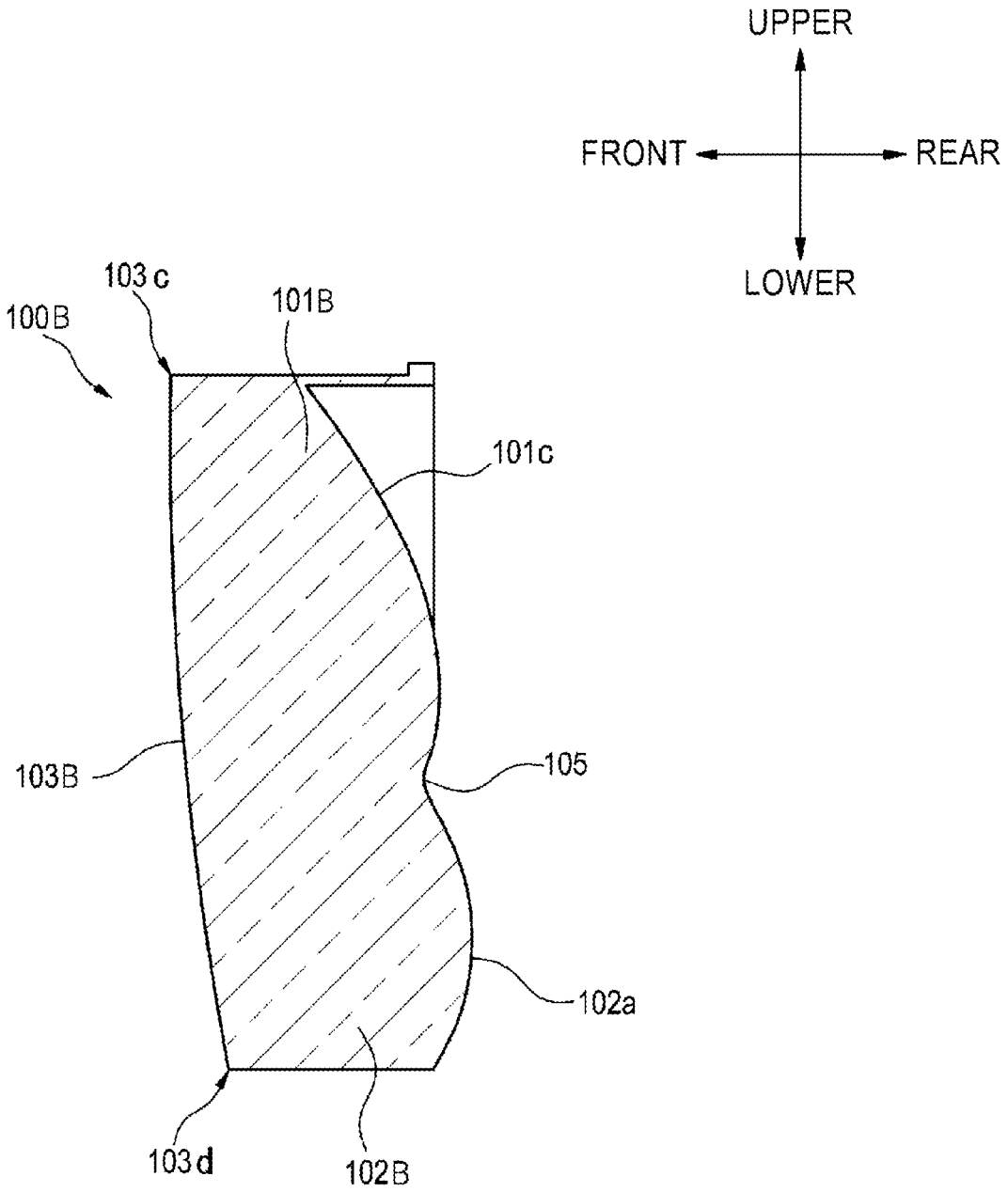
FIG. 47 is a sectional view taken along the line A-A in FIG. 46B.

Further, as shown in FIG. 47, in the projection lens 100B, an upper end position 103*c* of the exit surface 103B is located on the front side of the lamp than a lower end position 103*d*.

According to this configuration, it is easy to optically design the first rear focal point F1 and the second rear focal point F2 as a band-shaped focus group while maintaining the shape of the exit surface 103B in one curved surface shape. Specifically, it is possible to design a focus group according to the array shapes of the first array light source 16 and the second array light source 17.

Further, in the lamp of the modification 1 including the projection lens 100B, the light L, LA1 emitted from the low-beam light source 14 and the first array light source 16 is spread in the upper and lower direction when incident on the first incident surface 101*c* and is spread in the left and right direction when emitted from the exit surface 103B. Similarly, the light LA2 emitted from the second array light source 17 is spread in the upper and lower direction when incident on the second incident surface 102*a* and is spread in the left and right direction when emitted from the exit surface 103B. Therefore, the light L, LA1, LA2 emitted from the low-beam light source 14, the first array light source 16 and the second array light source 17 is spread in the upper and lower direction and the left and right direction, so that a wide range in front of the vehicle can be irradiated and the light distribution can be extended to the front and spread to the left and right.

Furthermore, also in the projection lens 100B, the boundary surface 105 is provided between the first incident surface 101*c* and the second incident surface 102*a*. Therefore, it is difficult for the boundary between the first incident surface 101*c* and the second incident surface 102*a* of the projection lens 100B to be visually recognized as a dividing line (bending line) from the front of the lamp when seeing the lamp from the front, so that it is possible to restrain the deterioration in the design of the appearance of the lamp.

Modification 2 of Third Embodiment

Figure 48:
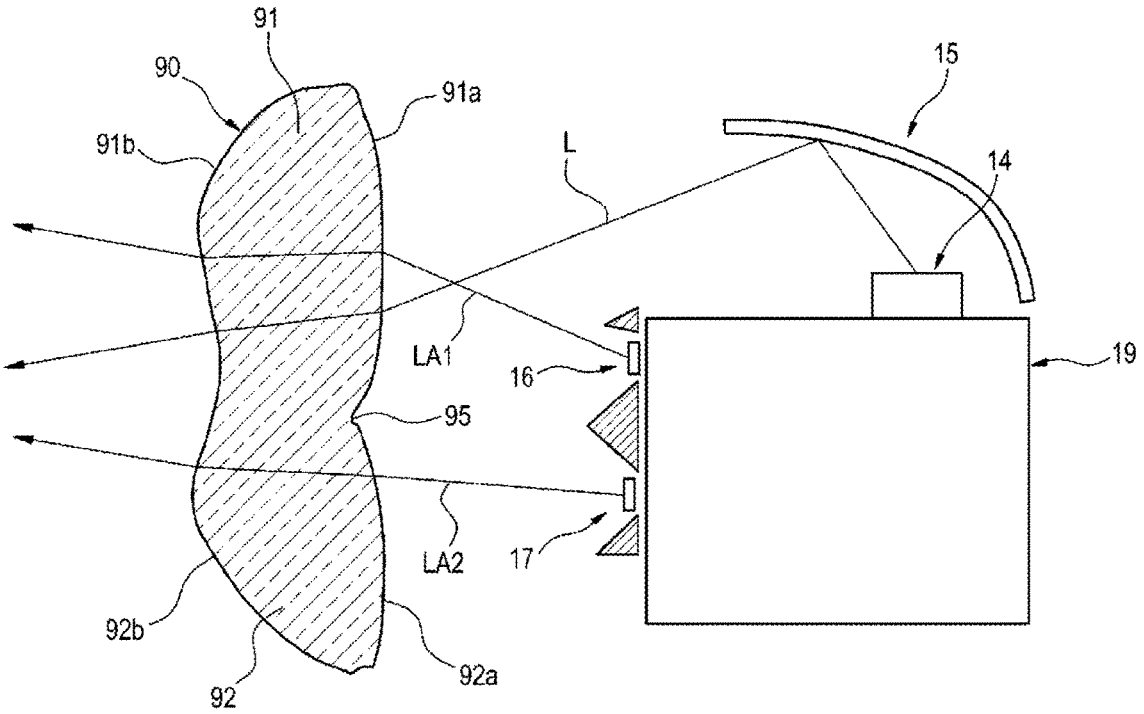
FIG. 48 is a schematic sectional view of a vehicle lamp for explaining a modification 2 of the third embodiment.

As shown in FIG. 48, similar to the modification 1 of the second embodiment, a lamp of a modification 2 of the third embodiment includes the projection lens 90 in which a convex shape of an exit surface is split up and down. Specifically, the projection lens 90 has the first lens portion 91 on the upper side and the second lens portion 92 on the lower side. The first lens portion 91 and the second lens portion 92 are integrated. The first lens portion 91 has the first incident surface 91*a* and the first exit surface 91*b*, and the second lens portion 92 has the second incident surface 92*a* and the second exit surface 92*b*.

In the projection lens 90 of the modification 2 of the third embodiment, a boundary surface 95 is provided between the first incident surface 91*a* and the second incident surface 92*a*. The first incident surface 91*a* and the boundary surface 95 are formed to be smoothly continuous. Similarly, the second incident surface 92*a* and the boundary surface 95 are formed to be smoothly continuous.

In the lamp of the modification 2, the light L emitted from the low-beam light source 14 and the light LA1 emitted from the first array light source 16 are incident on the first incident surface 91*a* of the first lens portion 91 and emitted from the first exit surface 91*b*. Further, the light LA2 emitted from the second array light source 17 is incident on the second incident surface 92*a* of the second lens portion 92 and emitted from the second exit surface 92*b*.

According to this structure, the light distribution pattern can be extended to the front and spread to the left and right while suppressing cost. Further, the boundary surface 95 between the first incident surface 91*a* and the second incident surface 92*a* makes it difficult for the boundary between the first incident surface 91*a* and the second incident surface 92*a* to be visually recognized, so that it is possible to restrain the deterioration in the design of the appearance of the lamp.

Modification 3 of Third Embodiment

Figure 49:
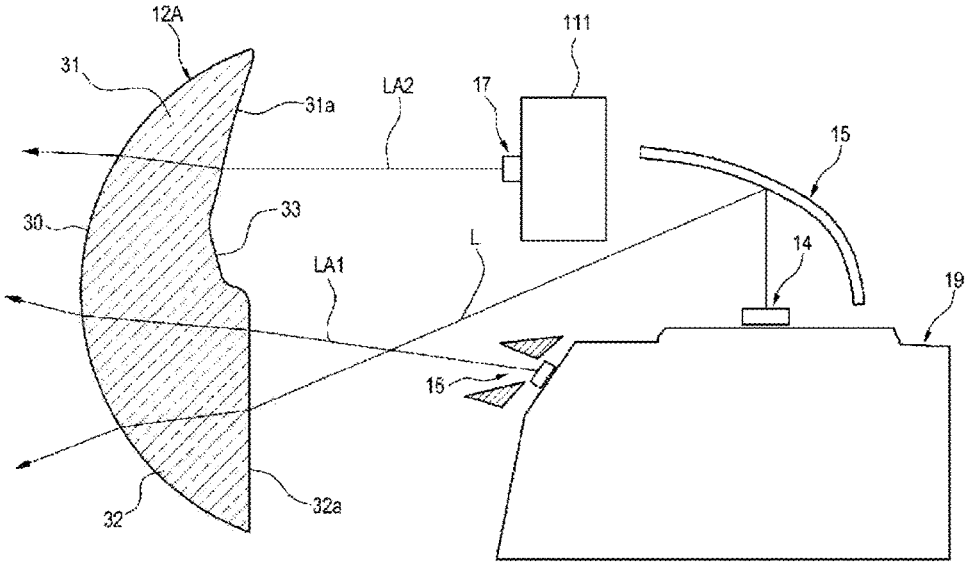
FIG. 49 is a schematic sectional view of a vehicle lamp for explaining a modification 3 of the third embodiment.

As shown in FIG. 49, similar to the modification 4 of the first embodiment and the modification 3 of the second embodiment, in a lamp of a modification 3 of the third embodiment, the second array light source 17 is supported not on the base member 19 but on the bracket 111 disposed at a position different from the base member 19, and the second array light source 17 is disposed above the first array light source 16.

In the lamp of the modification 3 of the third embodiment, the light L emitted from the low-beam light source 14 and the light LA1 emitted from the first array light source 16 are incident on the second incident surface 32*a* of a projection lens 12A and emitted from the exit surface 30. Further, the light LA2 emitted from the second array light source 17 is incident on the first incident surface 31*a* of the projection lens 12A and emitted from the exit surface 30.

According to this structure, the light distribution can be extended and spread while maintaining good appearance from the front of the lamp. Furthermore, the boundary surface 33 between the first incident surface 31*a* and the second incident surface 32*a* makes it difficult for the boundary to be visually recognized, so that it is possible to restrain the deterioration in the design of the appearance of the lamp.

Modification 4 of Third Embodiment

Figure 50:
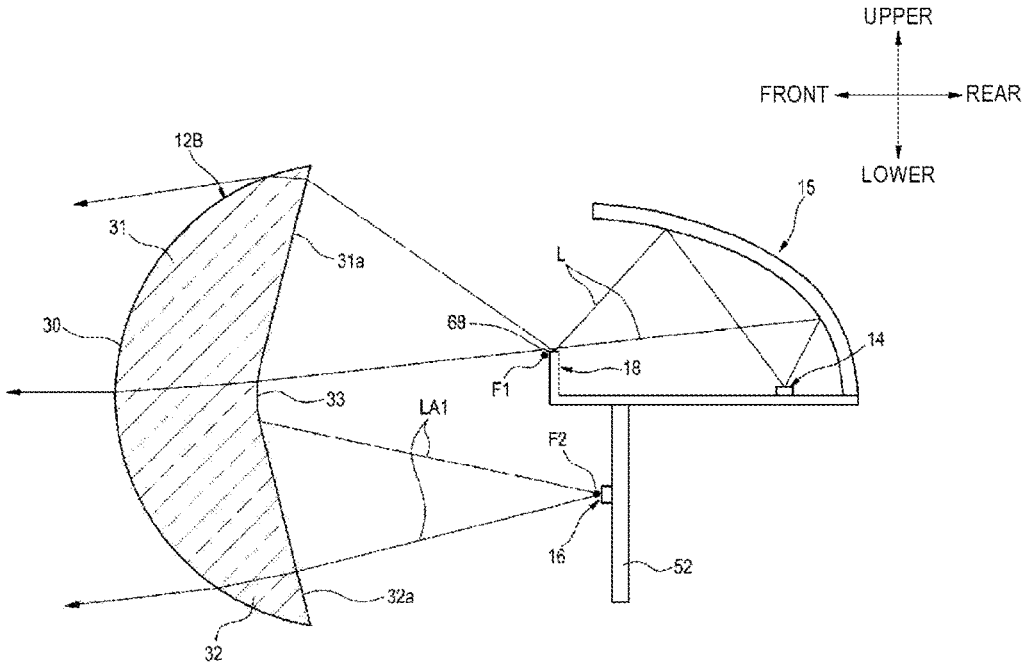
FIG. 50 is a schematic sectional view of a vehicle lamp for explaining a modification 4 of the third embodiment.

As shown in FIG. 50, a lamp of a modification 4 of the third embodiment includes the low-beam light source 14 and the first array light source 16 as a light source. The first array light source 16 is mounted on the substrate 52 and is provided so that the exit portion of the semiconductor light emitting elements 51 faces the first incident surface 31*a* of a projection lens 12B. Further, the first array light source 16 is disposed at the position corresponding to the second rear focal point F2 of the projection lens 12B. The shade portion 68 forming a cut-off line of a low-beam light distribution pattern by shielding a part of light emitted from the low-beam light source 14 is provided at the position corresponding to the first rear focal point F1 of the projection lens 12B. The shade portion 68 of the present example is provided above the low-beam light source 14 in the upper and lower direction of the lamp.

The light L emitted from the low-beam light source 14 is incident on the first incident surface 31*a* of the projection lens 12B. Further, the light LA1 emitted from the first array light source 16 is incident on the second incident surface 32*a* of the projection lens 12B. The light emitted from the low-beam light source 14 and incident on the first incident surface 31*a* is emitted from the exit surface 30 to form the low-beam light distribution pattern PL. The light LA1 emitted from the first array light source 16 and incident on the second incident surface 32*a* is emitted from the exit surface 30 to form the additional high-beam light distribution pattern P1.

According to this configuration, the light distribution can be extended and spread while maintaining good appearance from the front of the lamp. Further, the boundary surface 33 between the first incident surface 31*a* and the second incident surface 32*a* makes it difficult for the boundary to be visually recognized. Therefore, it is possible to restrain the deterioration in the design of the appearance of the lamp.

Modification 5 of Third Embodiment

Figure 51:
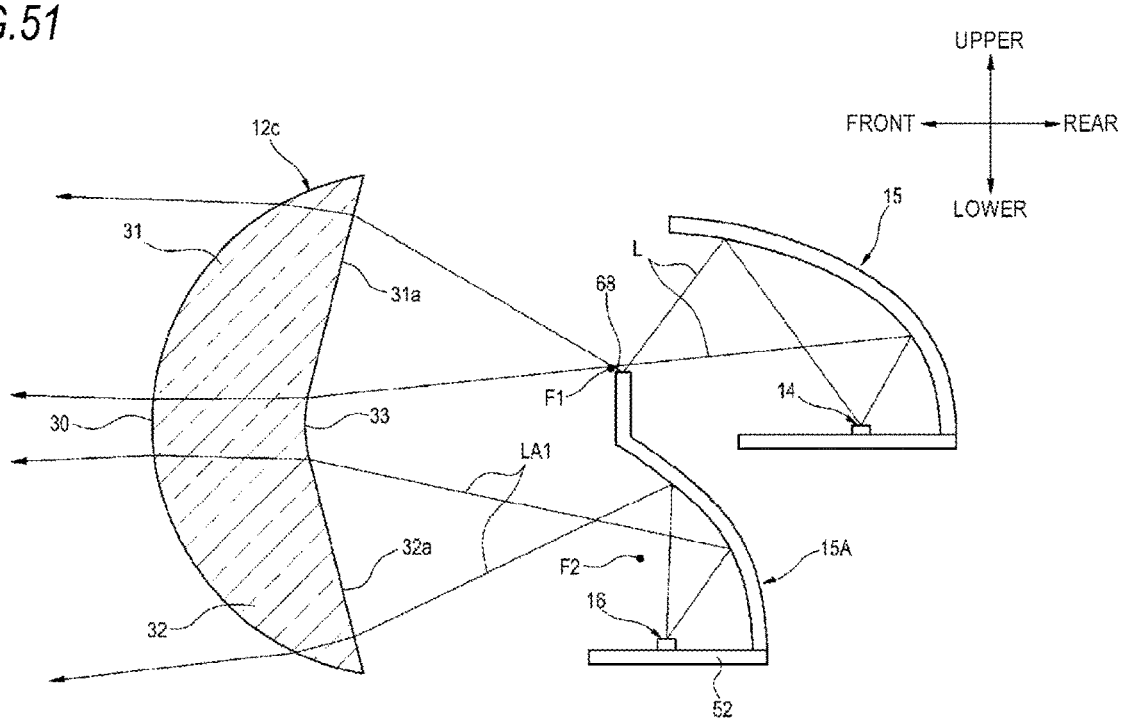
FIG. 51 is a schematic sectional view of a vehicle lamp for explaining a modification 5 of the third embodiment.

As shown in FIG. 51, a lamp of a modification 5 of the third embodiment includes the low-beam light source 14 and the first array light source 16 as a light source. Further, the lamp of the modification 5 includes a reflector 15A arranged to cover the first array light source 16 from the upper side. The first array light source 16 is mounted on the substrate 52 and is disposed so that the exit portion of the semiconductor light emitting elements 51 faces upward in the upper and lower direction of the lamp. An upper end of the reflector 15A serves as the shade portion 68 forming a cut-off line of a low-beam light distribution pattern by shielding a part of light emitted from the low-beam light source 14. The shade portion 68 is disposed at the position corresponding to the first rear focal point F1 of a projection lens 12C. The shade portion 68 of the present example is provided above the low-beam light source 14 in the upper and lower direction of the lamp.

The light emitted from the low-beam light source 14 is incident on the first incident surface 31*a* of the projection lens 12C. Further, the light LA1 emitted from the first array light source 16 is reflected by the reflector 15A and incident on the second incident surface 32*a* of the projection lens 12C. The light L emitted from the low-beam light source 14 and incident on the first incident surface 31*a* is emitted from the exit surface 30 to form the low-beam light distribution pattern PL. The light LA1 emitted from the first array light source 16 and incident on the second incident surface 32*a* is emitted from the exit surface 30 to form the additional high-beam light distribution pattern P1.

According to this configuration, similar to the modification 4 of the third embodiment, it is possible to restrain the deterioration in the design of the appearance of the lamp.

Modification 6 of Third Embodiment

Figure 52:
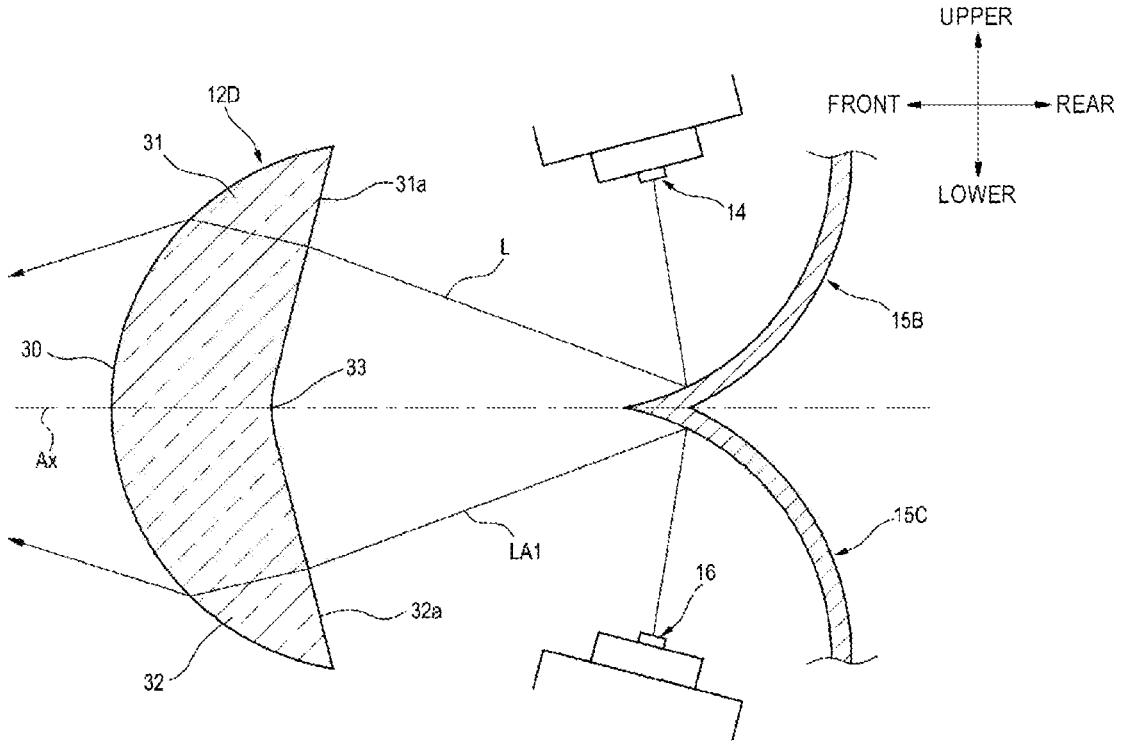
FIG. 52 is a schematic sectional view of a vehicle lamp for explaining a modification 6 of the third embodiment.

As shown in FIG. 52, a lamp of a modification 6 of the third embodiment includes the low-beam light source 14 and the first array light source 16 as a light source. Further, the lamp of the modification 6 includes a parabolic reflector 15B disposed to cover the lower side of the low-beam light source 14 and a parabolic reflector 15C disposed to cover the upper side of the first array light source 16. The low-beam light source 14 and the first array light source 16 are arranged to face each other with a central axis Ax extending in the front and rear direction of a vehicle between the first lens portion 31 and the second lens portion 32 therebetween. The low-beam light source 14 is arranged to face slightly rearward from above the central axis Ax, and the first array light source 16 is arranged to face slightly rearward from below the central axis Ax.

The light L emitted from the low-beam light source 14 is reflected by the reflector 15B and incident on the first incident surface 31*a* of a projection lens 12D. Further, the light LA1 emitted from the first array light source 16 is reflected by the reflector 15C and incident on the second incident surface 32*a* of the projection lens 12D. The light L emitted from the low-beam light source 14 and incident on the first incident surface 31*a* is emitted from the exit surface 30 to form the low-beam light distribution pattern PL. The light LA1 emitted from the first array light source 16 and incident on the second incident surface 32*a* is emitted from the exit surface 30 to form the additional high-beam light distribution pattern P1.

According to this configuration, various optical systems can be designed by a combination of reflectors, and the degree of freedom in designing the light distribution pattern can be improved.

Modification 7 of Third Embodiment

Figure 53:
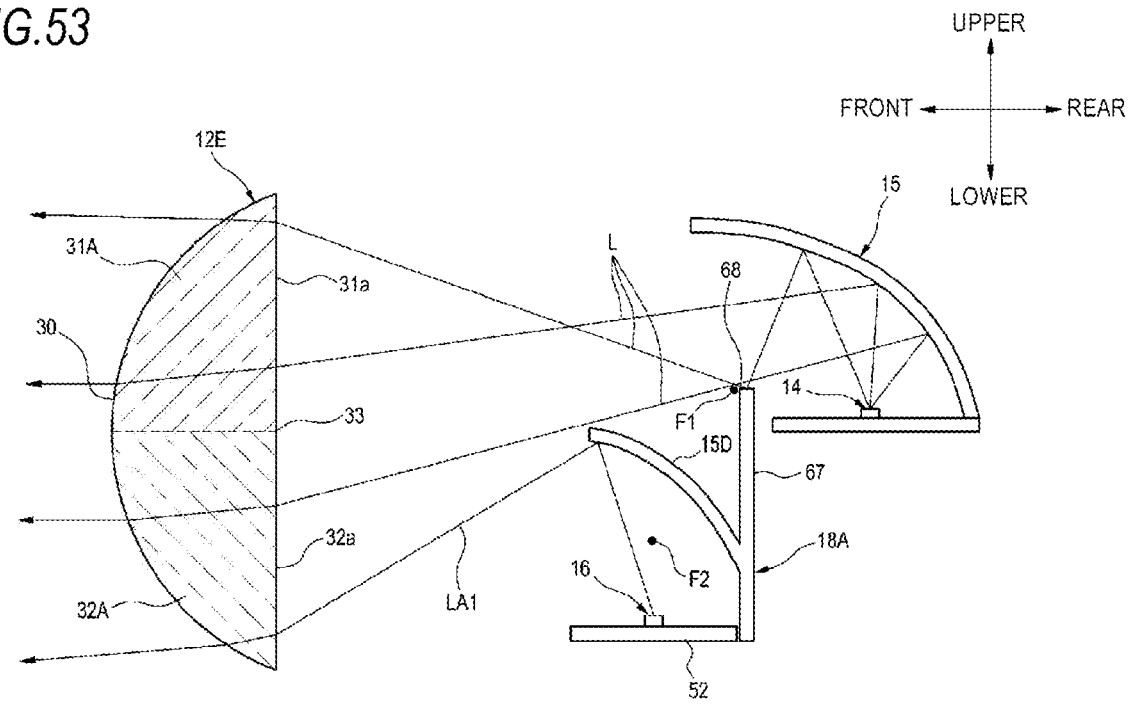
FIG. 53 is a schematic sectional view of a vehicle lamp for explaining a modification 7 of the third embodiment.

As shown in FIG. 53, a lamp of a modification 7 of the third embodiment includes a projection lens 12E configured by two kinds of lens portions (a first lens portion 31A and a second lens portion 32A) having different refractive indices. The projection lens 12E has the first lens portion 31A on the upper side and the second lens portion 32A on the lower side. The first lens portion 31A and the second lens portion 32A are integrated. The first lens portion 31A is formed of a material having a refractive index of N1, for example. The second lens portion 32A is formed of a material whose refractive index is larger than N1. In this manner, the first rear focal point F1 of the first lens portion 31A is disposed behind the second rear focal point F2 of the second lens portion 32A.

Further, the lamp of the modification 7 includes the low-beam light source 14 and the first array light source 16 as a light source. Furthermore, the lamp of the modification 7 includes the optical member 18A which has a reflector 15D formed to cover the first array light source 16 from the upper side and a vertical wall portion 67 extending vertically upward from a lower portion of the reflector 15D. The first array light source 16 is mounted on the substrate 52 and is disposed so that the exit portion of the semiconductor light emitting elements 51 faces upward in the upper and lower direction of the lamp. An upper end of the vertical wall portion 67 serves as the shade portion 68 forming a cut-off line of a low-beam light distribution pattern by shielding a part of light emitted from the low-beam light source 14. The shade portion 68 is provided at the position corresponding to the first rear focal point F1. The shade portion 68 of the present example is provided above the low-beam light source 14 in the upper and lower direction of the lamp. An upper end of the reflector 15D is provided at the position corresponding to the second rear focal point F2.

The light L emitted from the low-beam light source 14 is reflected by the reflector 15 and incident on the first incident surface 31*a* and the second incident surface 32*a* of the projection lens 12E. Further, the light LA1 emitted from the first array light source 16 is reflected by the reflector 15D and incident on the second incident surface 32*a* of the projection lens 12E. The light L emitted from the low-beam light source 14 is emitted from the exit surface 30 to form the low-beam light distribution pattern PL. The light LA1 emitted from the first array light source 16 is emitted from the exit surface 30 to form the additional high-beam light distribution pattern P1.

According to this configuration, similar to the modification 4 of the third embodiment, it is possible to restrain the deterioration in the design of the appearance of the lamp.

Subsequently, modifications common to the first to third embodiments will be described with reference to the drawings.

Modification 1 Common to First to Third Embodiments

In the first to third embodiments, the number of arrays in the left and right direction and the number of stages in the upper and lower direction of the semiconductor light emitting elements 51 of the first array light source 16 and the semiconductor light emitting elements 55 of the second array light source 17 can be increased. In this way, the resolution of the light distribution pattern can be improved.

Figure 54:
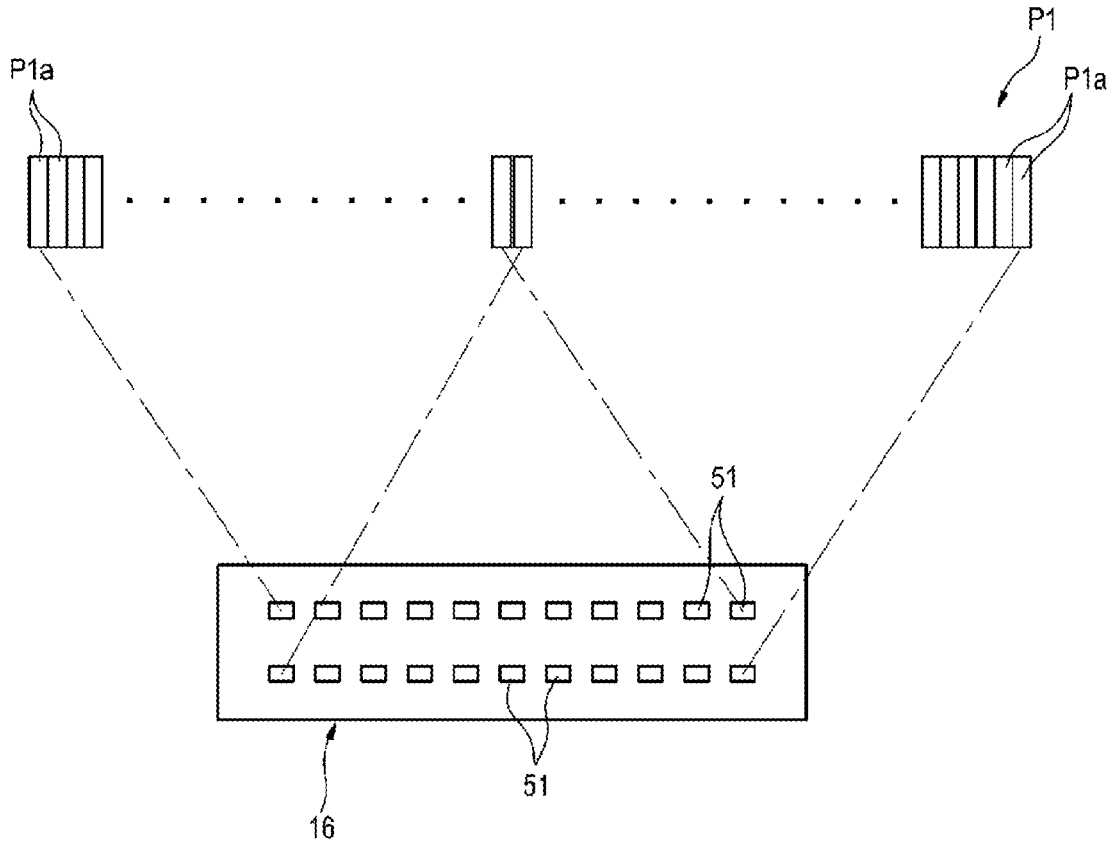
FIG. 54 is a schematic view for explaining how to form a light distribution pattern of an array light source in which rows of semiconductor light emitting elements are arranged in two stages, showing the modification 1 common to the first to third embodiments.

For example, when the semiconductor light emitting elements 51 of the first array light source 16 are arranged in two stages and the light distribution patterns P1*a* of the semiconductor light emitting elements 51 at each stage are arranged in a row as shown in FIG. 54, the light distribution pattern P1 formed by the first array light source 16 can be widened in the left and right direction and irradiated over a wide range while suppressing the width dimension. Further, the resolution can be improved. Similarly, when the semiconductor light emitting elements 55 of the second array light source 17 are arranged in two stages and the light distribution patterns P2*a* of the semiconductor light emitting elements 55 at each stage are arranged in a row, the light distribution pattern P2 formed by the second array light source 17 can be widened in the left and right direction and irradiated over a wide range while suppressing the width dimension of the lamp. Further, the resolution can be improved.

Modification 2 Common to First to Third Embodiments

Figure 55:
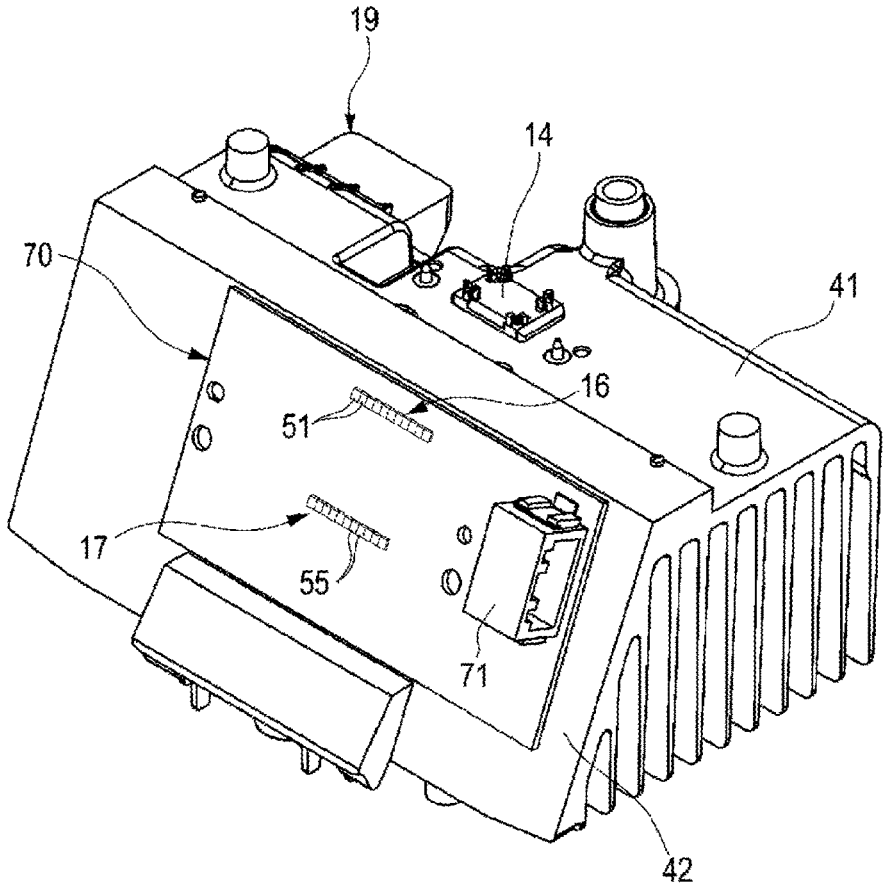
FIG. 55 is a perspective view of a base member on which a light source is mounted, showing the modification 2 common to the first to third embodiments.

As shown in FIG. 55, a lamp of a modification 2 common to the first to third embodiments includes a single rigid substrate 70. This rigid substrate 70 is, for example, a glass epoxy substrate or a paper phenol substrate. The rigid substrate 70 is fixedly attached to the second surface 42 which is an inclined surface of the base member 19. The first array light source 16 and the second array light source 17 are mounted on the rigid substrate 70 with a space in the upper and lower direction therebetween. A connector 71 is provided on one side portion of the rigid substrate 70. A connector (not shown) provided in a feeder line is connected to the connector 71, and power is supplied from the feeder line to the semiconductor light emitting elements 51 of the first array light source 16 and the semiconductor light emitting elements 55 of the second array light source 17.

According to this configuration, the first array light source 16 and the second array light source 17 can be easily arranged at predetermined positions with respect to the base member 19. Further, the relative positional deviation between the first array light source 16 and the second array light source 17 can be suppressed.

Modification 3 Common to First to Third Embodiments

Figure 56:
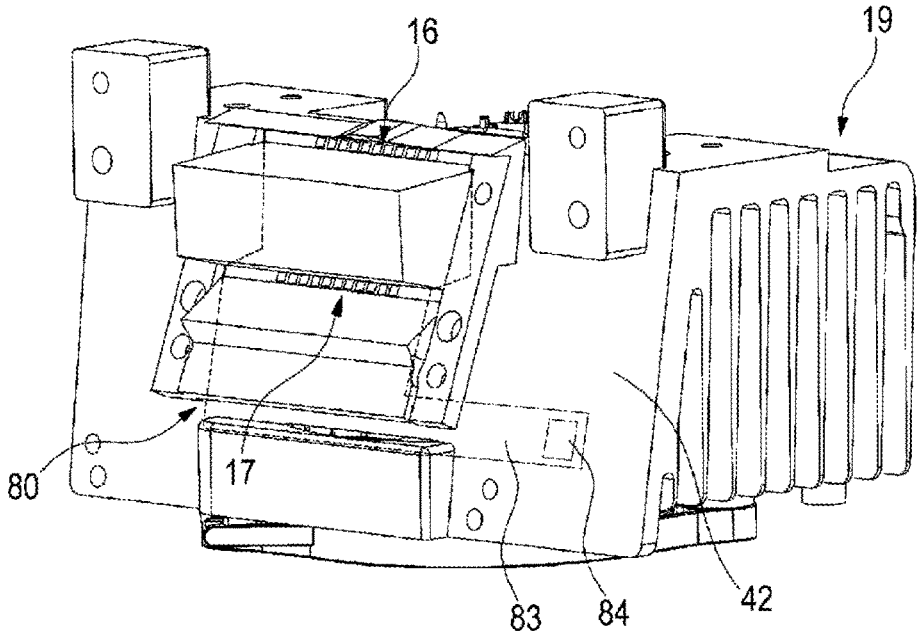
FIG. 56 is a perspective view of a base member on which a light source is mounted, showing the modification 3 common to the first to third embodiments.
Figure 57:
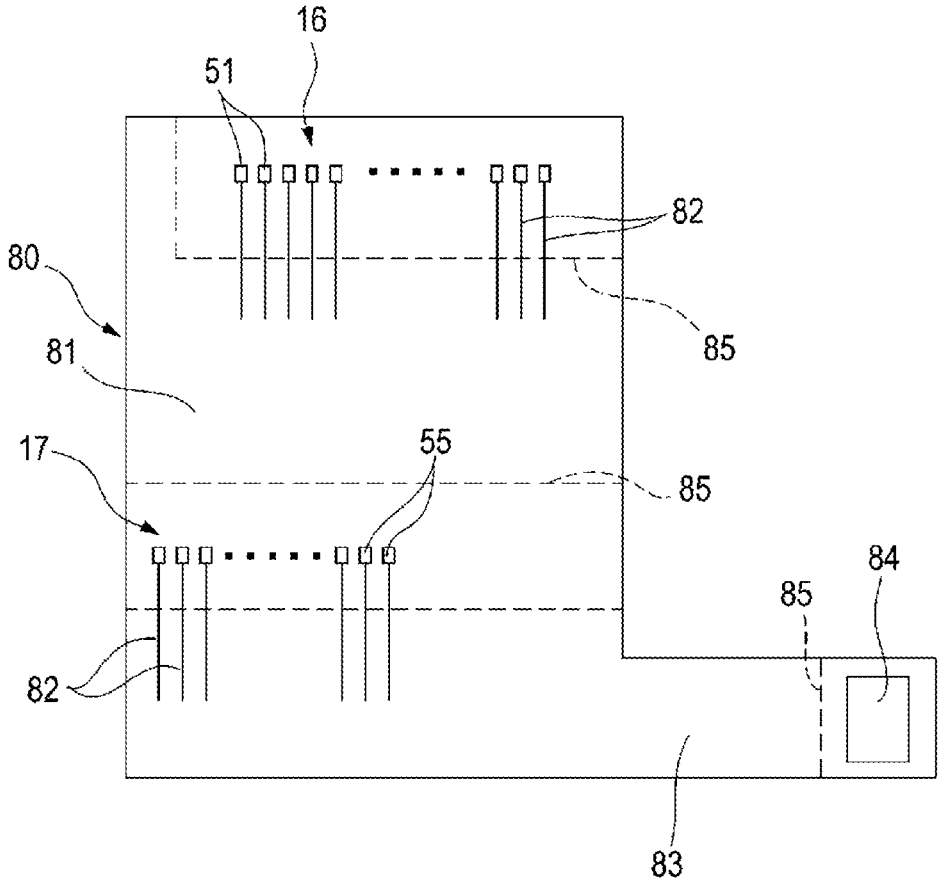
FIG. 57 is a schematic plan view of a flexible substrate, showing the modification 3 common to the first to third embodiments.

As shown in FIGS. 56 and 57, a lamp of a modification 3 common to the first to third embodiments includes a single flexible substrate 80. For example, this flexible substrate 80 is a substrate in which a wiring pattern 82 made of a copper foil is formed on a base body 81 made of a plastic film such as polyimide and having excellent flexibility. The flexible substrate 80 is fixedly attached to the second surface 42 which is an inclined surface of the base member 19. The first array light source 16 and the second array light source 17 are mounted on the flexible substrate 80 with a space in the upper and lower direction therebetween. A lead-out portion 83 extends on one side portion of the flexible substrate 80. A connector 84 is provided on the lead-out portion 83. A connector (not shown) provided in a feeder line is connected to the connector 84, and power is supplied from the feeder line to the semiconductor light emitting elements 51 of the first array light source 16 and the semiconductor light emitting elements 55 of the second array light source 17.

In the flexible substrate 80, the mounted portions of the semiconductor light emitting elements 51 of the first array light source 16 and the mounted portions of the semiconductor light emitting elements 55 of the second array light source 17 are attached to the second surface 42 configured by inclined surfaces of different angles in the base member 19. In this way, in the state where the flexible substrate 80 is attached to the base member 19, the exit portion configured by light emitting surfaces of the semiconductor light emitting elements 51 of the first array light source 16 is oriented in a direction different from the exit portion configured by light emitting surfaces of the semiconductor light emitting elements 55 of the second array light source 17 in the upper and lower direction of the lamp.

Meanwhile, preferably, a reinforcing plate 85 made of a metal plate such as an aluminum plate is provided on the portion of the flexible substrate 80 on which the semiconductor light emitting elements 51 of the first array light source 16, the semiconductor light emitting element 55 of the second array light source 17 and the connector 84 are mounted, and thus, the rigidity in the mounted portions of these parts is increased. In this way, the first array light source 16, the second array light source 17 and the connector 84 can be easily fixed to the base member 19. Further, when fixing the flexible substrate 80 to the base member 19, a thermally conductive adhesive or an aluminum plate or the like may be interposed between the base member 19 and the flexible substrate 80. In this way, the heat generated from the first array light source 16 and the second array light source 17 can be desirably transmitted to the base member 19. Further, the first array light source 16 and the second array light source 17 may be configured in such a manner that the semiconductor light emitting elements 51, 55 are directly mounted on the flexible substrate 80 or may be configured in such a manner that a substrate on which the semiconductor light emitting elements 51, 55 are mounted is mounted on the flexible substrate 80.

According to this configuration, the flexible substrate 80 can be placed while being bent, so that the workability when attaching the first array light source 16 and the second array light source 17 to the base member 19 is improved. Further, by using the flexible substrate 80, restrictions on arranging the first array light source 16 and the second array light source 17 in a predetermined posture are reduced. Therefore, the degree of freedom in designing a light distribution pattern formed by the first array light source 16 and the second array light source 17 is improved. Moreover, by using the flexible substrate 80, the lead-out portion 83 can be easily provided. For example, the connector 84 can be placed at a position that does not interfere with the lens holder 13 or a lamp component such as a positioning pin, thereby improving the degree of freedom in design.

Meanwhile, the disclosure is not limited to the above-described embodiments, but can be appropriately deformed or improved. In addition, the materials, shapes, dimensions, numerical values, modes, quantities, and locations and the like of the respective components in the above-described embodiments are arbitrary and not limited as long as they can achieve the disclosure.

The present application is based on Japanese Patent Application (Patent Application No. 2016-129204) filed on Jun. 29, 2016, Japanese Patent Application (Patent Application No. 2016-129205) filed on Jun. 29, 2016, Japanese Patent Application (Patent Application No. 2016-129206) filed on Jun. 29, 2016, and Japanese Patent Application (Patent Application No. 2016-203784) filed on Oct. 17, 2016, the contents of which are incorporated herein as a reference.

What is claimed is:

1. A vehicle lamp comprising:

a projection lens;

a light source disposed behind the projection lens and configured to emit light forming a predetermined light distribution pattern;

a reflector configured to reflect the light emitted from the light source toward a rear focal point of the projection lens; and an array light source disposed behind the projection lens and having a plurality of semiconductor light emitting elements arranged in at least one row, wherein the array light source is configured to emit light forming an additional light distribution pattern, and wherein the center position of the additional light distribution pattern overlaps with the predetermined light distribution pattern on a virtual vertical screen in front of the lamp.

2. The vehicle lamp according to claim 1, wherein the array light source is disposed at the position corresponding to the rear focal point.

3. The vehicle lamp according to claim 1, wherein the array light source has a first array light source and a second array light source, wherein the projection lens has a first lens portion forming a first rear focal point and a second lens portion forming a second rear focal point, and wherein the second array light source is disposed below the first array light source and configured to emit light forming the additional light distribution pattern, the light being incident on an incident surface of the second lens portion.

4. The vehicle lamp according to claim 3, wherein the first array light source is disposed at the position corresponding to the first rear focal point, and wherein the second array light source is disposed at the position corresponding to the second rear focal point.

5. The vehicle lamp according to claim 1, wherein the array light source has a first array light source and a second array light source, wherein the projection lens has a first lens portion forming a first rear focal point and a second lens portion forming a second rear focal point, and wherein the first array light source is disposed above the second array light source and configured to emit light forming the additional light distribution pattern, the light being incident on an incident surface of the second lens portion.

6. The vehicle lamp according to claim 5, comprising an optical member configured to cause the light emitted from the first array light source to be incident on the incident surface of the second lens portion, wherein the first array light source is disposed above the second rear focal point and the light is incident on the incident surface of the second lens portion via the optical member.

7. A vehicle lamp comprising:

a projection lens;

a light source disposed behind the projection lens and configured to emit light forming a predetermined light distribution pattern;

a reflector configured to reflect the light emitted from the light source toward the projection lens;

an array light source disposed behind the projection lens and having a plurality of semiconductor light emitting elements arranged in at least one row, an optical member disposed behind the projection lens; and a drive mechanism configured to move the optical member horizontally to a first position and a second position, wherein the optical member functions as a shade portion for forming a cut-off line in the predetermined light distribution pattern when the optical member is moved to the first position by the drive mechanism, and wherein a light distribution pattern larger than the light distribution pattern formed when the optical member is moved to the first position is formed when the optical member is moved to the second position by the drive mechanism.

8. The vehicle lamp according to claim 7, wherein the predetermined light distribution pattern is a first light distribution pattern for low beam, and wherein a second light distribution pattern formed by the light source when the optical member is moved to the second position by the drive mechanism is enlarged above the first light distribution pattern on a virtual vertical screen in front of the lamp.

9. The vehicle lamp according to claim 8, wherein the array light source is configured to emit light forming an additional light distribution pattern for high beam, and wherein the array light source is configured so that the second light distribution pattern and the additional light distribution pattern overlap with each other on the virtual vertical screen in front of the lamp when the optical member is moved to the second position by the drive mechanism.

10. The vehicle lamp according to claim 7, wherein the optical member also functions as a reflector configured to reflect at least a part of light emitted from the array light source toward the projection lens when moved to the first position by the drive mechanism.

11. The vehicle lamp according to claim 7, comprising a base member on which the light source and the array light source are disposed, wherein the optical member is a part separate from the base member and is moved to the first position and the second position along a front and rear direction of the lamp by the drive mechanism.

12. The vehicle lamp according to claim 7, wherein the array light source has a first array light source and a second array light source, wherein the projection lens has a first lens portion forming a first rear focal point and a second lens portion forming a second rear focal point, wherein the first array light source is disposed at the position corresponding to the first rear focal point, and wherein the second array light source is disposed below the first array light source and at the position corresponding to the second rear focal point.

13. A vehicle lamp comprising;

a projection lens having a convex exit surface based on at least one circular arc and having a first rear focal point and a second rear focal point;

a first light source disposed behind the projection lens; and a second light disposed behind the projection lens;

wherein the projection lens has a first lens portion forming the first rear focal point and a second lens portion forming the second rear focal point, wherein a boundary surface is provided between a first incident surface of the first lens portion and a second incident surface of the second lens portion, wherein the first incident surface and the boundary surface are formed to be smoothly continuous, wherein the second incident surface and the boundary surface are formed to be smoothly continuous, and wherein the first and second incident surfaces have different angles with respect to the horizontal plane.

14. The vehicle lamp according to claim 13, wherein the boundary surface is formed as a curved surface recessed toward the exit surface.

15. The vehicle lamp according to claim 13,
wherein the boundary surface comprises a flat surface.

16. The vehicle lamp according to claim 13,
wherein the boundary surface is formed as a convex curved surface protruding toward the side opposite to the exit surface.

17. The vehicle lamp according to claim 13,
wherein the exit surface is formed on the basis of a single curved surface, and
wherein the exit surface of the projection lens is configured by an outline based on two circular arcs when seeing the projection lens from a first direction which is one of an upper and lower direction and a left and right direction, and the exit surface of the projection lens is configured by an outline based on one circular arc when seeing the projection lens from a second direction perpendicularly intersecting with the first direction.

18. The vehicle lamp according to claim 1,
wherein the array light source is positioned off-center in relation to the light source.

* * * * *